US007867593B2

(12) United States Patent
Hoshino et al.

(10) Patent No.: US 7,867,593 B2
(45) Date of Patent: Jan. 11, 2011

(54) TAPE FOR TAPE PRINTER

(75) Inventors: Terumasa Hoshino, Nagoya (JP); Yasunori Nakamura, Shinshiro (JP); Haruki Matsumoto, Nagoya (JP); Tsutomu Kato, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 987 days.

(21) Appl. No.: 11/078,586

(22) Filed: Mar. 14, 2005

(65) Prior Publication Data

US 2005/0214054 A1 Sep. 29, 2005

(30) Foreign Application Priority Data

Mar. 17, 2004 (JP) ..... 2004-077294
Mar. 31, 2004 (JP) ..... 2004-106573

(51) Int. Cl.
*G09F 3/00* (2006.01)

(52) U.S. Cl. ..... 428/41.8; 428/40.1; 428/42.1; 400/613

(58) Field of Classification Search ..... 400/613, 400/613.2, 615.2, 621; 347/104, 217; 156/361; 355/28, 29

See application file for complete search history.

(56) References Cited

U.S. PATENT DOCUMENTS 4,573,059 A 2/1986 Shinma et al.
5,061,946 A 10/1991 Helmbold et al.
5,373,762 A 12/1994 Kato
5,374,132 A 12/1994 Kimura
5,488,223 A 1/1996 Austin et al.
5,653,542 A 8/1997 Sugimoto et al.
5,713,679 A 2/1998 Taylor et al.
5,943,085 A 8/1999 Higashi et al.
6,109,804 A 8/2000 Higashi et al.
6,380,965 B1 * 4/2002 Sims et al. ..... 347/218

(Continued)

FOREIGN PATENT DOCUMENTS

EP 0 872 352 A1 10/1998

(Continued)

OTHER PUBLICATIONS

Nov. 17, 2009 Office Action for Japanese Patent Application No. 2004-077294 (with English translation).

(Continued)

*Primary Examiner*—Daniel J Colilla
(74) *Attorney, Agent, or Firm*—Oliff & Berridge, PLC

(57) ABSTRACT

A roll sheet has a release paper as a base sheet. A recording paper is attached to the release paper via an adhesive layer so that the recording paper can be peeled off from the release paper. First and second peel-away areas are formed on both side edges of the roll sheet in the widthwise direction thereof by peeling off both widthwise edges of the recording paper from the release paper to allow the release paper to be exposed at the both side edges of the roll sheet. Sensor marks are printed on the release paper as being entirely shifted from the peel-away areas. This ensures that the roll sheet has a uniform thickness over the entire area of each sensor mark, thereby ensuring that each sensor mark has uniformities in its reflectivity and transmittance with respect to incident light.

6 Claims, 35 Drawing Sheets

U.S. PATENT DOCUMENTS

| | | | | |
|---|---|---|---|---|
| 6,648,533 | B2 * | 11/2003 | Lo et al. | 400/621 |
| 7,021,214 | B2 * | 4/2006 | Kugo et al. | 101/485 |
| 7,121,751 | B2 * | 10/2006 | Harada et al. | 400/615.2 |
| 2002/0122206 | A1 * | 9/2002 | Currans et al. | 358/1.18 |
| 2004/0050941 | A1 * | 3/2004 | Hanyu et al. | 235/487 |
| 2005/0149349 | A1 * | 7/2005 | Travis | 705/2 |

FOREIGN PATENT DOCUMENTS

| | | | |
|---|---|---|---|
| GB | 2 152 005 | A | 7/1985 |
| JP | U 59-005349 | | 1/1984 |
| JP | U 3-19047 | | 2/1991 |
| JP | A 04-049074 | | 2/1992 |
| JP | 05229542 | A * | 9/1993 |
| JP | A-05-246414 | | 9/1993 |
| JP | A-06-127094 | | 5/1994 |
| JP | A 06-286239 | | 10/1994 |
| JP | A-07-314866 | | 12/1995 |
| JP | 09016085 | A * | 1/1997 |
| JP | A-09-164742 | | 6/1997 |
| JP | A-10-194541 | | 7/1998 |
| JP | A 10-264458 | | 10/1998 |
| JP | A 10-291707 | | 11/1998 |
| JP | A-11-078128 | | 3/1999 |
| JP | A-2001-305958 | | 11/2001 |
| JP | 2004026363 | A * | 1/2004 |

OTHER PUBLICATIONS

May 11, 2010 Office Action issued in JP 2004-077294 with English-language translation.

* cited by examiner 3
12
13
37
55
56
62
12A
60D
60E
60
40
44
45
43
42
20
36
UP
DOWN
RIGHT
FRONT
REAR
LEFT
43C
43B
43A
35
47
48
30μm
20μm
10μm
57
60A 3
20
44
45
36
40
43
42
60
48
35
47
12
13
55
37
56
57
12A
43A
43B
43C
XI
XII
62
10m
20m
30m
UP
DOWN
FRONT
REAR
LEFT
RIGHT

TAPE FOR TAPE PRINTER

BACKGROUND OF THE INVENTION

1. Field of the Invention

The present invention relates to a tape for a tape printer.

2. Description of Related Art

Japanese Unexamined Utility Model Application Publication No. Hei-3-19047 has proposed a tape printer that prints characters and others on a long thermal tape by using a thermal head.

The long tape is prepared in a roll sheet wound on a roll core. A roll sheet holder rotatably holds the roll sheet therein. The roll sheet holder is removably mounted in the tape printer. Part of the roll sheet is drawn or unwound from the roll and is fed for printing.

SUMMARY OF THE INVENTION

It is necessary to accurately feed the roll sheet in order to attain accurate printing onto the roll sheet.

Japanese unexamined patent application publication No. Hei-10-291707 discloses attaching, to a trailing end of a roll sheet, a small slip of paper, whose width is smaller than that of the roll sheet, thereby enabling the tape printer to detect the trailing end of the roll sheet by detecting a change in the width of the roll sheet. However, it is troublesome to attach the small slip of paper onto the roll sheet.

It is an objective of the present invention to provide a tape which can be accurately fed and printed by a tape printer.

It is another object of the present invention to provide a tape which can be easily produced but whose trailing end can be accurately detected by a tape printer.

In order to attain the above and other objects, the present invention provides a tape. The tape includes: a release layer; and a recording medium. The release layer is elongated to extend in a lengthwise direction and has a pair of side edges that extend along the lengthwise direction. The pair of side edges are separate from each other in a widthwise direction that is substantially perpendicular to the lengthwise direction. The release layer has a first surface and a second surface opposite to the first surface. The entire area of the second surface includes a pair of non-recording regions and a recording region. The pair of non-recording regions extend along both side edges of the second surface, and the recording region is located between the pair of non-recording regions. The plurality of sensor marks are formed on the first surface. The sensor marks are arranged in the lengthwise direction. The entire part of each sensor mark is located on the first surface at a region that corresponds to the recording region and that is shifted from the pair of non-recording regions. The recording medium is provided over the recording region of the second surface of the release layer via an adhesive layer. The recording medium is able to be peeled off from the release layer.

According to another aspect, the present invention provides a tape. The tape is rolled up with a trailing end line being located at the innermost part of the roll. The tape includes: a release layer; and a recording medium. The release layer is elongated to extend in a lengthwise direction from its trailing end and has a pair of side edges that are separate from each other in a widthwise direction that is substantially perpendicular to the lengthwise direction. The release layer has a trailing end line that is located on the trailing end and that extends in the widthwise direction. The release layer has a first surface and a second surface opposite to the first surface. A plurality of sensor marks are formed on the first surface. The sensor marks are arranged in the lengthwise direction. The recording medium is provided over the second surface of the release layer via an adhesive layer. The recording medium is able to be peeled off from the release layer. The trailing end line is located at the innermost part of the roll with the printing medium facing inward and the first surface of the release layer facing outward. The folding line is defined at a distance away from the trailing end line in the lengthwise direction. An end portion is defined between the trailing end line and the folding line, and a next-to-end portion is defined next to the end portion in the lengthwise direction to have a length the same as the end portion along the lengthwise direction. The tape is folded at the folding line, with the release layer in the end portion facing the release layer in the next-to-end portion to prevent the sensor marks on the release layer in the end portion and in the next-to-end portion from being exposed.

According to another aspect, the present invention provides a combination of a tape and a tape printer. The tape printer includes: a feeding device that feeds a tape in a feeding direction; an optical sensor that optically detects the tape while the tape is being fed by the feeding device; and a printing device that performs printing on the tape while the tape is being fed by the feeding device. The tape includes: a release layer and a recording medium. The release layer is elongated to extend in a lengthwise direction and has a pair of side edges that are separate from each other in a widthwise direction that is substantially perpendicular to the lengthwise direction and that extend along the lengthwise direction. The release layer has a first surface and a second surface opposite to the first surface. The entire area of the second surface includes a pair of non-recording regions and a recording region. The pair of non-recording regions extend along both side edges of the second surface. The recording region is located between the pair of non-recording regions. The plurality of sensor marks are formed on the first surface. The sensor marks are arranged in the lengthwise direction. The entire part of each sensor mark is located on the first surface at a region that corresponds to the recording region and that is shifted from the pair of non-recording regions. The feeding device feeds the tape while setting the lengthwise direction the same as the feeding direction and while allowing the first surface of the release layer to confront the optical sensor. The sensor detects the sensor marks. The recording medium is provided over the recording region of the second surface of the release layer via an adhesive layer. The recording medium is able to be peeled off from the release layer. The feeding device feeds the tape while allowing the recording medium to confront the printing device. The printing device performs printing on the recording medium.

According to another aspect, the present invention provides a combination of a tape and a tape printer. The tape is rolled up with a trailing end line being located at the innermost part of the roll. The tape printer includes: a feeding device that unwinds a part of the tape from a roll of the tape and feeds the unwound part of the tape along a feed path in a feeding direction; an optical sensor that is located confronting the feed path and that optically detects the tape while the tape is being fed by the feeding device; and a printing device that is located confronting the feed path and that performs printing on the tape while the tape is being fed by the feeding device. The tape includes: a release layer and a recording medium. The release layer is elongated to extend in a lengthwise direction from a trailing end line. The release layer has a first surface and a second surface opposite to the first surface. A plurality of sensor marks are formed on the first surface. The sensor marks are arranged in the lengthwise direction. The feeding device feeds the tape while setting the lengthwise direction the same as the feeding direction and while allowing the first surface of the release layer to confront the optical sensor. The optical sensor detects the sensor marks. The recording medium is provided over the second surface of the release layer via an adhesive layer. The recording medium is able to be peeled off from the release layer. The feeding device feeds the tape while allowing the recording medium to confront the printing device. The printing device performs printing on the recording medium. The trailing end line is located at the innermost part of the roll with the printing medium facing inward and the first surface of the release layer facing outward. A folding line is defined at a distance away from the trailing end line in the lengthwise direction. An end portion is defined between the trailing end line and the folding line. A next-to-end portion is defined next to the end portion in the lengthwise direction to have a length the same as the end portion along the lengthwise direction. The tape is folded at the folding line, with the release layer in the end portion facing the release layer in the next-to-end portion to prevent the sensor marks on the release layer in the end portion and in the next-to-end portion from being exposed, thereby preventing the optical sensor to detect the sensor marks on the release layer in the end portion and in the next-to-end portion.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF THE PREFERRED EMBODIMENT

Figure 1:
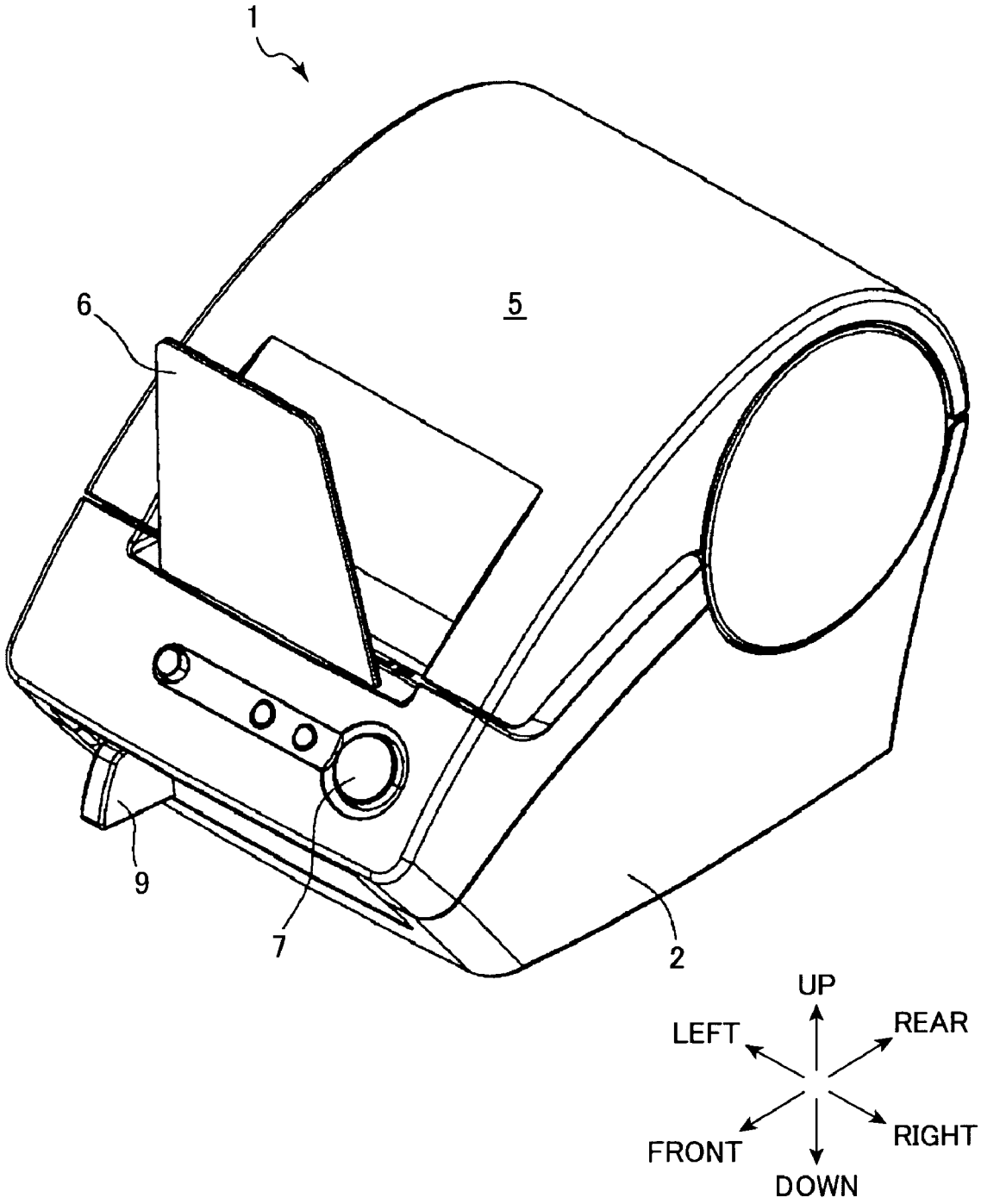
FIG. 1 is a schematic perspective view of a tape printer according to an embodiment of the present invention.

A tape for a tape printer according to a preferred embodiment of the present invention will be described while referring to the accompanying drawings wherein like parts and components are designated by the same reference numerals to avoid duplicating description.

In the following description, the expressions "front", "rear", "upper", "lower", "right", and "left" of the tape printer are used to define the various parts when the tape printer is disposed in an orientation in which it is intended to be used. Similarly, the expressions "front", "rear", "upper", "lower", "right", and "left" of the roll sheet are used to define the various parts when the roll sheet is disposed in an orientation in which it is intended to be used in the tape printer.

A schematic structure of the tape printer in the embodiment will be described below with reference to FIGS. 1 through 13(F).

Figure 2:
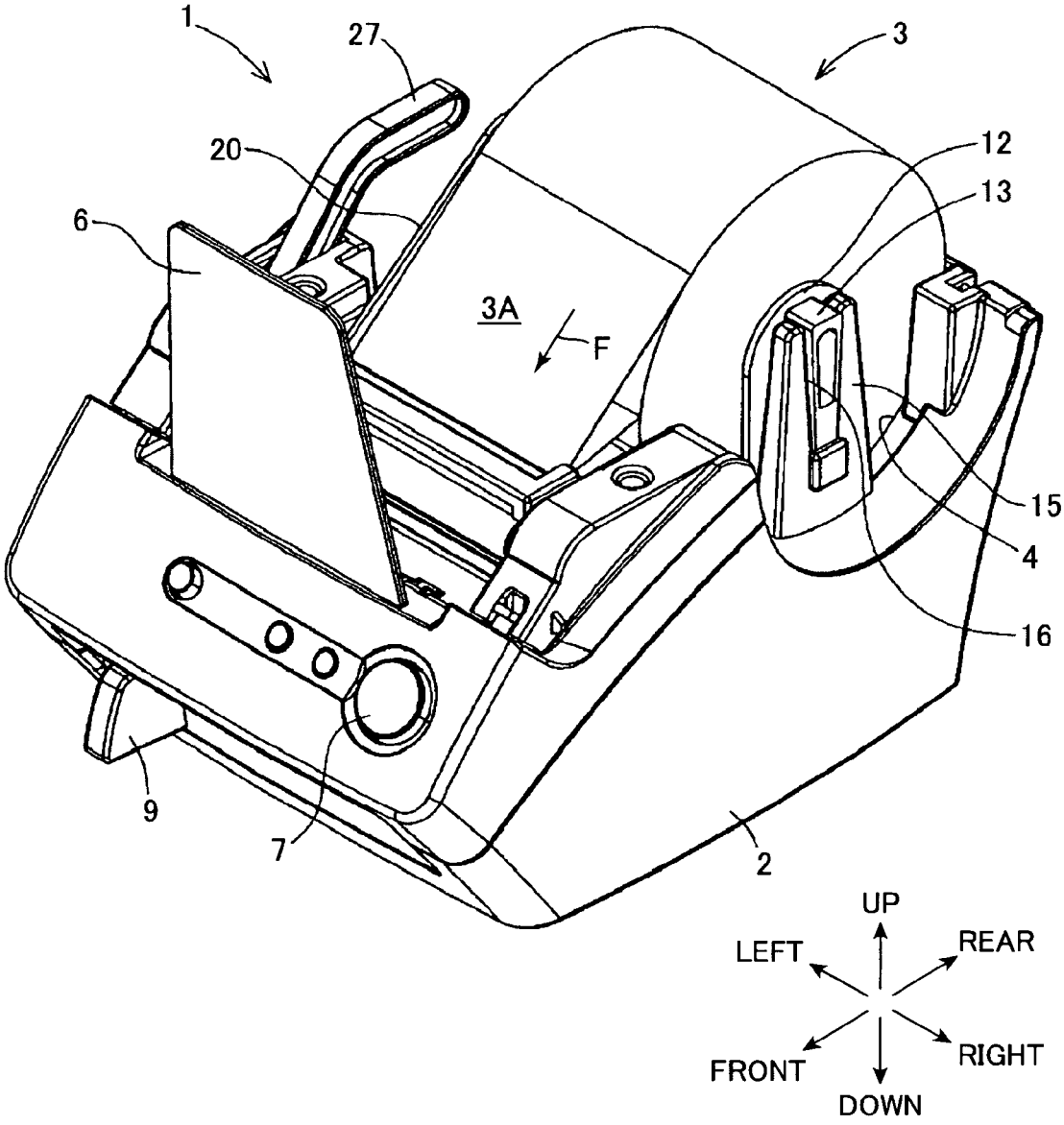
FIG. 2 is a perspective view of the tape printer in FIG. 1, from which a top cover is removed, and in which a roll sheet holder holding a roll sheet of a maximum width is mounted.
Figure 3:
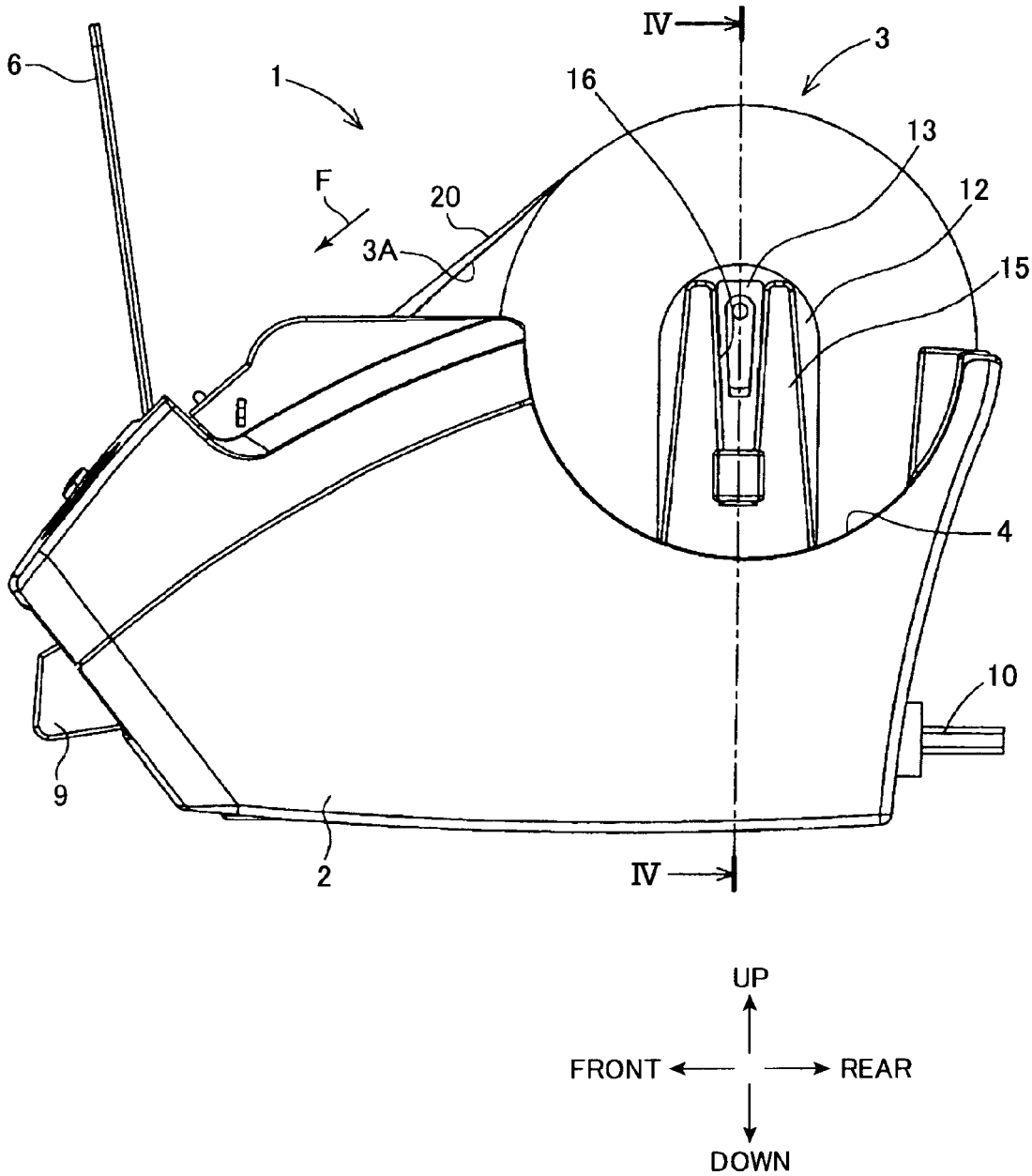
FIG. 3 is a right side view of the tape printer of FIG. 2.

As shown in FIGS. 1 to 3, the tape printer 1 of the present embodiment includes: a housing 2; a top cover 5, a tray 6, a power button 7, and a cutter lever 9. The top cover 5 is made of transparent resin and is attached to the housing 2 at its rear upper edge. The tray 6 is made of transparent resin and is set in a vertical position to face a substantially front center of the top cover 5. The power button 7 is placed in front of the tray 6. The cutter lever 9 is provided in a front face of the housing 2.

A holder storage part 4 is defined in the housing 2 as a space for receiving a roll sheet holder 3 holding a roll sheet 3A.

Figure 4:
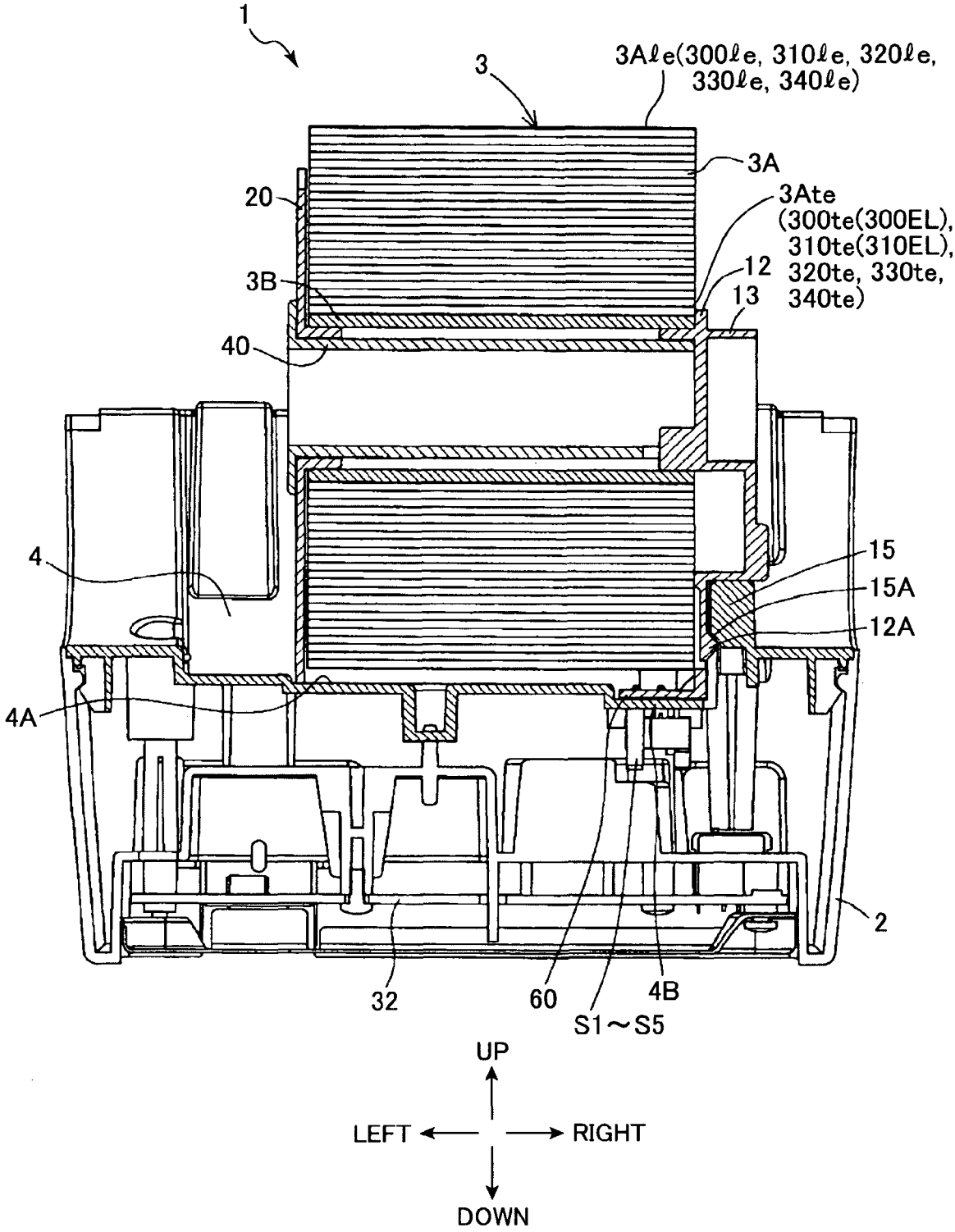
FIG. 4 is a sectional view taken along a line IV-IV in FIG. 3.

As shown in FIG. 4, the roll sheet holder 3 includes: a guide member 20; a positioning holding member (hereinafter, a "holding member") 12; and a hold shaft 40. The hold shaft 40 is of a hollow tube shape. A hollow cylindrical roll core or spool 3B is rotatably supported on the hold shaft 40. The roll sheet 3A is of an elongated tape shape that extends between its leading end 3Ale and its trailing end 3Ate, and is wound around the roll core 3B to be rolled up so that the trailing end 3Ate is located in the innermost position in the roll and the leading end 3Ale is located in the outermost position in the roll.

The roll sheet 3A includes: a recording paper (thermal paper, in this example); and a release paper, which are attached together via adhesive so that the recording paper can be peeled off from the release paper. The recording paper has coloring capability. The roll sheet 3A is rolled up around the roll core 3B, with the release paper facing outwardly and the recording paper facing inwardly.

As will be described later, the tape printer 1 has a platen 26 (FIG. 7), which serves to draw or unwind the roll sheet 3A from the roll core 3B in a direction from the leading end 3Ale toward the trailing end 3Ate, and feeds the unwound part of the roll sheet 3A in a sheet feeding direction F, that is, in a direction from the roll sheet 3A toward the tray 6.

A surface of the guide member 20 that faces rightwardly and therefore that confronts the holding member 12 will be referred to as an inner side surface of the guide member 20. The other surface of the guide member 20 that faces leftwardly will be referred to as an outer side surface of the guide member 20. A surface of the holding member 12 that faces leftwardly and therefore that confronts the guide member 20 will be referred to as an inner side surface of the holding member 12. The other surface of the holding member 12 that faces rightwardly will be referred to as an outer side surface of the holding member 12.

As shown in FIG. 4, a mounting piece (positioning rib) 13 protrudes outwardly (rightwardly) from the outer side surface of the holding member 12. An elastic locking piece 12A is formed on a lower end of the holding member 12 to project therefrom outwardly (rightwardly). A sheet discrimination part 60 extends from the lower end of the holding member 12 at a right angle therewith. The sheet discrimination part 60 extends toward the guide member 20. As will be described later with reference to FIG. 8(A), the guide member 20 has: a first extended portion 42, a second extended portion 43, a third extended portion 44, and a fourth extended portion 45. The third extended portion 44 has a lower edge 44*a* which extends horizontally. The fourth extended portion 45*a* has a front edge 45*a*.

Figure 7:
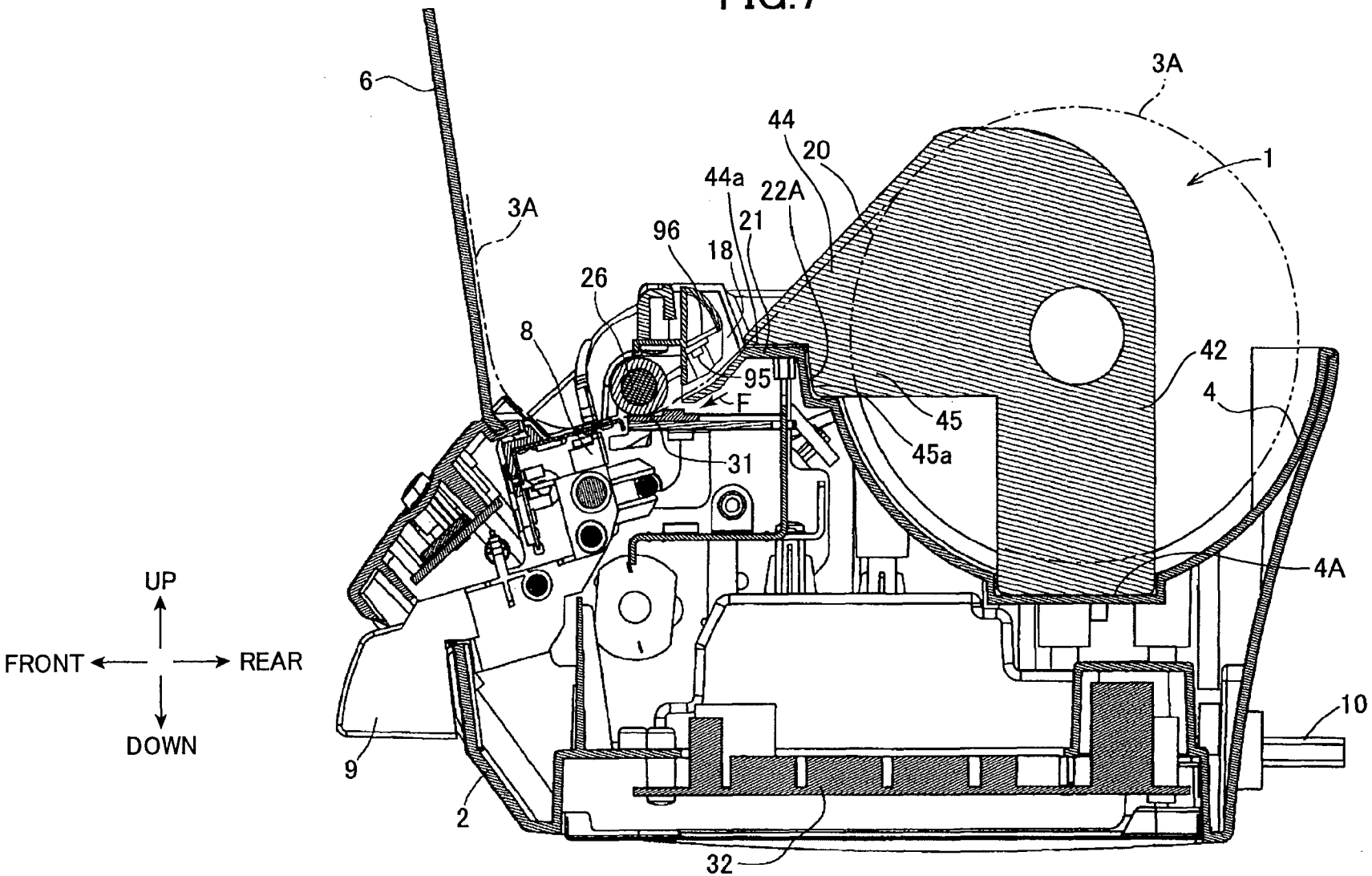
FIG. 7 is a sectional side view of the tape printer, from which the top cover is removed, and in which a roll sheet holder holding a roll sheet is mounted.

As shown in. FIG. 1, the top cover 5 can be freely opened and closed, thereby covering the upper part of the holder storage part 4. The cutter lever 9 is movable side to side, thereby horizontally moving a cutter unit 8 (FIG. 7).

Figure 6:
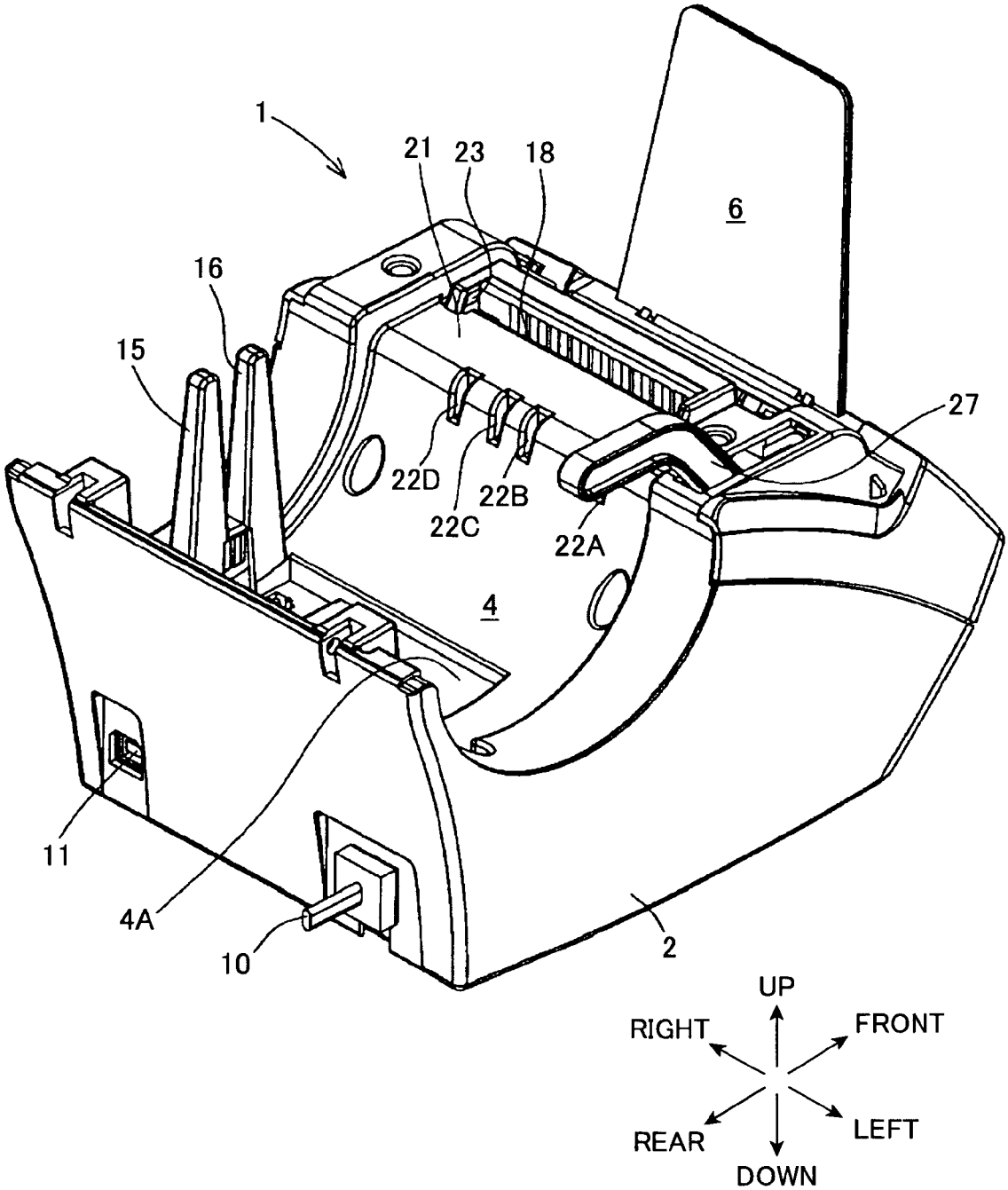
FIG. 6 is a schematic rear perspective view of the tape printer, from which the top cover is removed.

As shown in FIG. 6, a power cord 10 is connected to the housing 2 on its rear face at its left side edge. A connector port 11, such as a USB (Universal Serial Bus), is provided to the right side edge on the rear face of the housing 2. By connecting a cable from a personal computer, for example, to the connector port 11, it is possible to electrically connect the tape printer 1 with the personal computer.

As shown in FIGS. 2 through 6, the tape printer 1 is provided with a holder support member 15. The holder support member 15 is located at a right side end of the holder storage part 4.

The holder support member 15 is for receiving the mounting piece 13 of the roll sheet holder 3. The holder support member 15 is shaped like an angled long U-shape as shown in the right side view (FIG. 3) of the printer 1, providing a first positioning groove 16 which opens upward in the tape printer 1. The holder support member 15 is also formed with a recess 15A as shown in FIG. 5(B) for engaging with the elastic locking piece 12A.

Figure 5A:
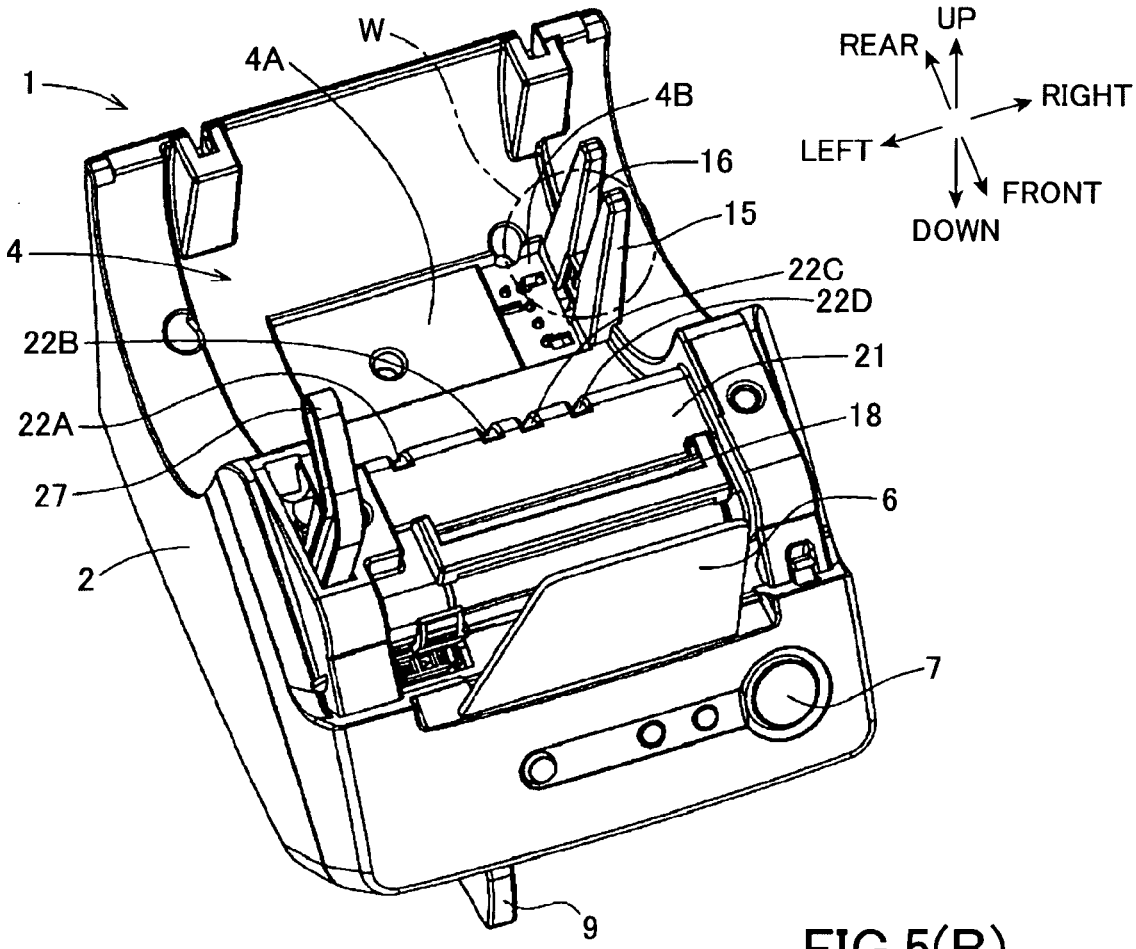
FIG. 5(A) is a schematic front perspective view of the tape printer, from which the top cover is removed.
Figure 5B:
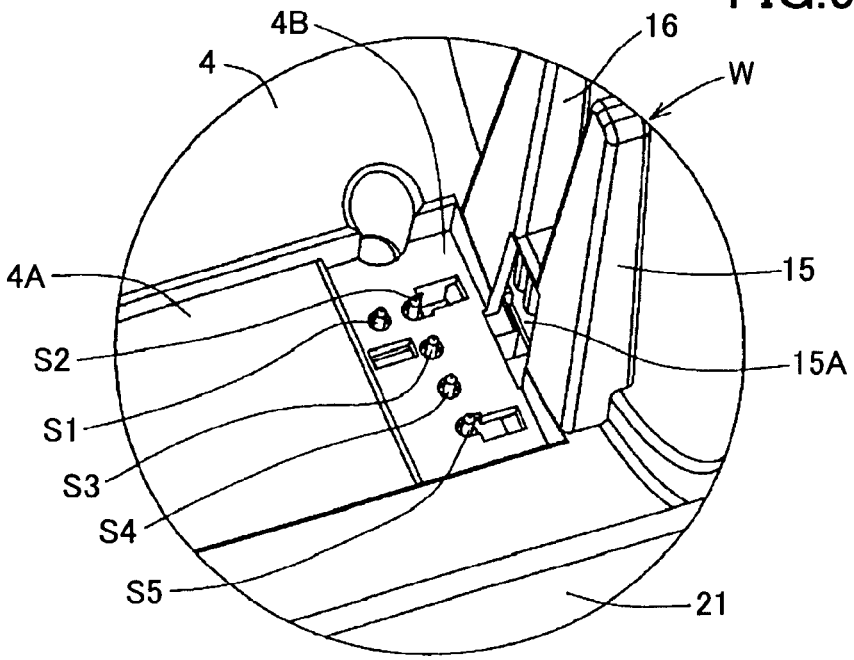
FIG. 5(B) is an enlarged perspective view of a portion W encircled by a chain line in FIG. 5(A)

As shown in FIG. 5(A), the housing 2 is formed with an insertion opening 18, through which a leading end of the unwound part of the roll sheet 3A is inserted into the housing 2. A flat portion 21 is formed substantially horizontal between a rear end of the opening 18 and a front upper edge of the holder storage part 4.

As shown in FIG. 5(A), a plurality of (four, in this example) second positioning grooves 22A to 22D are formed at the rear edge of the flat portion 21. The grooves 22A-22D are positioned in one-to-one correspondence with a plurality of (four, in this example) roll sheets 3A of different widths. Each groove 22A-22D is defined by a wall of a substantially L-shaped cross-section as shown in FIG. 7. When a sheet holder 3, which is mounted with a roll sheet 3A of some width, is mounted in the holder storage part 4, the front edge 45*a* of the fourth extended portion 45 in the guide member 20 is inserted from above and fitted into a corresponding groove 22A, 22B, 22C, or 22D. The lower edge 44*a* of the third extended portion 44 extends along the flat portion 21 forwardly to the insertion opening 18.

A positioning recess 4A is formed in the bottom of the holder storage part 4 as shown in FIGS. 4-6. The positioning recess 4A is rectangular in plan view, and is elongated in the right-to-left direction of the tape printer 1, extending from an inner base end of the holder support member 15 to a position corresponding to the second positioning groove 22A. This positioning recess 4A has a predetermined depth (about 1.5 mm to 3.0 mm in this example). The width of the positioning recess 4A in the front-to-rear direction of the tape printer 1 is almost equal to the width of the lower end portion of the holding member 12 and to the width of the lower end portion of the first extended portion 42 in the guide member 20.

As shown in FIGS. 4-5(B), a discrimination recess 4B is formed in the positioning recess 4A in the vicinity of the inner base end of the holder support member 15. This discrimination recess 4B is rectangular in plan view, is elongated in the front-to-rear direction of the tape printer 1, and has a depth larger by a predetermined amount (about 1.5 mm to 3.0 mm in this example) than the other remaining portion of the positioning recess 4A. The discrimination recess 4B is for receiving the sheet discrimination part 60 of the sheet holder 3.

As shown in FIG. 4 and FIG. 5(B), five sheet discrimination sensors S1, S2, S3, S4, and S5 are provided in the discrimination recess 4B. The sheet discrimination sensors S1, S2, S3, S4, and S5 are arranged in an L-shaped pattern for distinguishing the type of the roll sheet 3A. Each sensor S1 to S5 is constructed of a push type mechanical switch. In this example, each sensor S1 to S5 is a well-known mechanical switch including a plunger and a micro-switch. Each sheet discrimination sensor S1, S2, S3, S4, or S5 is for detecting whether or not the sheet discrimination part 60 of a roll sheet holder 3 that is presently being mounted in the tape printer 1 has a corresponding sensor through-hole 60A, 60B, 60C, 60D, or 60E (FIG. 8(B)) at the corresponding position, and is for issuing an ON/OFF signal representing the detection result. A combination of the ON/OFF signals from the sensors S1 to S5 indicate the type of the roll sheet 3A held in the roll sheet holder 3.

The micro-switch in each tape discrimination sensor S1 to S5 is normally in an OFF state. That is, each tape discrimination sensor S1 to S5 is allowed to normally protrude from the bottom surface of the discrimination recess 4B upwardly to near the bottom surface of the positioning recess 4A, that is, at the height substantially corresponding to a depth difference between the discrimination recess 4B and the positioning recess 4A.

When the sheet discrimination part 60 has some sensor through-hole(s) 60A-60E at position(s) corresponding to the sheet discrimination sensor(s). S1-S5, as shown in FIGS. 13(A)-13(F), the plunger(s) of the sensor(s) for which the sheet discrimination part 60 has sensor through-hole(s) is allowed to pass through the associated sensor through-hole(s) without depression, leaving the corresponding micro-switch (es) in the OFF state which generates an OFF signal. On the other hand, the plunger(s) of the sensor(s), for which the sheet discrimination part 60 has no sensor through-hole, is depressed, thereby bringing the corresponding micro-switch (es) into the ON state which generates an ON signal.

As shown in FIGS. 5(A) and 6, the insertion opening 18 has a right side end. A guide rib 23 is formed in the right side end of the insertion opening 18. When the roll sheet holder 3 is mounted in the tape printer 1 and the holding member 12 is engaged in the holder support member 15, the inner side surface of the holding member 12 becomes positioned substantially on the same plane with a left side surface of the guide rib 23 that faces leftwardly.

As shown in FIG. 5(A), a lever 27 is provided in front of the left side end of the holder storage part 4. The lever 27 is for vertically moving a thermal head 31, shown in FIG. 7, with respect to the platen roller 26, which is disposed facing the thermal head 31. More specifically, when the lever 27 is turned up, the thermal head 31 is moved down to separate from the platen roller 26. When the lever 27 is turned down, to the contrary, the thermal head 31 is moved up, thereby pressing the unwound part of the roll sheet 3A against the platen roller 26 to bring the unwound part of the roll sheet 3A in a printable condition.

As shown in FIG. 7, a control board 32 is located below the roll sheet holder 4. A control circuit is mounted on the control board 32 to drive and control each mechanism in the tape printer 1 in response to commands from the external personal computer or the like.

The roll sheet holder 3, having the roll core 3B around which the roll sheet 3A is wound, is removably set in the holder storage part 4 in a manner described below.

The mounting piece 13 of the holding member 12 is inserted from above into the first positioning groove 16 of the holder support member 15. The elastic locking piece 12A of the holding member 12 is then engaged in the locking recess 15A. The fourth extended portion 45 of the guide member 20 is engaged in a corresponding one of the second positioning grooves 22A to 22D, and the first extended portion 42 is fittingly inserted in the positioning recess 4A. The sheet discrimination part 60 of the holding member 12 is inserted from above into the discrimination recess 4B, whereupon the sensors S1-S5 are brought into a condition for detecting whether or not the sheet discrimination part 60 has any of the sensor through-holes 60A-60E, thereby detecting the type of the roll sheet 3A.

A user (operator) moves the lever 27 up, draws a leading end of the roll sheet 3A from the roll of the roll sheet 3A, and inserts the leading end of the unwound part of the roll sheet 3A into the insertion opening 18, while keeping the left side edge of the unwound part of the roll sheet 3A in contact with the inner side surface of the guide member 20 and keeping the right side edge of the unwound part of the roll sheet 3A in contact with the guide rib 23. Thereafter, the user moves the lever 27 down, thereby bringing the roll sheet 3A into a printable condition.

As shown in FIG. 7, when the lever 27 is moved down, the part of the roll sheet 3A inserted in the insertion opening 18 is pressed against the platen roller 26 by the thermal head 31. The thermal head 31 is of a line type, and is drivingly controlled to print image data on a printing surface of the roll sheet 3A, while the platen roller 26 is driven to rotate by a step motor or the like (not shown) to feed the roll sheet 3A sequentially in the feeding direction F. The printed part of the roll sheet 3A is discharged onto the tray 6. The discharged part of the roll sheet 3A is cut by the cutter unit 8 when the user moves the cut lever 9 rightward.

Next, the structure of the roll sheet holder 3 will be described with reference to FIGS. 8(A) through 13(F).

As described already, the roll sheet holder 3 has: the guide member 20, the holding member 12, and the holder shaft 40 as shown in FIG. 8(A) through 13(F). The holder shaft 40 is provided between the guide member 20 and the holding member 12.

Figures 9A, 9B:
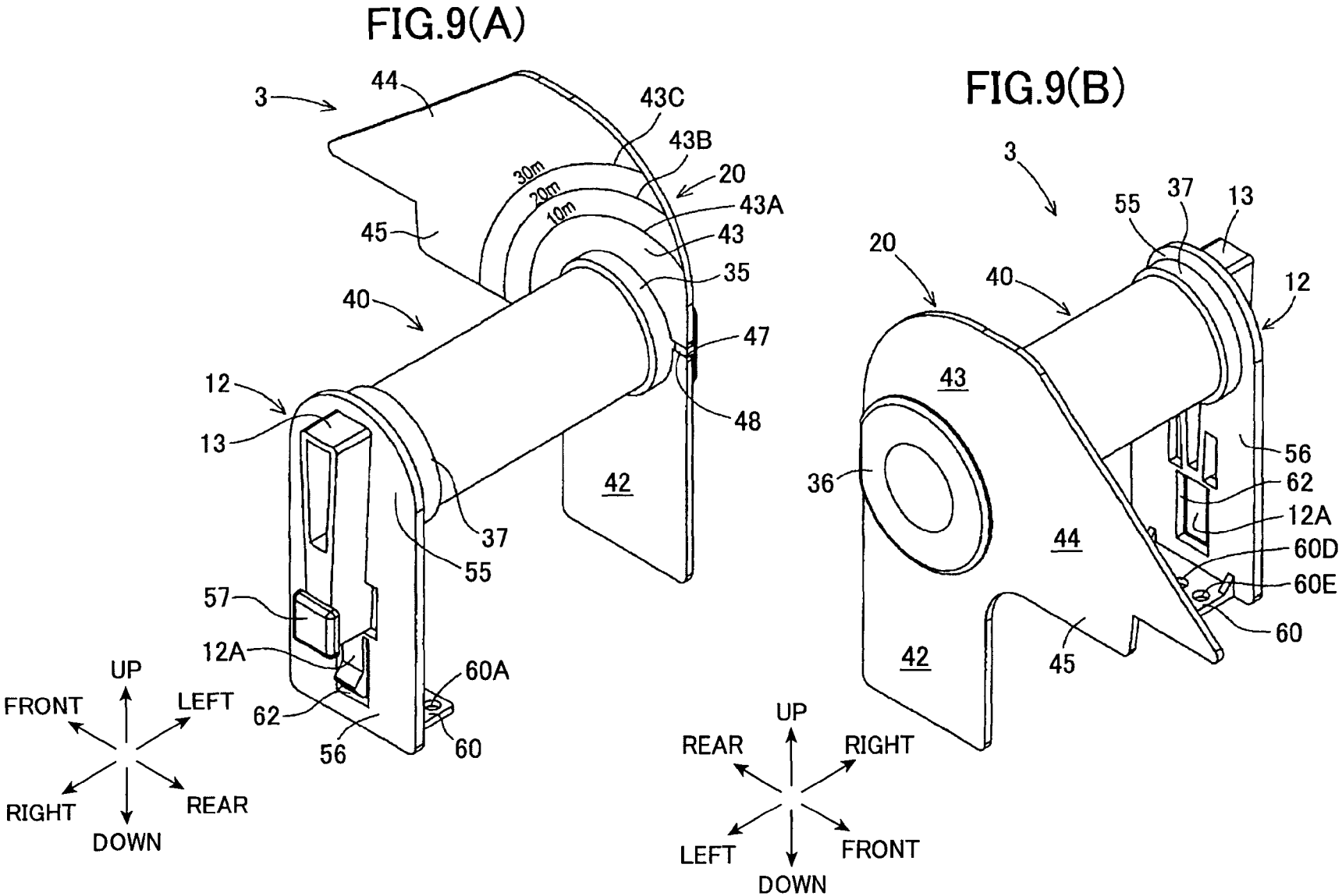
FIG. 9(A) is a perspective view of the roll sheet holder alone seen from an obliquely rear direction.
FIG. 9(B) is a perspective view of the roll sheet holder alone seen from an obliquely front direction.
Figure 11:
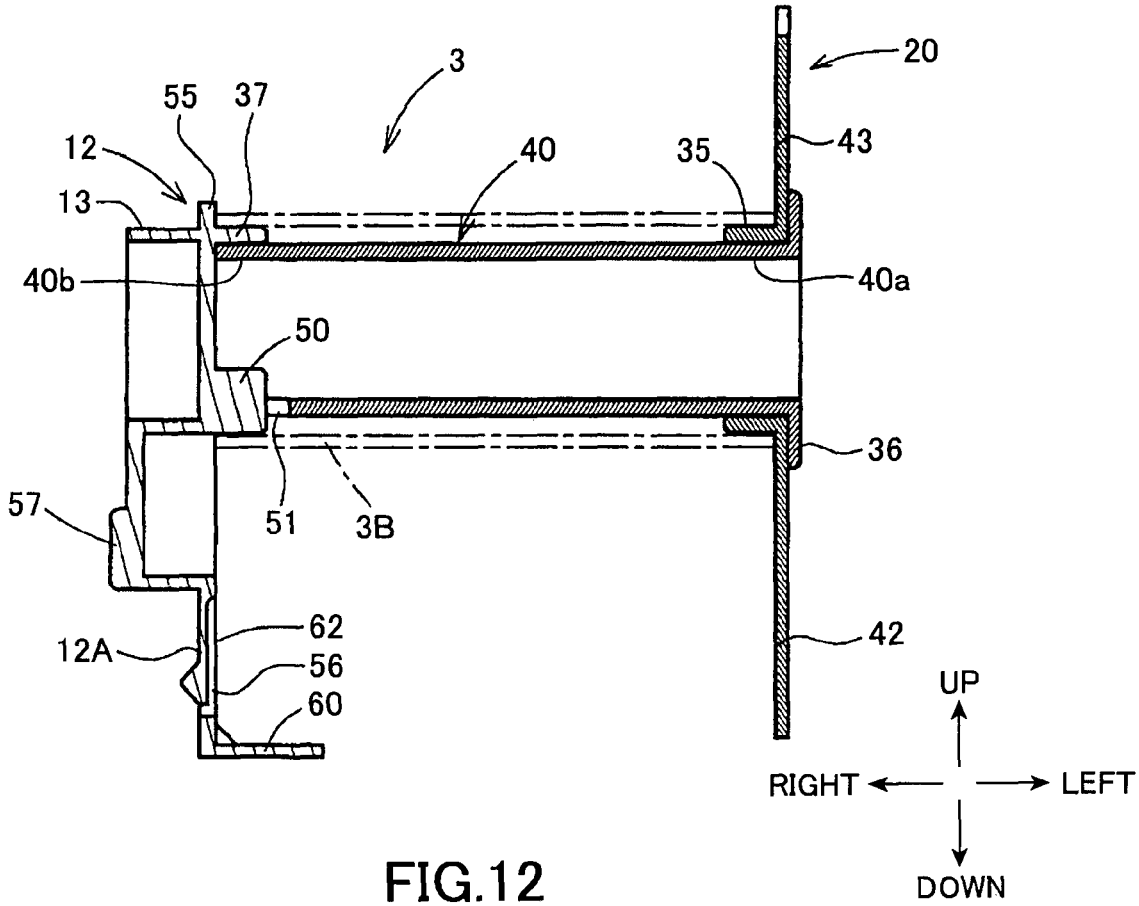
FIG. 11 is a sectional view of the roll sheet holder taken along a line XI-XI in FIG. 10(A)

As shown in FIG. 9(A), the guide member 20 has a first cylindrical part 35, which is fitted in one open end (left side open end) of the roll core 3B as shown in FIG. 11 so that the guide member 20 is held in contact with one end surface (left side end surface) of the roll sheet 3A.

As shown in FIG. 9(B), the holding member 12 has a second cylindrical part 37, which is fitted in the other open end (right side open end) of the roll core 3B so that the holding member 12 is held in contact with the other end surface (right side end surface) of the roll sheet 3A as also shown in FIG. 11.

As shown in FIG. 11, the holder shaft 40 is of a substantially tube shape and has two open ends 40*a* and 40*b*. The one end 40*a* of the holder shaft 40 is fitted in the first cylindrical part 35, and is formed with a radially extended flange part 36, which is fixed onto the outer surface of the guide member 20. The other end 40*b* of the holder shaft 40 is fixedly fitted in the second cylindrical part 37.

The holder shaft 40 may be selected from among a plurality of shafts of different lengths to easily provide many kinds of roll sheet holders 3 holding roll sheets 3A of different widths.

Figure 8A:
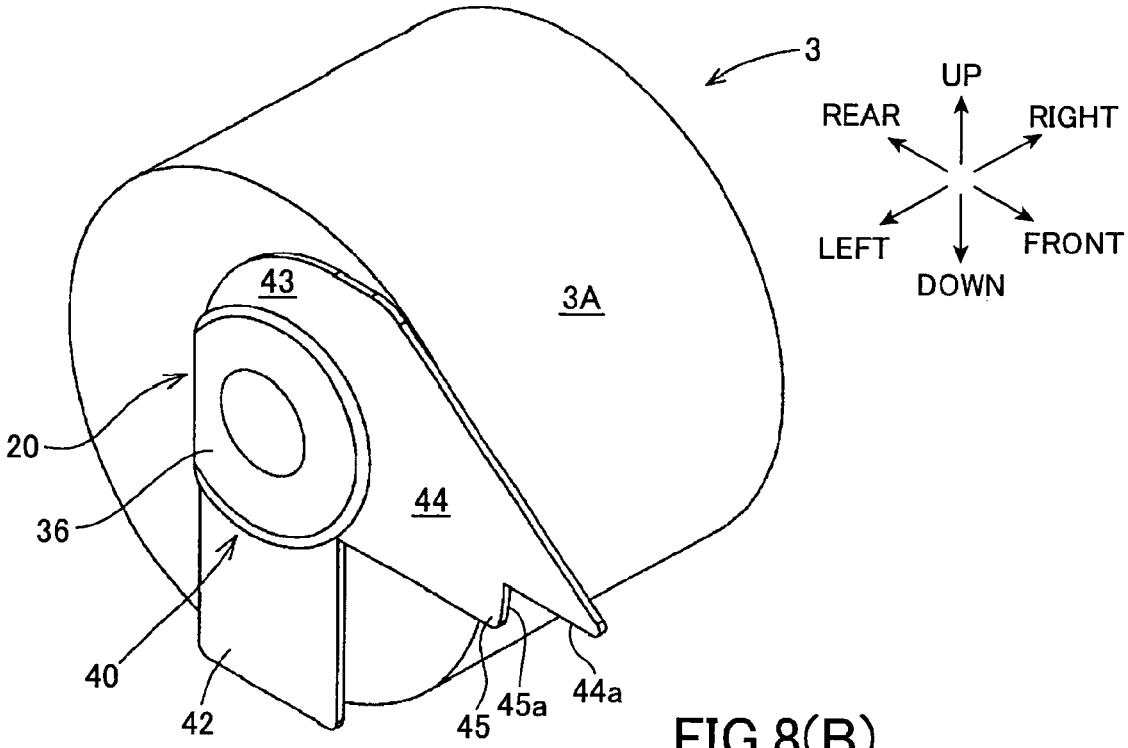
FIG. 8(A) is a perspective view of a roll sheet holder holding a roll sheet, seen from an obliquely front direction.
Figure 8B:
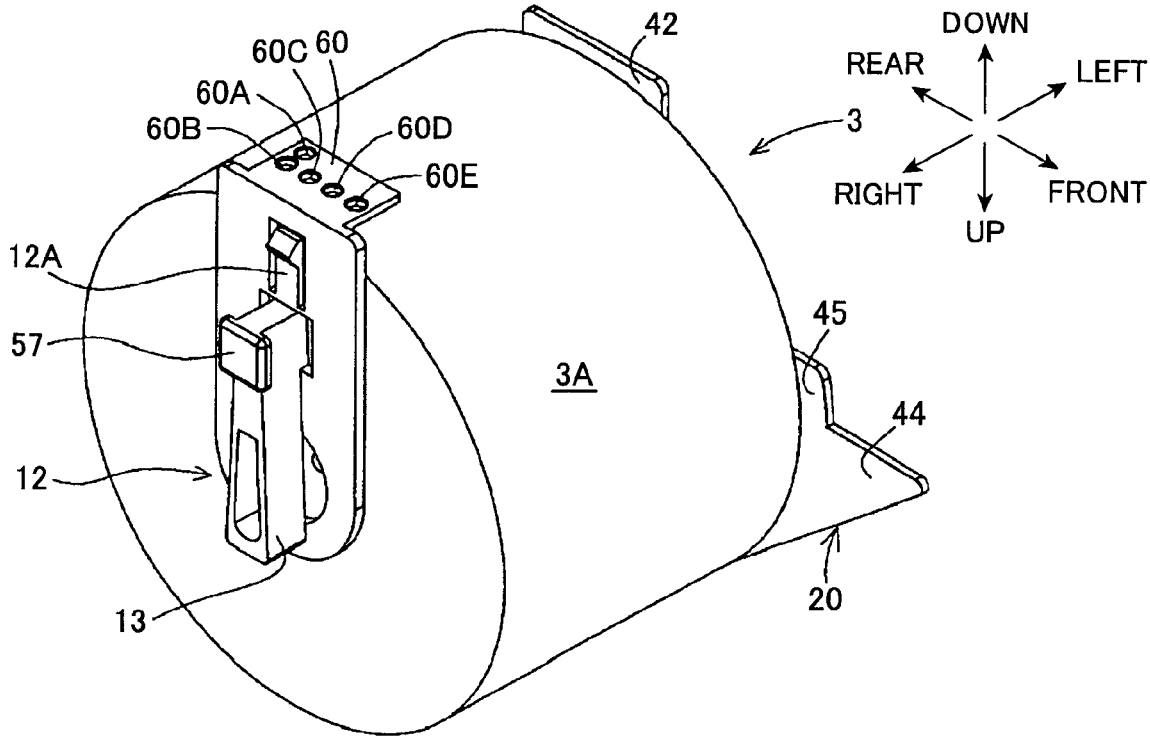
FIG. 8(B) is a perspective view of the roll sheet holder holding a roll sheet, which is turned upside down and seen from an obliquely front direction.

As described already, as shown in FIG. 8(A), the guide member 20 includes the first, second, third, and fourth extended portions 42, 43, 44, and 45.

The first extended portion 42 is formed extending downward in a predetermined length from a lower periphery of an outer end face of the first cylindrical part 35. When the roll sheet holder 3 is mounted in the tape printer 1, as shown in FIG. 7, the first extended portion 42 is fitted in the positioning recess 4A, and the lower end surface of the first extended portion 42 is brought into contact with the bottom surface of the positioning recess 4A.

The second extended portion 43 is formed extending upward to cover a front quarter round of the end face of the roll sheet 3A.

The third extended portion 44 is formed continuously extending from the second extended portion 43, with its upper edge being sloped downward to its front end. When the roll sheet holder 3 is mounted in the tape printer 1, as shown in FIG. 7, the front end of the third extended portion 44 is located in the vicinity of the insertion opening 18.

The third extended portion 44 has a lower edge 44*a* that extends horizontally. When the roll sheet holder 3 is mounted in the tape printer 1, the lower edge 44*a* is held in contact with the flat portion 21 of the tape printer 1. This ensures that the left-side edge of the unwound part of the roll sheet 3A is guided to the insertion opening 18 along the inner side surface of the guide member 20 at its second and third extended portions 43 and 44.

The fourth extended portion 45 is formed under the third extended portion 44 to extend at a predetermined distance from the front end of the first extended portion 42 to the rear end of the lower edge 44*a*. When the lower edge 44*a* of the third extended portion 44 is held in contact with the flat portion 21, the front edge 45*a* of the fourth extended portion 45 is inserted in one of the second positioning grooves 22A to 22D that corresponds to the sheet width of the roll sheet 3A set in the sheet holder 3 as shown in FIG. 7.

Figures 10A, 10B, 10C:
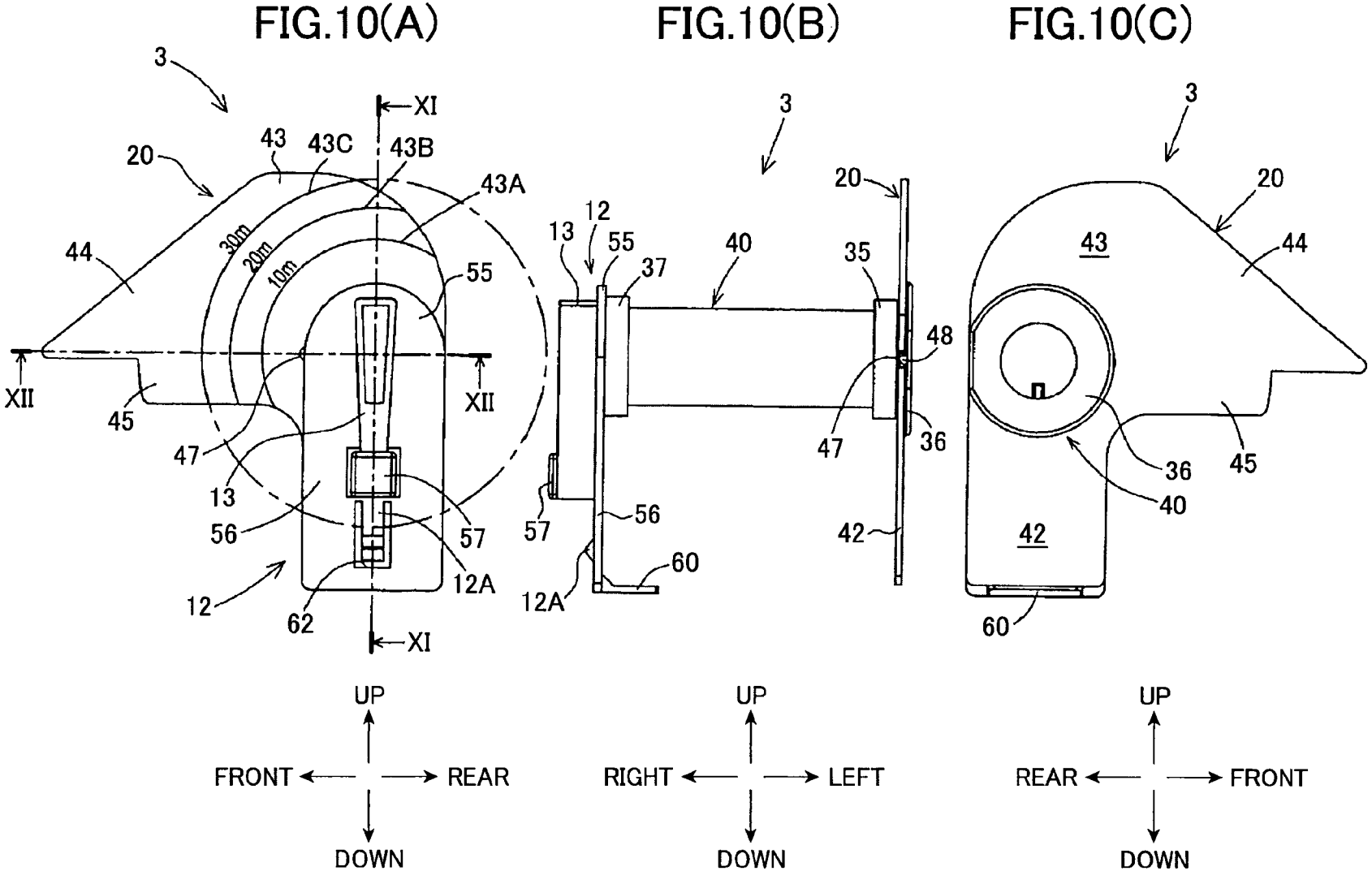
FIG. 10(A) is a right side view of the roll sheet holder.
FIG. 10(B) is a rear view of the roll sheet holder.
FIG. 10(C) is a left side view of the roll sheet holder.
Figure 12:
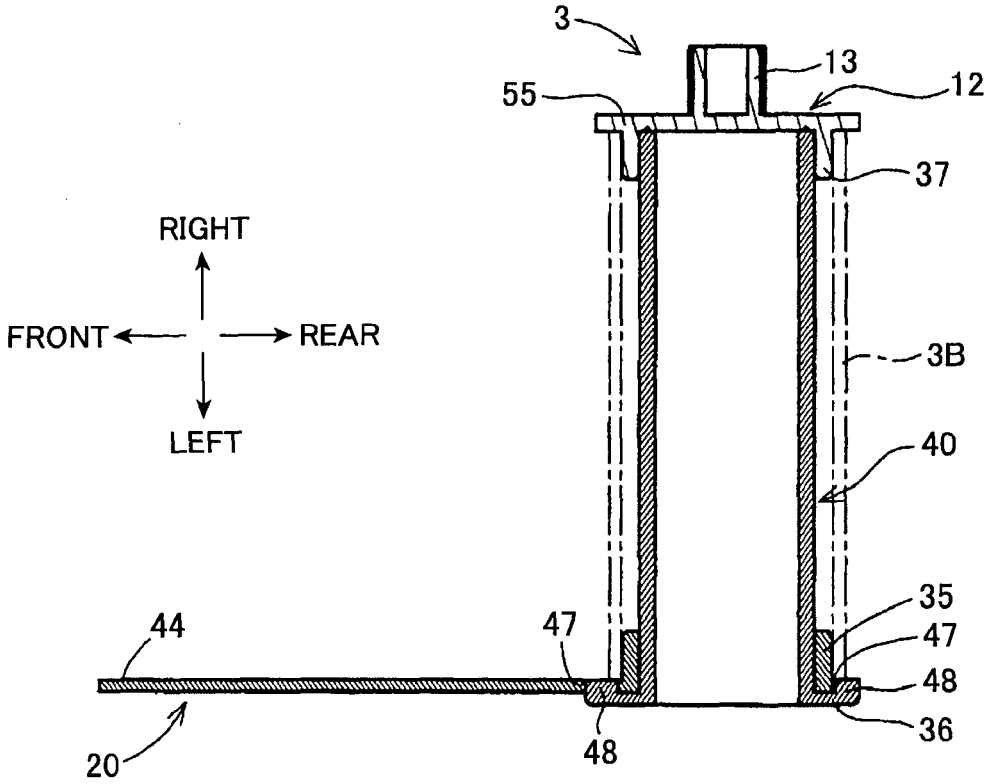
FIG. 12 is a sectional view of the roll sheet holder taken along a line XII-XII in FIG. 10(A)

As shown in FIG. 12, a pair of slits 47 are formed on the guide member 20. Although only one of the two slits 47 is shown in FIG. 9(A) and FIG. 10(A), the slits 47 are located at an upper end of the first extended portion 42. The slits 47 are located at opposed positions (front and rear positions) on the periphery of the outer end face of the first cylindrical part 35. Each slit 47 is of a substantially rectangular shape viewed from a right side in the roll sheet holder 3. As shown in FIG. 12, a pair of protrusions 48 are formed on the inner surface of the flange part 36 that faces rightwardly. The pair of protrusions 48 are engaged in the slits 47 for positioning.

As shown in FIG. 9(A), scales 43A, 43B, and 43C are formed in concentric circular lines on the inner side surface of the guide member 20. The scales 43A to 43C are located on the extended portions 43, 44, and 45. These scales 43A to 43C indicate the winding lengths of the roll sheet 3A: 10 m, 20 m, and 30 m. In this example, the maximum winding length of the roll sheet 3A that can be set in the roll sheet holder 3 is about 30 m.

As shown in FIG. 11, a rib 50 is formed at the lower end of the second cylindrical part 37. The rib 50 protrudes radially inwardly from the second cylindrical part 37. A slit 51 is formed in the right end portion of the holder shaft 40 that is fitted in the second cylindrical part 37. The slit 51 has a length, along the axial direction of the shaft 40, sufficiently long to receive the rib 50 therein. Such engagement between the rib 50 of the holding member 12 and the slit 51 of the holder shaft 40 makes it possible to correctly position the holding member 12 and the guide member 20 with respect to each other via the holder shaft 40.

The first and second cylindrical parts 35 and 37 serve to rotatably support the roll core 3B of the roll sheet 3A. The holder shaft 40 may be selected from among a plurality of shafts (four shafts in this example) of different lengths individually corresponding to the lengths of the roll cores 3B (i.e., the widths of the roll sheets 3A).

As shown in FIGS. 11 and 12, the outer open end of the second cylindrical part 37 is closed by the positioning member 12. A flange 55 is formed around the second cylindrical part 37. As shown in FIG. 9(A), an extended portion 56 is formed to extend from the flange 55 continuously downwardly.

At the flange 55 and the extended portion 56, the inner side surface of the holding member 12 is held in contact with the right end face of the roll sheet 3A and the right end face of the roll core 3B.

As shown in FIGS. 10(B) and 10(C), a lower end of the extended portion 56 is positioned lower than the lower end of the first extended portion 42 in the guide member 20 by a predetermined length (about 1.0 mm to 2.5 mm in this example) in the vertical direction.

The sheet discrimination part 60 is provided at the lower end of the extended portion 56. The sheet discrimination part 60 is of a substantially rectangular plate shape. The sheet discrimination part 60 extends at an almost right angle to the extended portion 56, and extends by a predetermined length toward the guide member 20.

As described above, the sheet discrimination part 60 is formed with the sensor through-holes 60A-60E arranged at predetermined positions corresponding to the sheet discrimination sensors S1 to S5 respectively.

Figures 13A, 13B, 13C, 13D, 13E, 13F:
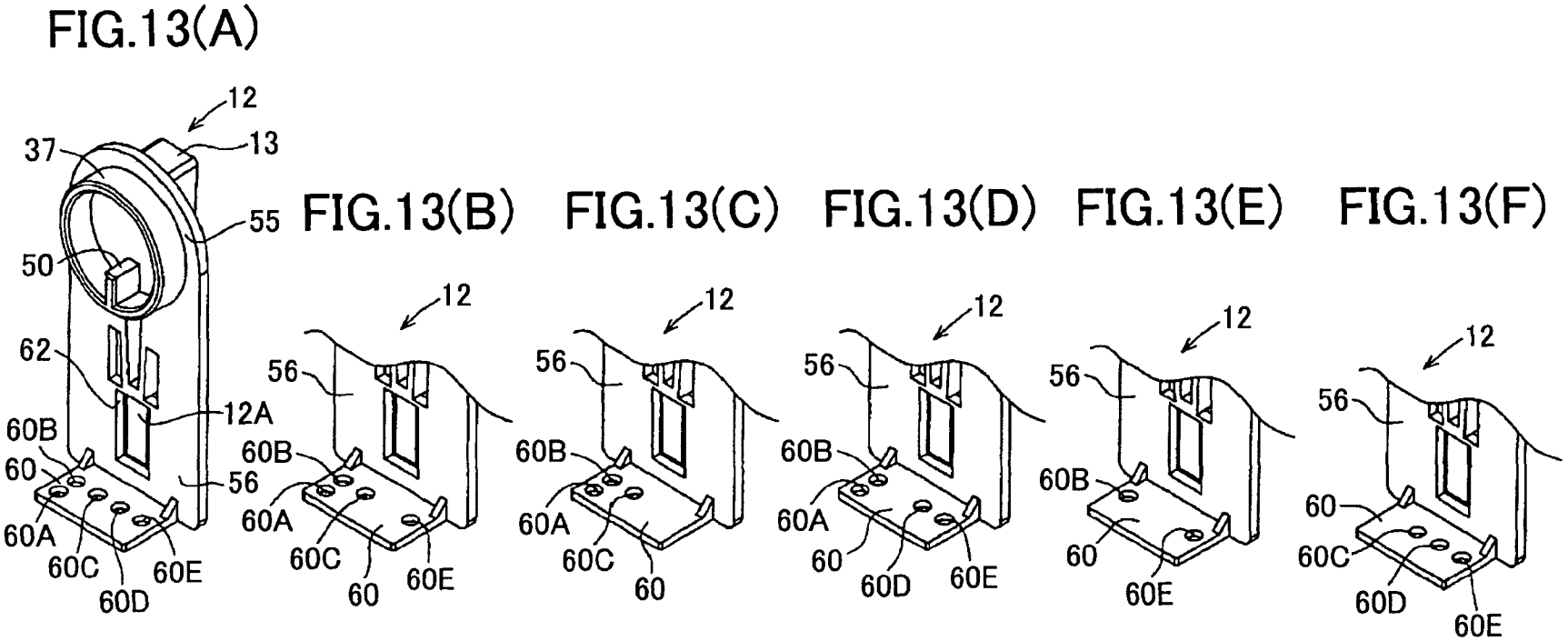
FIGS. 13(A)-13(F) show examples of the arrangement of sensor through-holes, which are formed in a sheet discrimination part provided on a roll sheet holder to indicate the type of a roll sheet held on the roll sheet holder.

In one example shown in FIG. 13(A), all of the five sensor through-holes 60A-60E are formed at the predetermined positions to indicate a corresponding type of roll sheet 3A set in the holder 3.

In another example shown in FIG. 13(B), only four sensor through-holes 60A, 60B, 60C, and 60E are formed to indicate another kind of the roll sheet 3A set in the holder 3.

In another example shown in FIG. 13(C), only three sensor through-holes 60A-60C are formed to indicate still another kind of the roll sheet 3A set in the holder 3.

In another example shown in FIG. 13(D), other four sensor through-holes 60A, 60B, 60D, and 60E are formed to indicate another kind of the roll sheet 3A set in the holder 3.

In another example shown in FIG. 13(E), only two sensor through-holes 60A and 60E are formed to indicate still another kind of the roll sheet 3A set in the holder 3.

In another example shown in FIG. 13(F), three sensor through-holes 60C-60E are formed to indicate still another kind of the roll sheet 3A set in the holder 3.

Because the total number of the sensor through-holes 60A-60E is five (5), by allowing the corresponding sensors S1-S5 to detect the sensor through-holes 60A-60E to output ON (1) or OFF (0) indicative of the detected result, it is possible to allow the sensors S1 to S5 to indicate the type of the roll sheet 3A by a five bit number.

As shown in FIG. 10(A), on the outer side surface of the holding member 12, the mounting piece (positioning rib) 13 is provided at substantially the center of the width of the positioning member 12 in the front-to-rear direction. The mounting piece protrudes outwardly (rightwardly) from the outer side surface of the holding member 12. The protruding amount of the mounting piece 13 is almost equal to the width of the holder support member 15 in the left-to-right direction. The mounting piece 13 is elongated in the vertical direction to extend from the flange 55 to the extended portion 56. Thus, the mounting piece 13 extends perpendicularly to the axis of the shaft 40. The mounting piece 13 has a substantially rectangular shape as viewed from the right side as shown in FIG. 10(A). The width of the mounting piece 13 in the front-to-rear direction decreases gradually in a downward direction. The mounting piece 13 can therefore be smoothly fitted in the first positioning groove 16 whose width in the front-to-rear direction also decreases gradually towards the bottom of the holder support member 15.

A guide portion 57 is formed on a lower end of the mounting piece 13. The guide portion 57 is formed on the outer side surface of the mounting piece 13. The guide portion 57 is a square flat plate having a predetermined thickness (about 1.5 mm to 3 mm in this example). The guide portion 57 has a larger width than the lower portion of the mounting piece 13 by a predetermined amount (about 1.5 mm to 3 mm in this example) at each of the front and rear sides of the lower end portion of the mounting piece 13. Accordingly, in order to mount the roll sheet holder 3 in the tape printer 1, the user inserts the mounting piece 13 from above into the first positioning groove 16 by bringing the inner side surface of the guide portion 57, which faces leftwardly, into sliding contact with the outer side surface of the holder support member 15, which faces rightwardly. Thus, the roll sheet holder 3 can be easily fitted in place.

As shown in FIGS. 9(A) and 13(A), a through-hole 62 is formed in the extended portion 56 at a location below the mounting piece 13. The through-hole 62 is of a rectangular shape elongated in the vertical direction. The elastic locking piece 12A is formed on the extended portion 56 to protrude into the through-hole 62 downwardly from an upper edge of the through-hole 62. An outward protrusion is formed on the elastic locking piece 12A at its lower end.

Next will be described with reference to FIGS. 14A and 14B how to mount the roll sheet holder 3 in the tape printer 1.

Figure 14B:
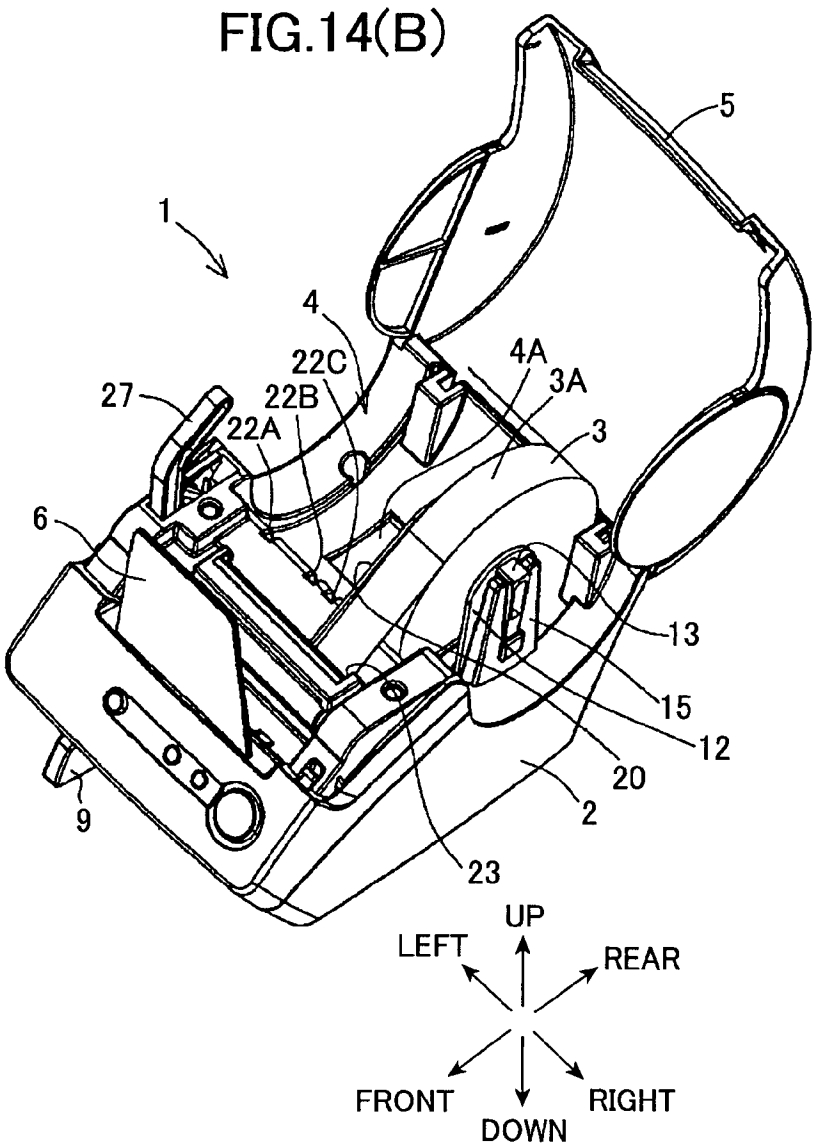
FIG. 14(B) is a perspective view of the tape printer, in which the roll sheet holder for a minimum roll sheet width is mounted.
Figure 14A:
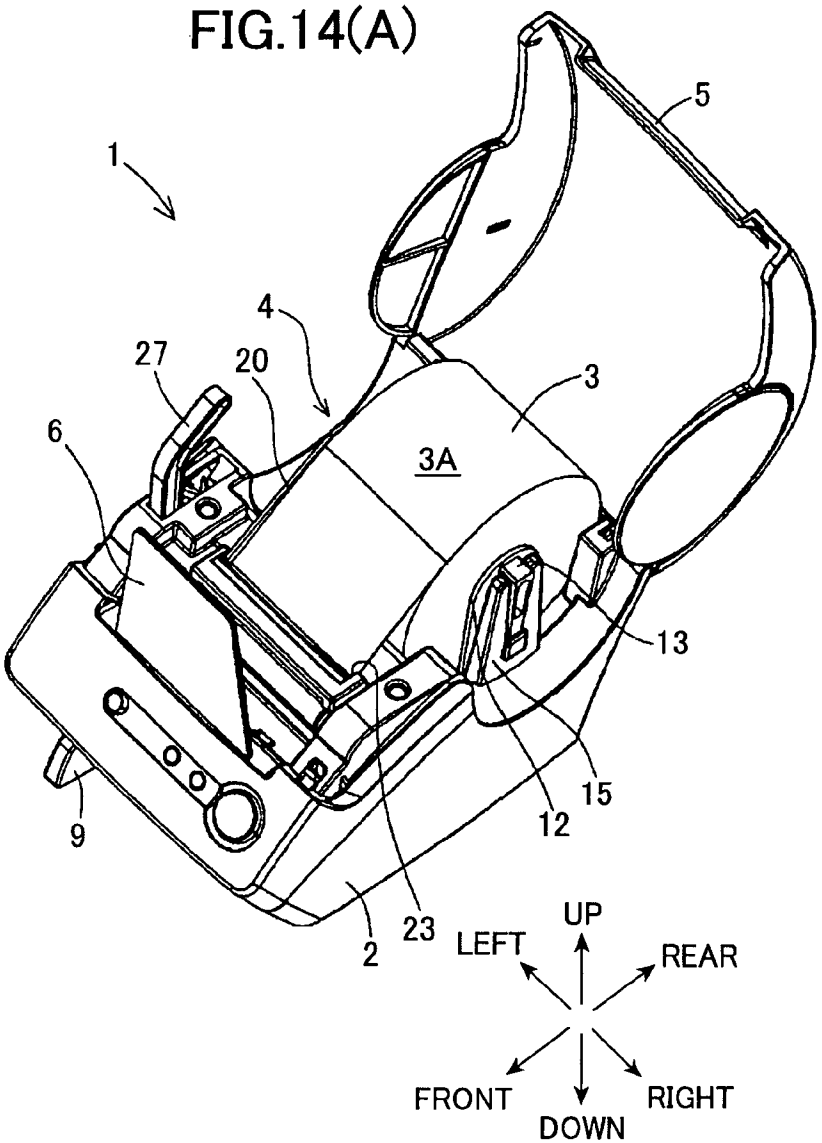
FIG. 14(A) is a perspective view of the tape printer, in which the roll sheet holder for a maximum roll sheet width is mounted.

FIG. 14(A) shows the case where the roll sheet 3A holds a roll sheet 3A of a maximum width wound on a hollow cylindrical roll core 3B. The mounting piece 13 of the holder 3 is first inserted from above into the positioning groove 16 of the tape printer 1. The lower edge 44*a* of the third extended portion 44 of the guide member 20 is brought into contact with the flat portion 21. The fourth extended portion 45 is engaged in the second positioning groove 22A formed at the rear edge of the flat portion 21. The first extended portion 42 is fitted in the positioning recess 4A so that the lower end face of the first extended portion 42 is brought into contact with the bottom surface of the positioning recess 4A. Simultaneously, the sheet discrimination part 60 is fitted in the discrimination recess 4B and the elastic locking piece 12A is engaged in the recess 15A. Thus, the roll sheet holder 3 is mounted in the holder storage part 4 to be freely removable therefrom. The sensors S1-S5 are brought into a detectable condition for detecting whether or not any sensor through-holes 60A-60E are formed in the sheet discrimination part 60.

Subsequently, the user turns the lever 27 upward and then draws or unwinds part of the roll sheet 3A and inserts the leading end of the unwound part of the roll sheet 3A in the insertion opening 18 while guiding the left side edge of the unwound part of the roll sheet 3A in contact with the guide member 20 and guiding the right side edge of the unwounded part of the roll sheet 3A in contact with the protruding guide rib 23. Thereafter, the user turns the lever 27 down. The inserted portion of the roll sheet 3A is pressed against the platen roller 26 by the thermal head 31, bringing the roll sheet 3A into a printable state.

FIG. 14(B) shows the case where the roll sheet holder 3 holds a roll sheet 3A of a minimum width wound on a hollow cylindrical roll core 3B. The mounting piece 13 of the holder 3 is first inserted from above into the positioning groove 16 of the holder support member 15. The lower edge 44*a* of the third extended portion 44 is brought into contact with the flat portion 21. The fourth extended portion 45 is engaged in the second positioning groove 22D formed at the rear edge of the flat portion 21. The first extended portion 42 is fitted in the positioning recess 4A so that the lower end face of the first extended portion 42 is brought into contact with the bottom surface of the positioning recess 4A. Simultaneously, the sheet discrimination part 60 is fitted in the discrimination recess 4B and the elastic locking piece 12A is engaged in the recess 15A. Thus, the roll sheet holder 3 is mounted in the holder storage part 4 to be freely removable therefrom. The sensors S1-S5 are brought into a detectable condition for detecting whether or not any sensor through-holes 60A-60E are formed in the sheet discrimination part 60.

Subsequently, the user turns the lever 27 up and then draws or unwinds part of the roll sheet 3A to insert the leading end of the unwound part of the roll sheet 3A in the insertion opening 18 while guiding the left side edge of the unwound part of the roll sheet 3A in contact with the guide member 20 and guiding the right side edge of the unwound part of the roll sheet 3A in contact with the protruding guide rib 23. Thereafter, the user turns the lever 27 down. The inserted portion of the roll sheet 3A is pressed against the platen roller 26 by the thermal head 31, bringing the roll sheet 3A into a printable state.

Next will be described an optical sensor 95 with reference to FIG. 7 and FIG. 15.

It is noted that a feed path of the roll sheet 3A is defined from the insertion opening 18 toward the tray 6.

Figure 15:
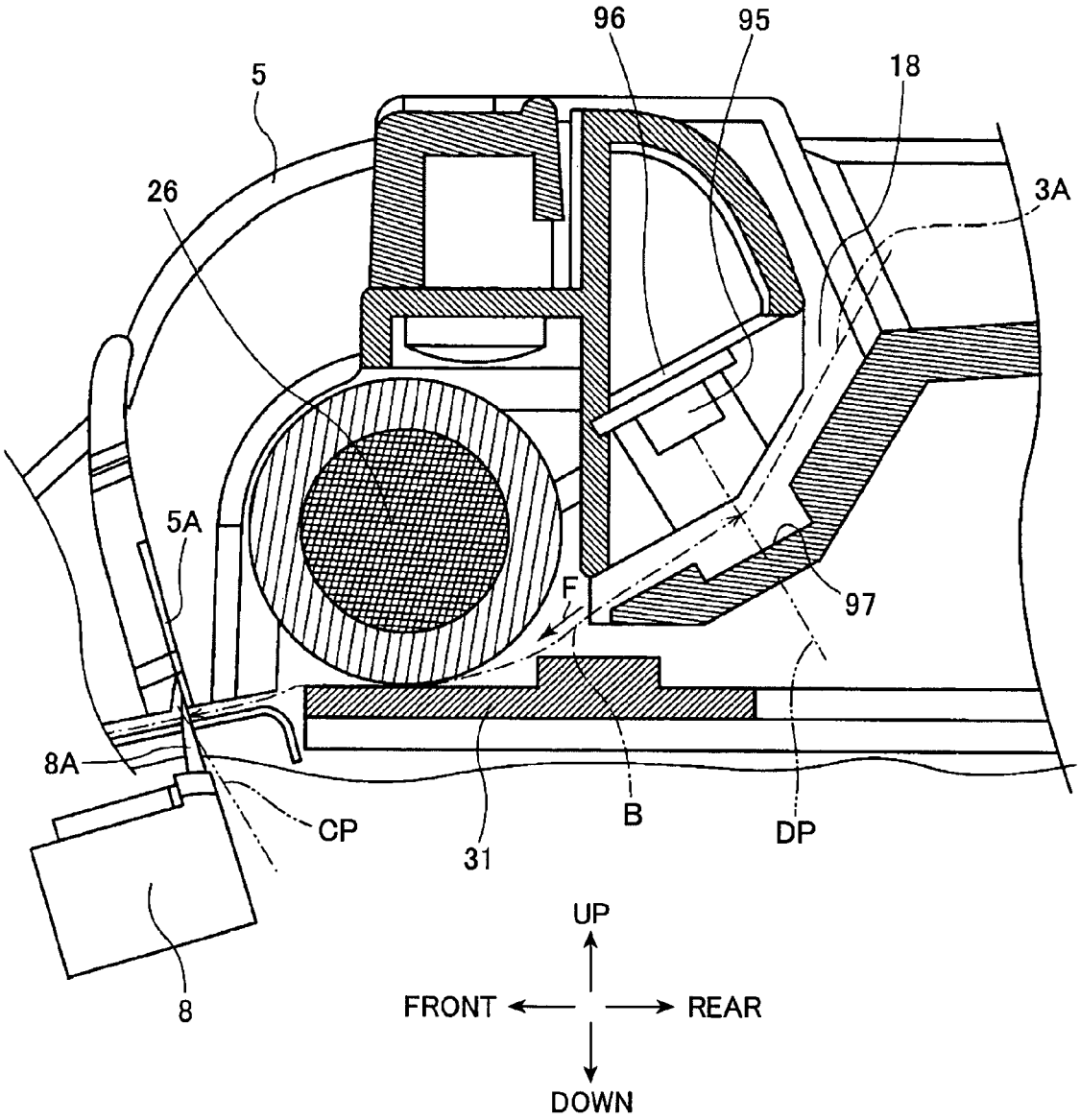
FIG. 15 is a partial enlarged sectional side view of a portion in the tape printer in the vicinity of a platen roller shown in FIG. 7.

As shown in FIG. 7 and FIG. 15, an optical sensor 95 is provided at a location (which will be referred to as a "detecting position DP" hereinafter) along the feed path of the roll sheet 3A. The detecting position DP is located between the insertion opening 18 and the platen roller 26. In other words, the detecting position DP is located in the downstream side of the insertion opening 18 and in the upstream side of the platen roller 26 in the sheet feeding direction F indicated by an arrow in FIG. 15.

More specifically, the optical sensor 95 is fixedly secured to a frame 96, which is located between the insertion opening 18 and the platen roller 26 and which confronts the feed path of the roll sheet 3A. A reflecting plate 97 is provided at a location that the reflecting plate 97 confronts the optical sensor 95, with the feed path being positioned between the optical sensor 95 and the reflecting plate 97.

In this example, the optical sensor 95 is a reflective sensor. The optical sensor 95 includes: a light emitter; and a light receiver having a photo-transistor or the like. As will be described later, the roll sheet 3A has a sensing surface. A plurality of sensor marks are printed on the sensing surface of the roll sheet 3A. Inter-mark areas are defined between the successive sensor marks on the sensing surface. The roll sheet 3A is fed along the feed path, with its sensing surface confronting the optical sensor 95. Light from the light emitter is emitted onto the sensing surface of the roll sheet 3A. The light partly passes through the roll sheet 3A, with a remaining part reflecting off the roll sheet 3A. The light receiver receives a part of the light that is reflected off from the roll sheet 3A, and detects the sensor marks based on differences between the amount of light reflected from the roll sheet 3A at the sensor mark and the amount of light reflected from the roll sheet 3A at the inter-mark area. The reflecting plate 97 serves to reflect off light when the light emitted from the light emitter in the optical sensor 95 reaches the reflecting plate 97.

The cutter unit 8 is provided at a location (which will be referred to as a "cutting position CP" hereinafter) along the feed path of the roll sheet 3A. The cutting position CP is located in the downstream side of the platen roller 26 and in the upstream side of the tray 6 in the sheet feeding direction F. The cutter unit 8 has a blade 8A. The edge of the blade 8A protrudes into the feed path. A metal plate 5A is fixed at the front edge of the top cover 5. The metal plate 5A extends along the widthwise direction of the feed path. In association with movement of the cutting lever 9, the cutter unit 8 slides as a whole across the entire width of the feed path of the roll sheet 3A. The roll sheet 3A is cut along its widthwise direction when the blade 8A and the metal plate 5A pinch the roll sheet 3A therebetween.

A DP-CP feed path length B is defined along the feed path between the cutting position CP and the detecting position DP. It is noted that the DP-CP feed path length B is not a straight-line distance between the cutting position CP and the detecting position DP, but is a distance along the feed path between the cutting position CP and the detecting position DP.

Next will be described several examples of the roll sheet 3A with reference to FIGS. 16(A)-24(B).

FIRST EXAMPLE

Figure 16A:
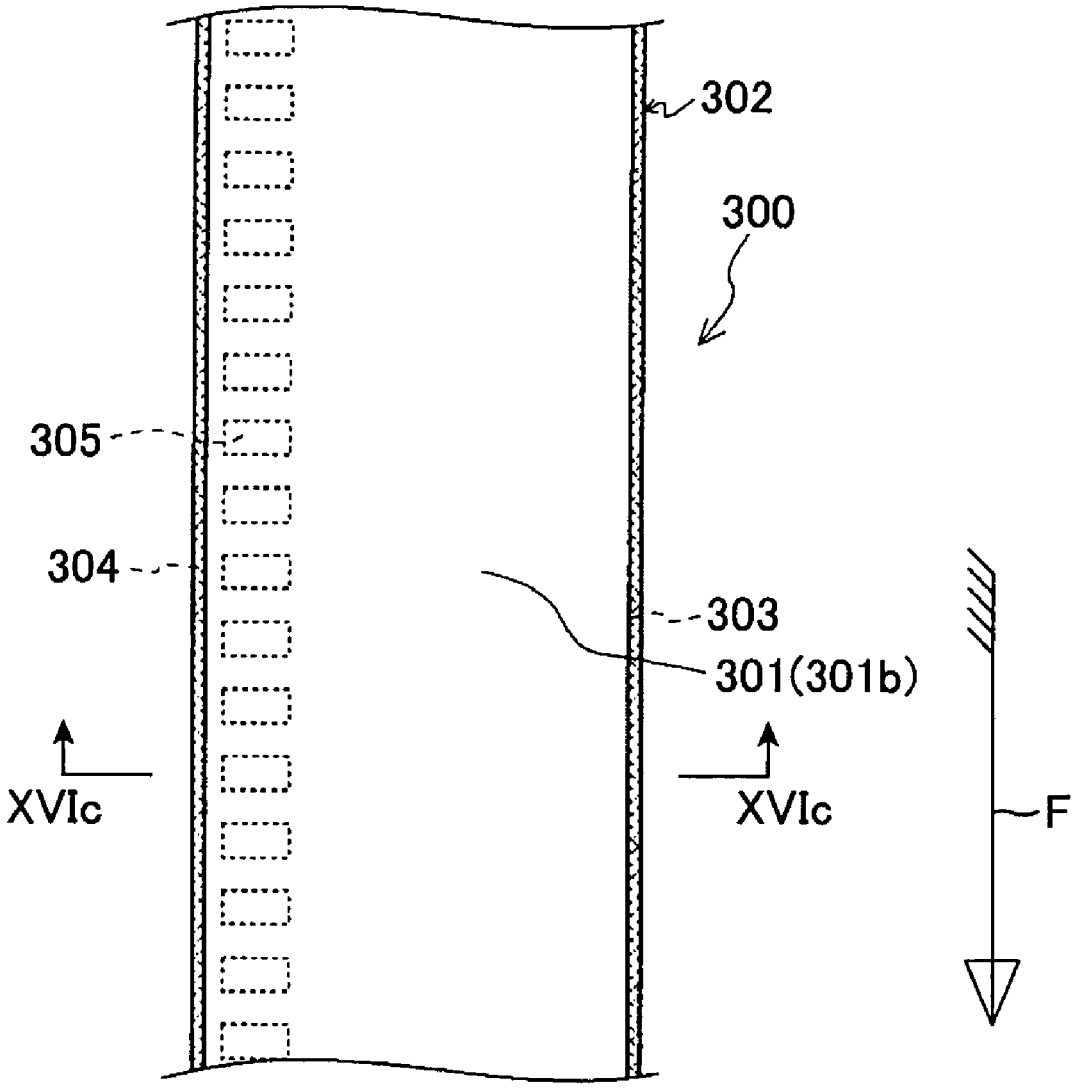
FIG. 16(A) is a plan view showing a recording surface of an unwound portion of a roll sheet according to a first example of the embodiment.

First, a roll sheet 300 according to a first example of the roll sheet 3A will be described with reference to FIG. 16(A), FIG. 16(B), and FIG. 16(C).

The roll sheet 300 is a continuous tape with a predetermined tape width (66 mm, in this example). The roll sheet 300 has a three-layer structure. More specifically, the roll sheet 300 has: a release paper 302; a recording paper 301; and an adhesive layer 308 provided between the recording paper 301 and the release paper 302.

The roll sheet 300 is rolled up into a roll shape, with the release paper 302 facing outwardly and the recording paper 301 facing inwardly. The release paper 302 is a sheet of paper in the form of a continuous tape and serves as a base sheet of the roll sheet 300. The release paper 302 has a first surface 302*a* and a second surface 302*b* opposite to the first surface 302*a*.

The recording paper 301 is a thermal paper in the form of a continuous tape. The recording paper 301 has a first surface 301*a* and a second surface 301*b* opposite to each other. The first surface 301*a* of the recording paper 301 is attached via the adhesive layer 308 onto the second surface 302*b* of the release paper 302. An example of the adhesive layer 308 is acrylic emulsion adhesive. The adhesive layer 308 enables the recording paper 301 to be peeled from the release paper 302.

With this configuration, when the roll sheet 300 is rolled up into a roll shape, a trailing end 300*te* of the roll sheet 300 is located in an innermost position in the roll and a leading end 3001*e* of the roll sheet 300 is located in an outermost position in the roll as shown in FIG. 4. In the roll, the first surface 302*a* of the release paper 302 faces outwardly and the second surface 301*b* of the recording paper 301 faces inwardly. When the roll of the roll sheet 300 is set in the roll sheet holder 3 and is mounted in the tape printer 1, the roll sheet 300 is unwound from the roll in succession from the leading end 300*le* toward the trailing end 300*te* and is fed along the feeding path in the feeding direction F. While the roll sheet 300 is fed along the feeding path, the second surface 301*b* of the recording paper 301 confronts the thermal head 31 to be printed on by the thermal head 31, and the release paper 302 confronts the optical detector 95 to be detected thereby.

A first peel-away area 303 and a second peel-away area 304 are formed on the second surface 302*b* at both widthwise edges of the release paper 302. Each peel-away area 303, 304 has a width of 2 mm, in this example. The peel-away areas 303 and 304 are formed by peeling both widthwise edge areas of the recording paper 301 from the release paper 302.

The peel-away areas 303 and 304 ensure that even if adhesive is exuded from the adhesive layer 308, the adhesive will not reach the widthwise edges of the roll sheet 300. The adhesive will not adhere to the feed path of the tape printer 1 and will not cause interference with the feeding of the roll sheet 300.

Figure 16B:
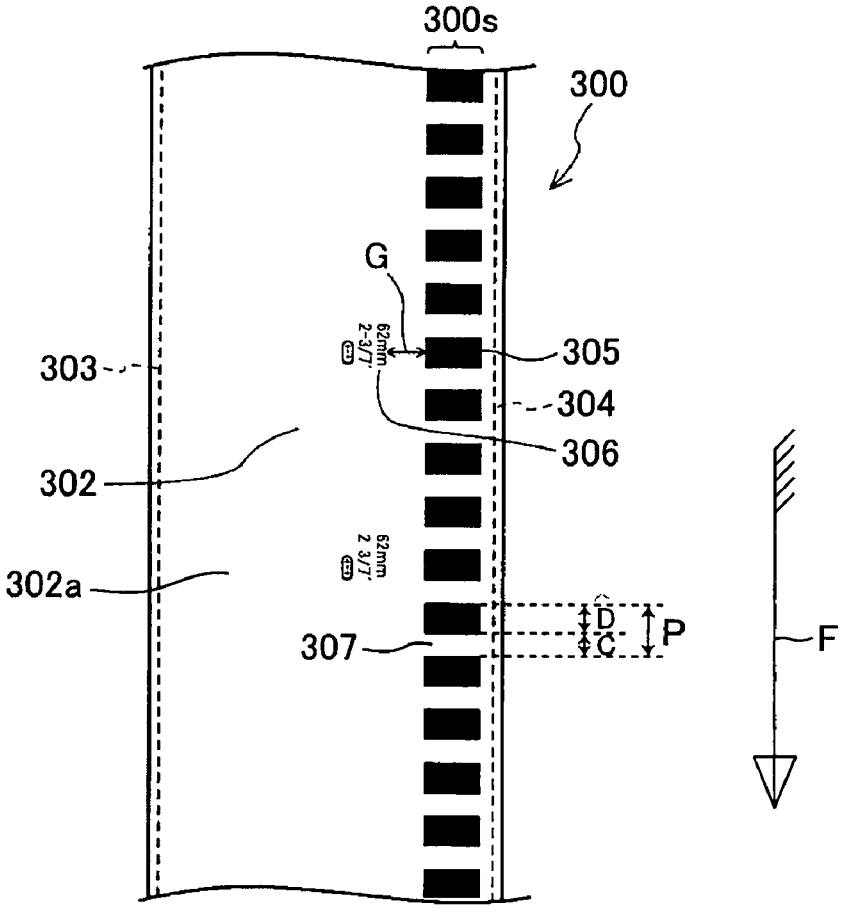
FIG. 16(B) is a plan view showing a sensing surface of the unwound portion of the roll sheet in FIG. 16(A)
Figure 16C:
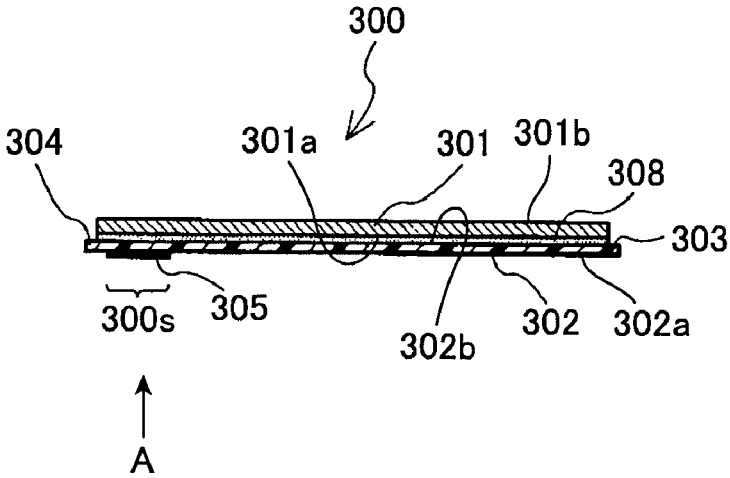
FIG. 16(C) shows a cross-section of the unwound portion of the roll sheet taken along a line XVIc-XVIc in FIG. 16(A)

As shown in FIG. 16(B), sensor marks 305 are printed on one side in the widthwise direction (right side in the figure) on the first surface 302*a* of the release paper 302. The sensor marks 305 are arranged in succession with a fixed interval P in the lengthwise direction of the roll sheet 300. Each sensor mark 305 is printed in a rectangular shape filled with black. In this example, each sensor mark 305 has a rectangle shape with a 10 mm longer side and a 5 mm shorter side. The sensor marks 305 are printed with the interval P of 10.16 mm.

As shown in FIG. 16(B), the sensor marks 305 are printed at positions, which are offset from the second peel-away area 304 in the widthwise direction toward the first peal-away area 303. In this figure, the leftside edge of the peel-away area 304 is shifted 2 mm away from the rightside edge of the roll sheet 300. Each sensor mark 305 has a rightside edge, which is shifted leftwardly from the right-side edge of the roll sheet 300 by an amount of more than 2 mm. Accordingly, the rightside edge of each sensor mark 305 is located exactly on the leftside edge of the peel-away area 304 or is shifted further leftwardly from the leftside edge of the peel-away area 304. In this example, the rightside edge of each sensor mark 305 is located 4.5 mm away from the right-side edge of the roll sheet 300, that is, 2.5 mm away from the leftside edge of the peel-away area 304. Because each sensor mark 305 has a width of 10 mm, the leftside edge of each sensor mark 305 is shifted leftwardly from the right-side edge of the roll sheet 300 by an amount of more than 12 mm (14.5 mm in this example). Because the width of the roll sheet 300 is 66 mm and the first peel-away area 303 has a width of 2 mm, the left side edge of the sensor marks 305 are shifted rightwardly away from the right side edge of the first peel-away area 303.

In this way, the entire area of each sensor mark 305 is shifted leftwardly from the second peel-away area 304 and is shifted rightwardly from the first peel-away area 303. In other words, no part of each sensor mark 305 is located on the first or second peel-away area 303, 304. The entire area of each sensor mark 305 is located on the recording paper 301. Accordingly, each sensor mark 305 exhibits a uniform amount of light reflectivity and a uniform amount of transmittance or transmissivity over the entire area thereof.

It is noted that a sensing bar area 300*s* is defined as a long strip-shaped area, which extends in the lengthwise direction of the roll sheet 300, whose rightside edge is shifted leftwardly from the right-side edge of the roll sheet 300 by the amount of more than 2 mm (4.5 mm, in this example), and whose left-side edge is shifted leftwardly from the right-side edge of the roll sheet 300 by the amount of more than 12 mm (14.5 mm, in this example). In the sensing bar area 300*s*, the sensor marks 305 and inter-mark areas 307 are arranged in alternation in the lengthwise direction. An inter-mark area 307 is defined between each two adjacent sensor marks 305 in the feeding direction F. Each sensor mark 305 has a length D of 5 mm in the lengthwise direction of the roll sheet 300, while each inter-mark area 307 has a length C of 5.16 mm in the lengthwise direction of the roll sheet 300.

While the unwounded part of the roll sheet 300 is fed in the feeding direction F, the optical sensor 95 tracks the sensing bar area 300*s*. That is, light from the optical sensor 95 strikes a part of the sensing bar area 300*s* in the direction of arrow A in FIG. 16(C). When the light strikes some sensor mark 305, the sensor mark 305 exhibits a uniform amount of reflectivity and a uniform amount of transmittance over the entire width with respect to the incident light. It is possible to prevent errors from occurring during read-in of the sensor mark 305 by the optical sensor 95.

Because no part of each inter-mark area 307 is located on the peel-away area 304, each inter-mark area 307 also exhibits a uniform amount of reflectivity and a uniform amount of transmittance over the entire width. This also prevents errors from arising during read-in of the inter-mark areas 307 by the optical sensor 95.

On the first surface 302*a* of the release paper 302, characters and/or symbols 306 are printed at positions that are shifted by an amount G (6 mm, in this example) from the leftside edge (in FIG. 16(B)) of the sensor marks 305. The characters and/or symbols 306 are for identifying the roll sheet 300. More specifically, the characters and/or symbols 306 indicate: the tape type, tape width, and the like of the roll sheet 300. The characters and/or symbols 306 are printed at a location that is apart from the sensor marks 305 by a sufficiently large amount of space (6 mm). This ensures that even though a great amount of ink is used for printing the sensor marks 305, the characters and/or symbols 306 can be printed with sufficiently a high density.

In this way, the characters and/or symbols 306 are printed on the release paper 302. When the roll sheet 300 is rolled up, the release paper 302 faces outwardly, the characters and/or symbols 306 can be observed accurately.

As described above, the roll sheet 300 has the release paper 302 as a base sheet. The recording paper 301 (thermal paper) is attached to the release paper 302 via the adhesive layer 308 so that the recording paper 301 can be peeled off from the release paper 302. In addition, the first and second peel-away areas 303 and 304 are formed on both side edges of the roll sheet 300 in the widthwise direction thereof by peeling off both widthwise edges of the recording paper 301 from the release paper 302 to allow the release paper 302 to be exposed at the both side edges of the roll sheet 300. The sensor marks 305 are printed on the release paper 302 as being entirely shifted from the peel-away areas 303 and 304. This ensures that the roll sheet 300 has a uniform thickness over the entire area of each sensor mark 305, thereby ensuring that each sensor mark 305 has uniformities in its reflectivity and transmittance with respect to incident light.

COMPARATIVE EXAMPLE

Figure 17A:
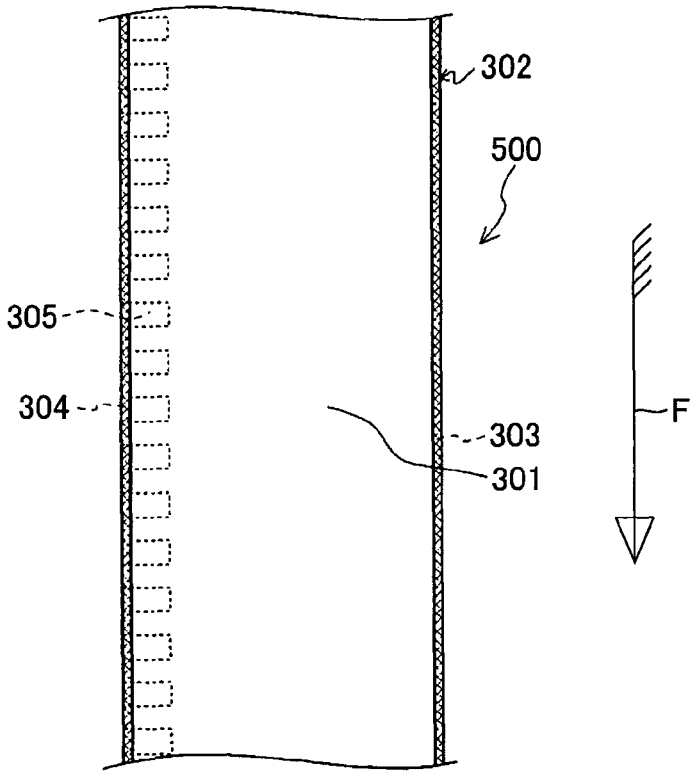
FIG. 17(A) is a plan view showing a recording surface of an unwound portion of a roll sheet according to a comparative example.
Figure 17B:
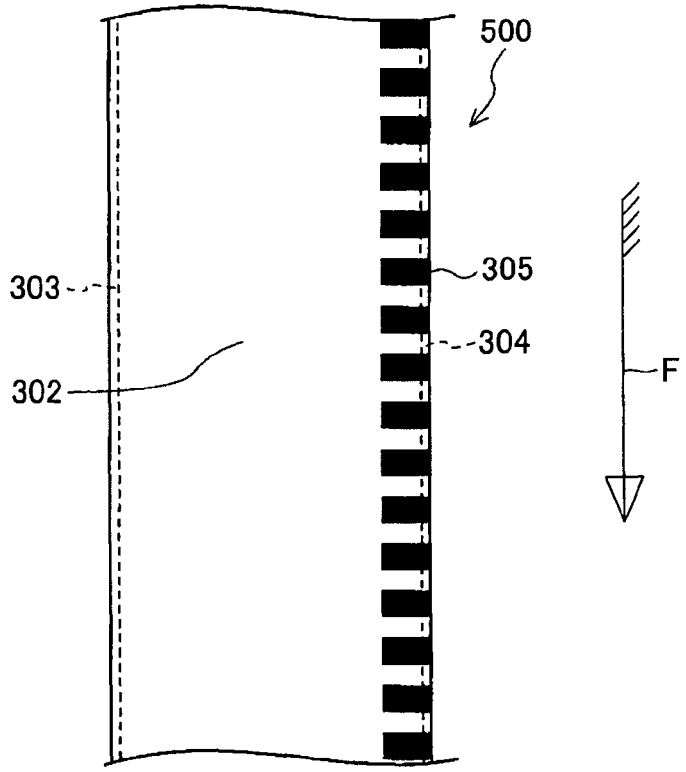
FIG. 17(B) is a plan view showing a sensing surface of the unwound portion of the roll sheet of FIG. 17(A)

A comparative example roll sheet 500 is shown in FIG. 17(A) and FIG. 17(B). Contrary to the above-described first example of the present embodiment, each sensor mark 305 is located partly on the peel-away area 304 in the comparative example. In other words, each sensor mark 305 has: a portion that is located on the recording paper 301; and another portion that is located on the peel-away area 304. Accordingly, each sensor mark 305 has difference in thickness between the portion that is located on the recording paper 301 and the other portion that is located on the peel-away area 304. Each sensor mark 305 exhibits non-uniform light transmittance and non-uniform light reflectivity. Accordingly, each sensor mark 305 may not be detected by the tape printer 1 accurately.

According to the present example, when the roll sheet 300 is rolled up into a roll, a trailing end portion of the roll sheet 300 is folded up. The trailing end portion of the roll sheet 300 is located in the innermost position in the roll, and will serve as a trailing end when the roll sheet 300 is unwound from the roll of the roll sheet 300 and is fed to be printed in the feeding direction F.

Next will be described how to fold the trailing end portion of the roll sheet 300 with reference to FIG. 18(A)-FIG. 18(F).

Figure 18A:
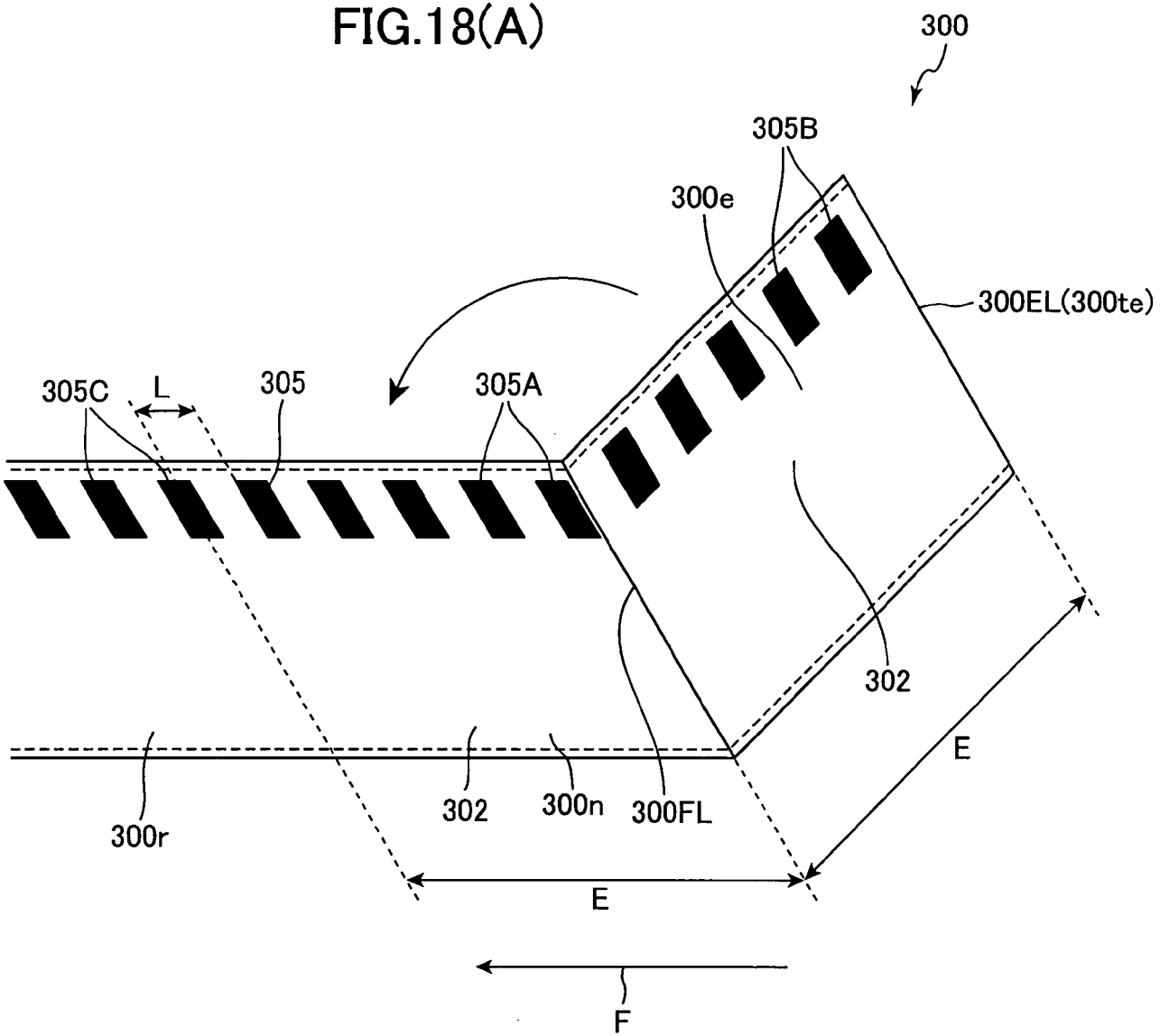
FIG. 18(A) is a perspective view showing how to fold a trailing end portion of the roll sheet shown in FIG. 16(A)
Figure 18B:
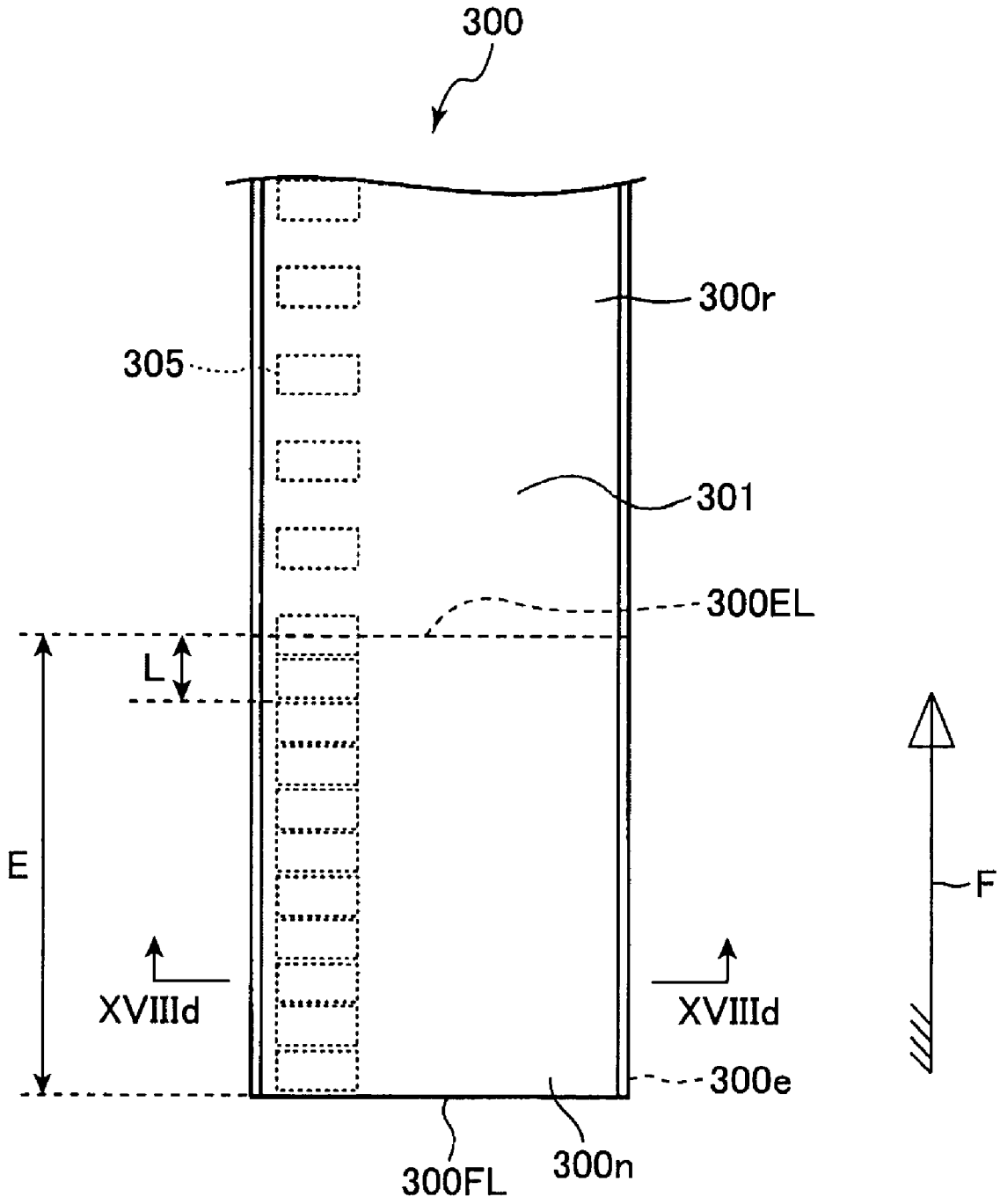
FIG. 18(B) is a plan view showing a printing surface side of the roll sheet at the folded trailing end portion shown in FIG. 18(A)
Figure 18C:
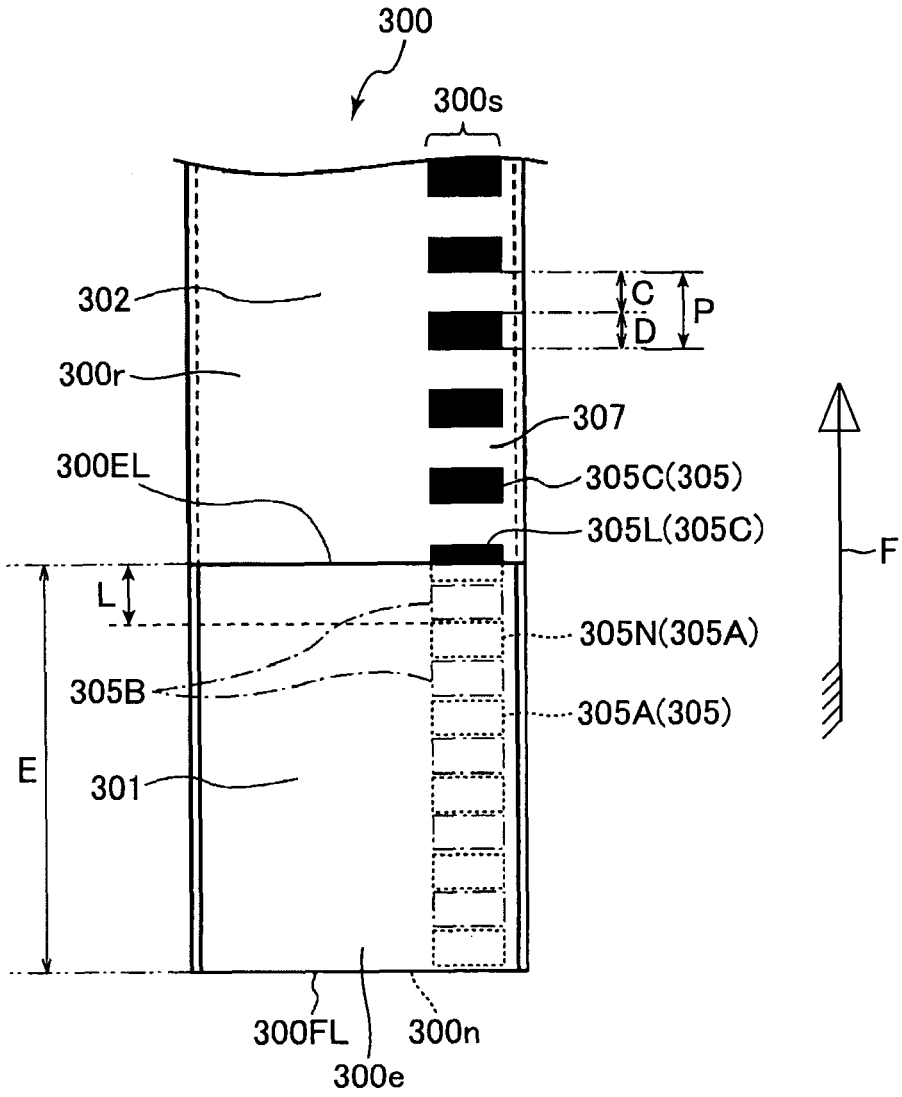
FIG. 18(C) is a plan view showing a sensing surface side of the roll sheet at the folded trailing end portion of FIG. 18(A)
Figure 18D:
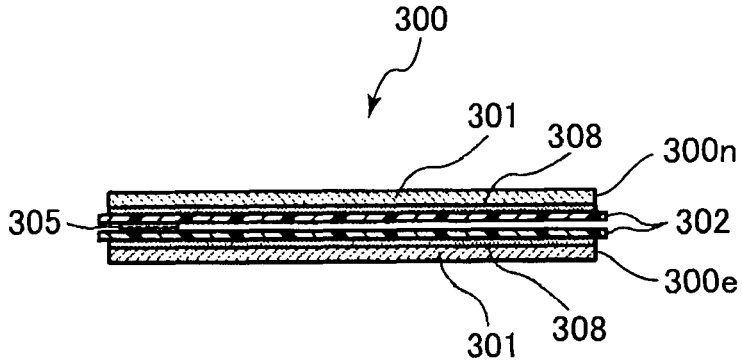
FIG. 18(D) shows a cross-section of the roll sheet at the folded trailing end portion, taken along a line XVIIId-XVIIId in FIG. 18(B)

As shown in FIG. 18(C), the pitch P (10.16 mm, in this example) of the sensor marks 305 is equal to a total of length C (5.16 mm, in this example) of the inter-mark area 307 and length D (5 mm, in this example) of the shorter side of the sensor mark 305. In this way, the spacing (length C) between the adjacent sensor marks 305 is greater than the length (length D) of the sensor mark 305 in the lengthwise direction of the roll sheet 300.

As shown in FIG. 18(A), the roll sheet 300 has a trailing end line 300EL as the trailing end 300*te*. In other words, the trailing end line 300EL is located in the innermost location in the roll when the roll sheet 300 is rolled up as shown in FIG. 4. The trailing end line 300EL extends in the widthwise direction across the roll sheet 300, that is, perpendicularly to the lengthwise direction of the roll sheet 300.

An imaginary folding line 300FL is defined on the roll sheet 300 at a predetermined distance E away from the trailing end line 300EL. The folding line 300FL extends also in the widthwise direction across the roll sheet 300, that is, perpendicularly to the lengthwise direction of the roll sheet 300.

The entire roll sheet is divided into an end portion 300*e*, a next-to-end portion 300*n*, and a remaining portion 300*r* along the feeding direction F. The end portion 300*e* is defined with respect to the feeding direction F as an area of the roll sheet 300 between the trailing end line 300EL and the imaginary folding line 300FL. The next-to-end portion 300*n* is defined as an area of the roll sheet 300 that is located next to the end portion 300*e* in the feeding direction F, with the imaginary folding line 300FL being located between the end portion 300*e* and the next-to-end portion 300*n*. The next-to-end portion 300*n* has a length the same as the length E of the end portion 300*e* in the lengthwise direction of the roll sheet 300. The remaining portion 300*r* is defined as a remaining area of the roll sheet 300 other than the end portion 300*e* and the next-to-end portion 300*n*.

It is noted that sensor marks 305, whose leading edges in the feeding direction F are located on the end portion 300*e*, will be referred to as "sensor marks 305B" hereinafter, sensor marks 305, whose leading edges in the feeding direction F are located on the next-to-end portion 300*n*, will be referred to as "sensor marks 305A" hereinafter, and remaining sensor marks 305, whose leading edges in the feeding direction F are located on the remaining portion 300*r*, will be referred to as "sensor marks 305C" hereinafter.

The roll sheet 300 is folded at the imaginary folding line 300FL so that a part of the release paper 302 in the end portion 300*e* is facing another part of the release paper 302 in the next-to-end portion 300*n*. As shown in FIG. 18(B) and FIG. 18(C), each widthwise edge of the end portion 300*e* extends along a corresponding widthwise edge of the next-to-end portion 300*n*. As shown in FIG. 18(C), the sensor marks 305A and 305B are covered up by the end portion 300*e* of the roll sheet 300. This has the same effect as though no sensor marks 305A or 305B were printed in the trailing end portion of the roll sheet 300. The trailing end line 300EL now serves as a line dividing the roll sheet 300 into a normal portion where the sensor marks 305 are printed and an end portion where no sensor marks 305 are printed.

When this roll sheet 300 is set into the sheet holder 3 and is mounted in the tape printer 1 and detection of the sensor marks 305 is performed by the optical sensor 95, the optical sensor 95 continues successively detecting the sensor marks 305 until the trailing end line 300EL confronts the optical sensor 95. When the trailing end line 300EL reaches the optical sensor 95, the optical sensor 95 will detect sensor marks 305 no more, thereby detecting the trailing end of the roll sheet 300.

As described above, the length C of the inter-mark area 307 is greater than the length D of the sensor mark 305. The folding line 300FL is located relative to the sensor marks 305 in the feeding direction F so that when the roll sheet 300 is folded at the folding line 300FL as shown in FIG. 18(C), the sensor marks 305B are shifted from the sensor marks 305A in the feeding direction F. The entire area of each sensor mark 305A does not overlap with the sensor marks 305A. In other words, each sensor mark 305A is located between a corresponding pair of adjacent sensor marks 305B, and each sensor mark 305B is located between a corresponding pair of adjacent sensor marks 305A. This prevents the optical sensor 95 from erroneously detecting the sensor marks 305A or 305B.

More specifically, if the sensor marks 305A and 305B were overlapped with one another, even if the sensor marks 305A and 305B are covered up by the folded part of the roll sheet 300, the roll sheet 300 will have, at its portion where the sensor marks 305A and 305B overlap with each other, high density that is similar to the density, which the roll sheet 300 has at its portion where the sensor mark 305A or 305B is exposed. Accordingly, if the sensor marks 305A and 305B were overlapped with one another, even if the sensor marks 305A and 305B are covered up by the folded part of the roll sheet 300, the roll sheet 300 will exhibit, at its portion where the sensor marks 305A and 305B overlap with each other, a large amount of light reflectivity that is similar to the light reflectivity, which the roll sheet 300 exhibits at its portion where the sensor mark 305A or 305B is exposed. According to the present example, however, the sensor marks 305A and 305B do not overlap with each other in the folded part of the roll sheet 300. The optical sensor 95 will not erroneously detect the sensor marks 305A or 305B hidden in the folded part of the roll sheet 300.

According to the present embodiment, the sensor marks 305A and 305B are arranged in alternation in the folded part of the roll sheet 300. Accordingly, the roll sheet 300 has an almost uniform amount of density at the sensing bar area 300*s* over the entire length E of the folded part of the roll sheet 300. The roll sheet 300 therefore exhibits an almost uniform amount of light transmittance and an almost uniform amount of light reflectivity at the sensing bar area 300*s* over the entire length E of the folded part in the roll sheet 300. This prevents the optical sensor 95 from erroneously detecting the sensor marks 305A or 305B hidden in the folded part of the roll sheet 300, but ensures that the optical sensor 95 can accurately recognize the trailing end portion of the roll sheet 300.

The length C of the inter-mark area 307 is greater than the length D of the sensor mark 305. This ensures that the sensor marks 305A and 305B will be arranged as being shifted from one another when the end portion 300*e* is folded over the next-to-end portion 300*n*.

The length C of the inter-mark area 307 may be equal to the length D of the sensor mark 305. In this case, the folding line 300FL can be located with respect to the sensor marks 305 so that when the roll sheet 300 is folded at the folding line 300FL, the sensor marks 305A and 305B will be arranged in alternation in the longitudinal direction with no space being formed therebetween. In this case, the roll sheet 300 has a substantially completely uniform amount of density at the sensing bar area 300*s* over the entire length E of the folded part in the roll sheet 300. The roll sheet 300 exhibits a substantially completely uniform amount of light transmittance and a substantially completely uniform amount of light reflectivity at the sensing bar area 300*s* over the entire length E of the folded part in the roll sheet 300. This prevents the optical sensor 95 from erroneously detecting the sensor marks 305A or 305B hidden in the folded part of the roll sheet 300, but ensures that the optical sensor 95 can accurately recognize the trailing end of the roll sheet 300. In this way, the length C of the inter-mark area 307 can be set to any length that is greater than or equal to the length D of the sensor mark 305.

As shown in FIG. 18(C), when the roll sheet 300 is fed in the feeding direction F, the optical sensor 95 detects the sensor marks 305C in succession. At last, the optical sensor 95 detects one sensor mark 305C (which will be referred to as "last sensor mark 305L" hereinafter), whose leading edge is located closest to the trailing end line 300EL among all the sensor marks 305C. Next, the optical sensor 95 tries detecting a sensor mark 305A (which will be referred to as "next sensor mark 305N" hereinafter) that is located as being shifted from the last sensor mark 305L by the pitch P in the lengthwise direction. It is noted that among the sensor marks 305A, the sensor mark 305N is located closest to the trailing end line 300EL when the roll sheet 300 is folded at the folding line 300FL. A length L is defined between the trailing end line 300EL and the leading edge of the next sensor mark 305N in the feeding direction F.

After the optical sensor 95 detects the last sensor mark 305L, the tape printer 1 still continues feeding the roll sheet 300 by the pitch P (=C+D), in order to allow the optical sensor 95 to try detecting the next sensor mark 305N. Because the sensor mark 305N is hidden by the folded part of the roll sheet 300, the tape printer 1 fails to detect the sensor mark 305N.

After the optical sensor 95 fails to detect the sensor mark 305N, the tape printer 1 further continues feeding the roll sheet 300 by a predetermined length Q, as shown in FIG.

18(E), before finally determining that the optical sensor 95 has detected a trailing end portion of the roll sheet 300. The tape printer 1 finally stops feeding the roll sheet 300 when the tape printer 1 finally determines that the optical sensor 95 has detected a trailing end of the roll sheet 300. In other words, the tape printer 1 finally stops feeding the roll sheet 300 when the position of the roll sheet 300, which is distant from the sensor mark 305N by the length Q in the direction opposite to the feeding direction F, reaches the detecting position DP as shown in FIG. 18(E) and FIG. 18(F).

It is noted that according to the present example, the folding line 300FL is set so that the total amount of the length Q and the length L is smaller than both of the DP-CP feed path length B and the folded length E.

Figure 18E:
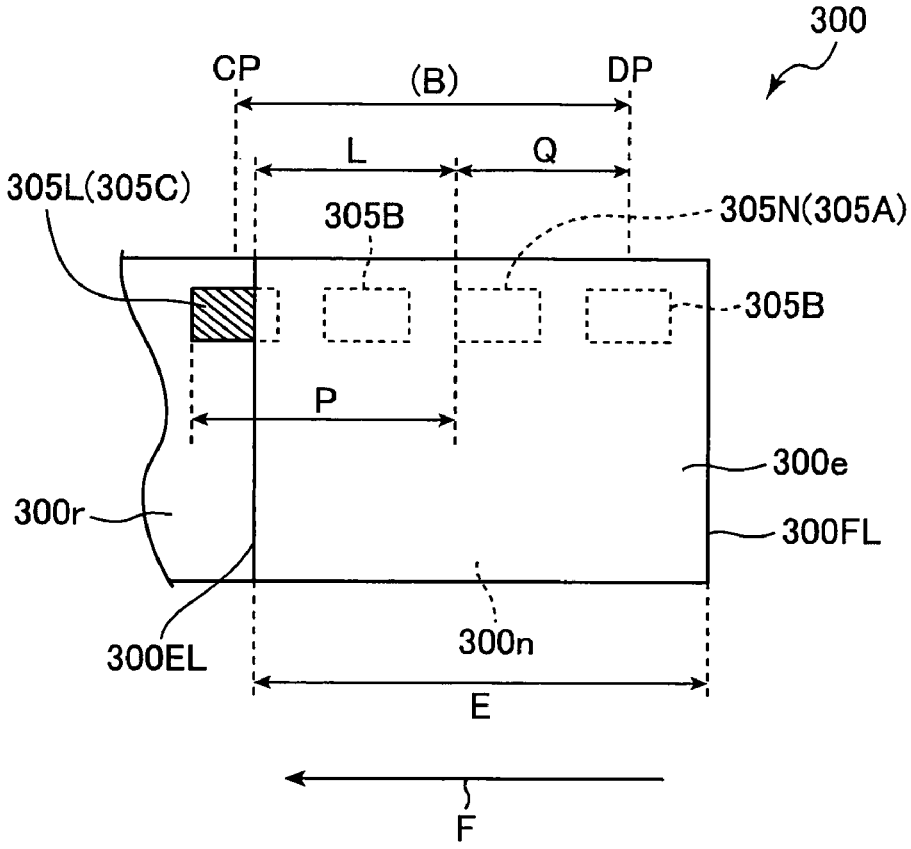
FIG. 18(E) is a plan illustration showing the positional relationship between the folded trailing end portion of the roll sheet of FIG. 18(A) and a cutting position CP and a detecting position DP.
Figure 18F:
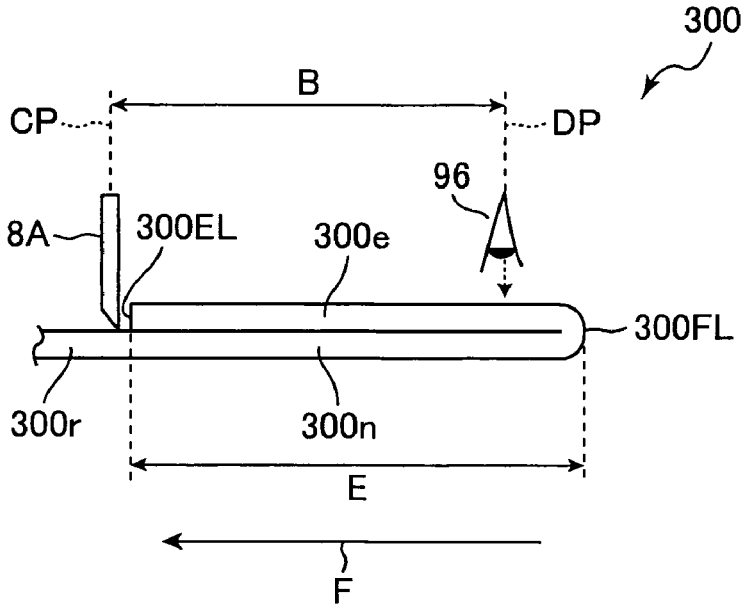
FIG. 18(F) is a side illustration showing a positional relationship between the folded trailing end portion of the roll sheet of FIG. 18(A) and the cutting position CP and the detecting position DP.

Because the sum (L+Q) is smaller than B, when the tape printer 1 finally stops feeding the roll sheet 300, the trailing end line 300EL has not yet reached the cutting position CP as shown in FIG. 18(E) and FIG. 18(F). This ensures that the trailing end line 300EL of the roll sheet 300 will not reach the cutting position CP before the tape printer 1 finally stops feeding the roll sheet 300. It is possible to prevent the cutting unit 8 from cutting the folded part of the roll sheet 300 that has two sheets' worth of thickness. It is therefore possible to prevent occurrence of damage to the blade 8A and the occurrence of feed jams along the feed path.

Because the sum (L+Q) is smaller than E, when the tape printer 1 finally stops feeding the roll sheet 300, the folding line 300FL has not yet reached the detecting position DP. This ensures that the folding line 300FL of the roll sheet 300 will not reach the detecting position DP before the tape printer 1 finally stops feeding the roll sheet 300. It is possible to prevent the entire part of the roll sheet 300 from erroneously passing by the optical sensor 95 before finally stopping feeding the roll sheet 300.

According to the present example, it is possible to roll up the roll sheet 300 simply by first locating the folded part of the roll sheet 300 on the surface of the roll core 3B and then winding the roll sheet 300 over the folded part around the tape spool 3B. This is because when the trailing end portion is folded up, the trailing end portion can exhibit a higher amount of friction coefficient with respect to the roll core 3B in comparison with when the trailing end portion is not folded. It becomes unnecessary to fixedly secure, via an adhesive, the trailing end portion of the roll sheet 300 to the roll core 3B. It is unnecessary to seal the trailing end portion of the roll sheet 3A onto the roll core 3B. The roll core 3B can be removed from the roll sheet 300 after the roll sheet 300 is rolled up around the roll core 3B, thereby obtaining a spool-less type roll. The spool-less type roll 300 can be mounted directly on the holder shaft 40.

When producing the roll sheet 300, the sensor marks 305 are printed by the pitch P in succession along the entire length of the roll sheet 300. Simply folding the trailing end of the roll sheet 300 enables the optical sensor 95 to accurately detect the trailing end of the roll sheet 300.

It becomes unnecessary to print any special end marks to the trailing end portion of the roll sheet 300. Similarly, it becomes unnecessary to perform any complicated mark-printing operation onto the roll sheet 300. For example, it becomes unnecessary to print sensor marks 305 so that the sensor marks 305 will be printed on the almost entire part of the roll sheet 300 but will not be printed on the trailing end portion of the roll sheet 300. According to the present embodiment, it is possible to print sensor marks 305 over the entire length of the roll sheet 300.

The roll sheet 300 can be produced: by first producing a long mother sheet, on which the sensor marks 305 are printed in succession; and then by cutting a proper length of roll sheet out of the mother sheet at an arbitrary location. The thus cut portion is used as the roll sheet 300. Production costs of the roll sheet 300 can be reduced.

In the above-described manner, the trailing end portion of the roll sheet 300 is folded over, with the release paper 302 facing inward. In so doing, the surface of the release paper 302, on which sensor marks 305 are printed, becomes succeeded by the surface of the recording paper, on which there are no sensor marks 305. In this way, in the trailing end portion of the roll sheet 300, the sensor marks 305 are covered up, resulting in a situation that is equivalent to that in which no sensor marks 305 were printed. The optical sensor 95 successively detects the sensor marks 305 as the roll sheet 300 is fed in the feeding direction F, but does not detect the sensor marks 305 when the trailing end portion of the roll sheet 300 reaches the optical sensor 95. This allows the optical sensor 95 to accurately detect the trailing end of the roll sheet 300.

SECOND EXAMPLE

Next, a roll sheet 310 according to a second example of the roll sheet 3A will be described with reference to FIG. 19(A) and FIG. 19(B).

Similarly to the roll sheet 300 of the first example, the roll sheet 310 has a three-layer structure. More specifically, the roll sheet 310 has: a release paper 312; a recording paper 311; and an adhesive layer (not shown) provided between the recording paper 311 and the release paper 312. The release paper 312, the recording paper 311, and the adhesive layer are made from the same material with the release paper 302, the recording paper 301, and the adhesive layer 308 in the roll sheet 300 of the first example. The positional relationship between the release paper 312, the recording paper 311, and the adhesive layer in the roll sheet 310 is the same as that between the release paper 302, the recording paper 301, and the adhesive layer 308 in the roll sheet 300 of the first example.

Similarly to the roll sheet 300 of the first example, the roll sheet 310 is rolled up into a roll shape, with its trailing end 310*te* being located in an innermost position in the roll and its leading end 3101*e* being located in an outermost position in the roll as shown in FIG. 4. In the roll, the release paper 312 faces outwardly and the recording paper 311 faces inwardly. When the roll of the roll sheet 310 is set in the roll sheet holder 3 and is mounted in the tape printer 1, the roll sheet 310 is unwound from the roll in succession from the leading end 3101*e* toward the trailing end 310*te* and is fed along the feeding path in the feeding direction F. While the roll sheet 310 is fed along the feeding path, the recording paper 311 confronts the thermal head 31 to be printed on by the thermal head 31, and the release paper 312 confronts the optical detector 95 to be detected thereby.

Additionally, similarly to the first peel-away area 303 and the second peel-away area 304 in the first example, a first peel-away area 313 and a second peel-away area 314 are formed on both widthwise edges of the release paper 312 on its surface where the recording paper 311 is attached.

The roll sheet 310 of the present example differs from the roll sheet 300 in the first example in that a plurality of third peel-away areas 319 are additionally formed on the surface of the release paper 312, on which the recording paper 311 is attached.

The plurality of third peel-away areas 319 are arranged at a fixed pitch or interval P' along the lengthwise direction of the roll sheet 310, and are in continuous with the first and second peel-away areas 313 and 314. The peel-away areas 313, 314, and 319 are formed by peeling corresponding areas of the recording paper 311 from the release paper 312. Thus, the release paper 312 is exposed on the recording surface at the peel-away areas 313, 314, and 319 as shown in FIG. 19(A).

Figure 19A:
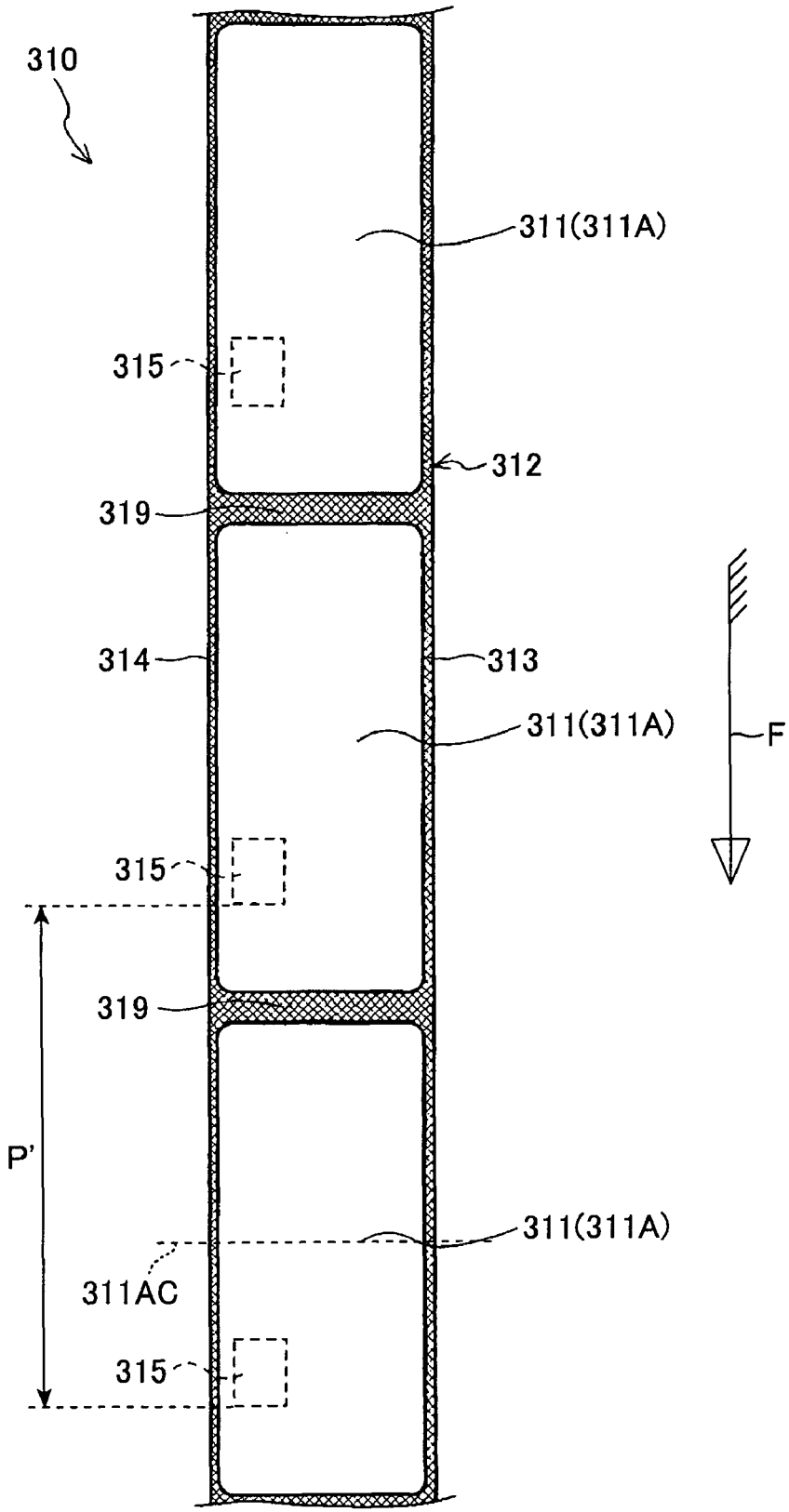
FIG. 19(A) is a plan view showing a recording surface of an unwound portion of a roll sheet according to a second example of the embodiment.

According to this example, therefore, the recording paper 311 is divided into a plurality of labels 311A by the peel-away areas 319 as shown in FIG. 19(A). The plurality of recording labels 311A are arranged also at the fixed pitch P'. A third peel-away area 319 is located between each two adjacent recording labels 311A. The plurality of labels 311A can be peeled off from the roll sheet 310 independently from one another.

In this example, the roll sheet 310 has a tape width of 32 mm. As shown in FIG. 19(A), each recording label 311A is substantially of a rectangular shape with four rounded corners. The recording label 311A has a longer side in the lengthwise direction of the roll sheet 310 and a shorter side in the widthwise direction of the roll sheet 310. In this example, each recording label 311A has a size of 90 mm (length in the lengthwise direction of the roll sheet 310)×29 mm (width in the widthwise direction of the roll sheet 310). The spacing between each two adjacent recording labels 311A is 6 mm. In other words, each third peel-away area 319 extends by an amount of 6 mm in the lengthwise direction of the roll sheet 310. Each of the peel-away areas 313 and 314 has a width of 1.5 mm.

Figure 19B:
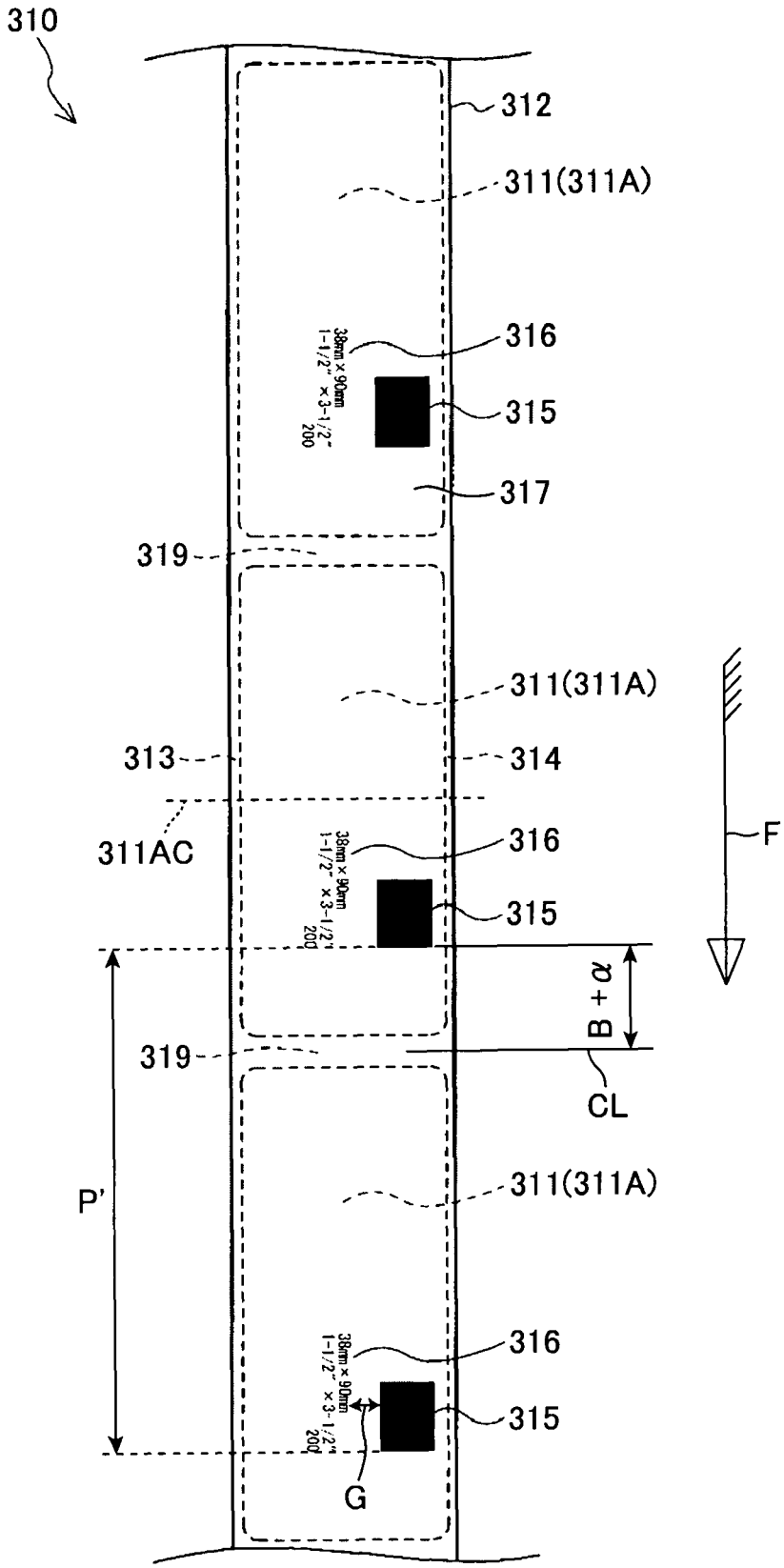
FIG. 19(B) is a plan view showing a sensing surface of the unwound portion of the roll sheet of FIG. 19(A)

As shown in FIG. 19(B), on the sensing surface of the roll sheet 310, a plurality of sensor marks 315 are printed on the release paper 312 at its one widthwise side (right side in the figure) of the roll sheet 310. The plurality of sensor marks 315 are printed in one-to-one correspondence with the plurality of labels 311A. The sensor marks 315 are therefore printed at the predetermined pitch P' along the longitudinal direction of the roll sheet 310. Each sensor mark 315 is printed in a rectangle filled with black. In this example, each sensor mark 315 has the shape of a rectangle with a longer side of 13 mm (lengthwise direction of the roll sheet 310) and a shorter side of 10 mm (widthwise direction of the roll sheet 310). An inter-mark area 317 is defined between each two adjacent sensor marks 315 in the feeding direction F.

As shown in FIG. 19(A) and FIG. 19(B), each sensor mark 315 is located with its entire area being located within the corresponding label 311A. More specifically, each sensor mark 315 is located at such a position that no part of the sensor mark 315 is located on any parts of the peel-away area 313, 314, or 319, but the entire part of the sensor mark 315 is located on a corresponding recording label 311A. In this example, each sensor mark 315 is located with its rightside edge (in FIG. 19(B)) being located at a position that is more than 1.5 mm (for example, 4.5 mm) apart from the rightside edge of the roll sheet 310. Accordingly, similarly to the sensor mark 305 in the first example, the sensor mark 315 can exhibit the uniform amount of light reflectivity and the uniform amount of light transmittance. Similarly to the inter-mark area 307 in the first example, the inter-mark area 317 can exhibit the uniform amount of light reflectivity and the uniform amount of light transmittance.

Similarly to the characters and/or symbols 306 in the first example, characters and/or symbols 316 are printed at positions that are shifted by an amount G (6 mm, in this example) from the leftside edge (in FIG. 19(B)) of the sensor marks 315. In this way, the characters and/or symbols 316 are printed in one-to-one correspondence with the recording labels 311A. The characters and/or symbols 316 are for identifying the roll sheet 310. More specifically, the characters and/or symbols 316 indicate: the tape type and tape width of the tape 310, the size of the recording labels 311A, and the like. Similarly to the characters and/or symbols 306 of the first example, because the characters and/or symbols 316 are located sufficiently apart from the sensor marks 315, even though a great amount of ink is used for printing the sensor marks 315, the characters and/or symbols 316 can be printed with sufficiently a high density.

As shown in FIG. 19(B), a cutting line CL for each label 311A is defined in the third peel-away area 319 that is located on the leading edge of the subject label 311A in the feeding direction F. For each label 311A, a sensor mark 315 is located in the feeding direction F that the leading edge of the sensor mark 315 is distant from the corresponding cutting line CL by an amount that is equal to a sum (B+a) of the DP-CP feed path length B and a predetermined fixed amount a. This ensures that the cutting line CL for one label 311A will reach the cutting position CP when the tape printer 1 feeds the roll sheet 310 by the predetermined fixed amount a after the optical sensor 96 has detected the sensor mark 315 for the subject label 311A. It is noted that as shown in FIG. 19(B), each label 311A has a central line 311AC in the feeding direction F.

According to the present example, the trailing end of the roll sheet 310 is folded similarly to the first example.

Next will be described how to fold the trailing end portion of the roll sheet 310 with reference to FIG. 20(A)-FIG. 20(E).

Figure 20A:
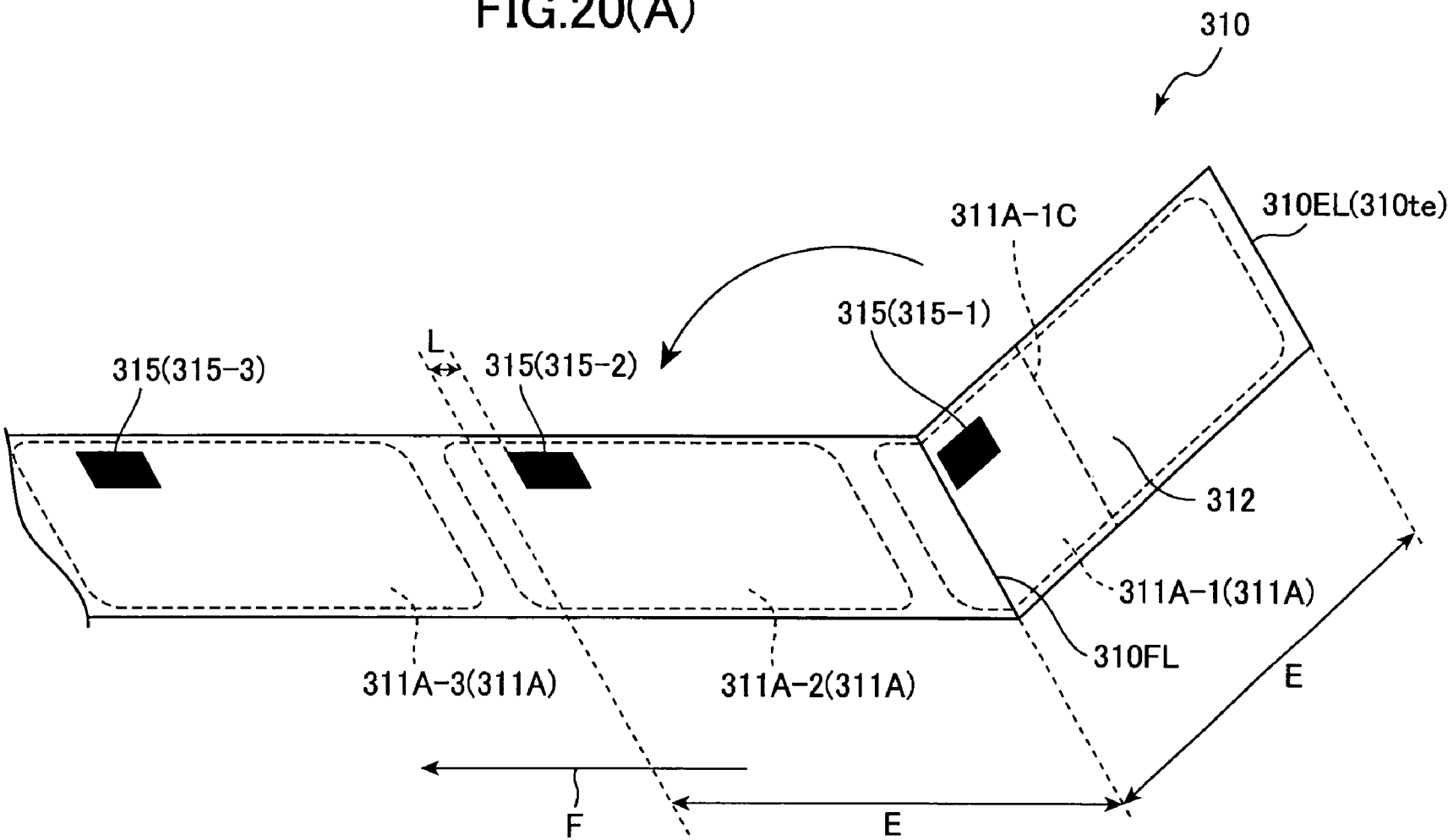
FIG. 20(A) is a perspective view showing how to fold a trailing end portion of the roll sheet shown in FIG. 19(A) and FIG. 19(B)

Similarly to the trailing end line 300EL in the first example, the roll sheet 310 has a trailing end line 310EL as the trailing end 310*te* as shown in FIG. 20(A). In other words, when the roll sheet 310 is rolled up, the trailing end line 310EL is located in the innermost position in the roll. The trailing end line 310EL extends in the widthwise direction across the roll sheet 310, that is, perpendicularly to the lengthwise direction of the roll sheet 310.

In the following description, among all the labels 311A in the roll sheet 310, a label 311A that is located closest to the trailing end line 310EL will be referred to as an end label 311A-1. Another label 311A that is next to the end label 311A-1 will be referred to as a second label 311A-2. Still another label 311A that is next to the second label 311A-2 will be referred to as a second label 311A-3. As shown in FIG. 20(A), in the trailing end portion, the end label 311A-1, the second label 311A-2, and the third label 311A-3 are arranged in the feeding direction F. Similarly, a sensor mark 315 that is located on the end label 311A-1 will be referred to as an end sensor mark 315-1. Another sensor mark 315 that is located on the second label 311A-2 will be referred to as a second sensor mark 315-2. Another sensor mark 315 that is located on the third label 311A-3 will be referred to as a third sensor mark 315-3.

As shown in FIG. 20(A), a folding line 310FL is defined on the end label 311A-1 at a position that is closer to the second label 311A-2 relative to the center line 311A-1C of the end label 311A-1 in the feeding direction F. A distance E is defined between the folding line 310FL and the trailing end line 310EL.

Figure 20B:
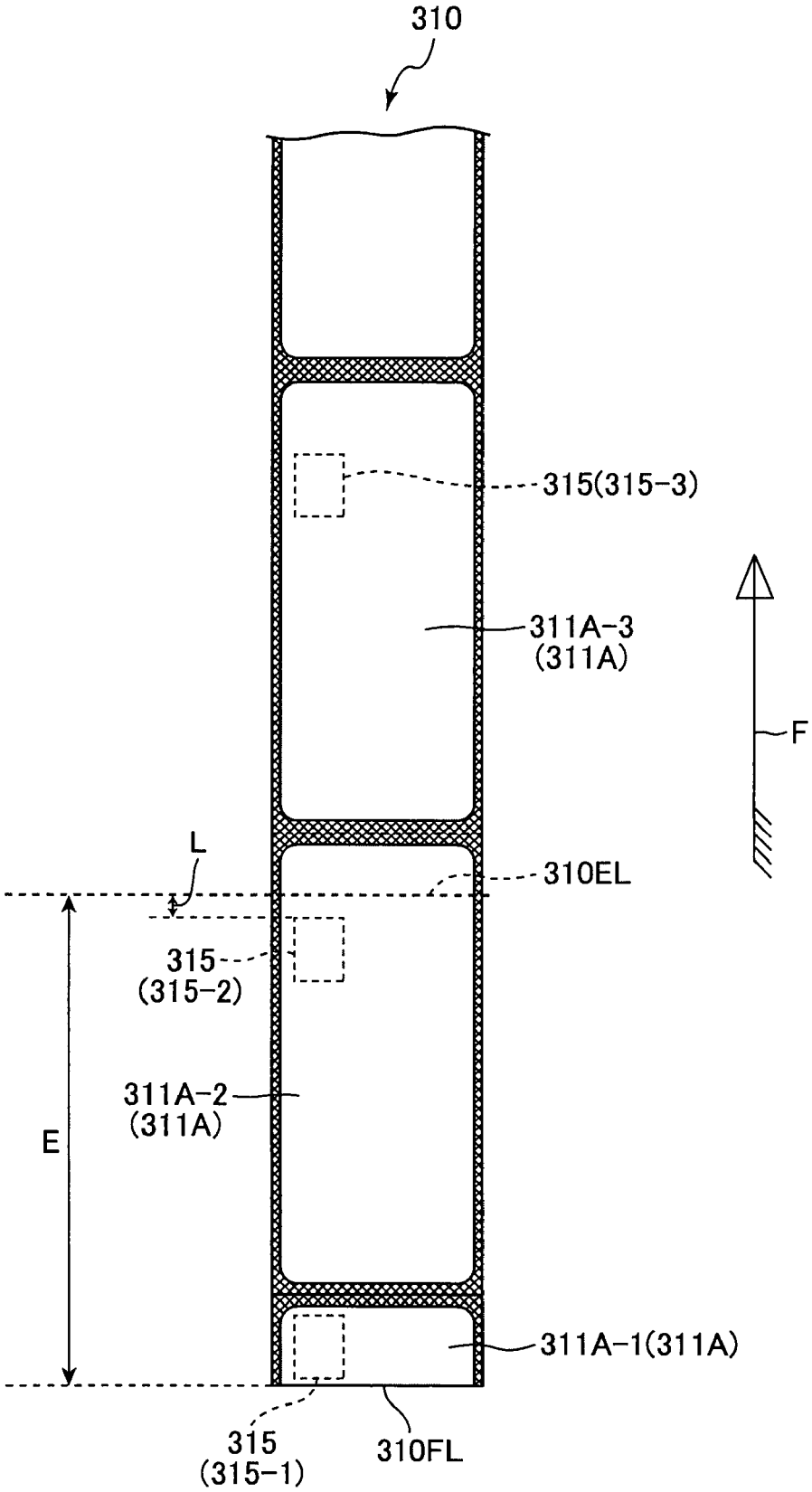
FIG. 20(B) is a plan view showing a printing surface side of the roll sheet at the folded trailing end portion shown in FIG. 20(A)
Figure 20C:
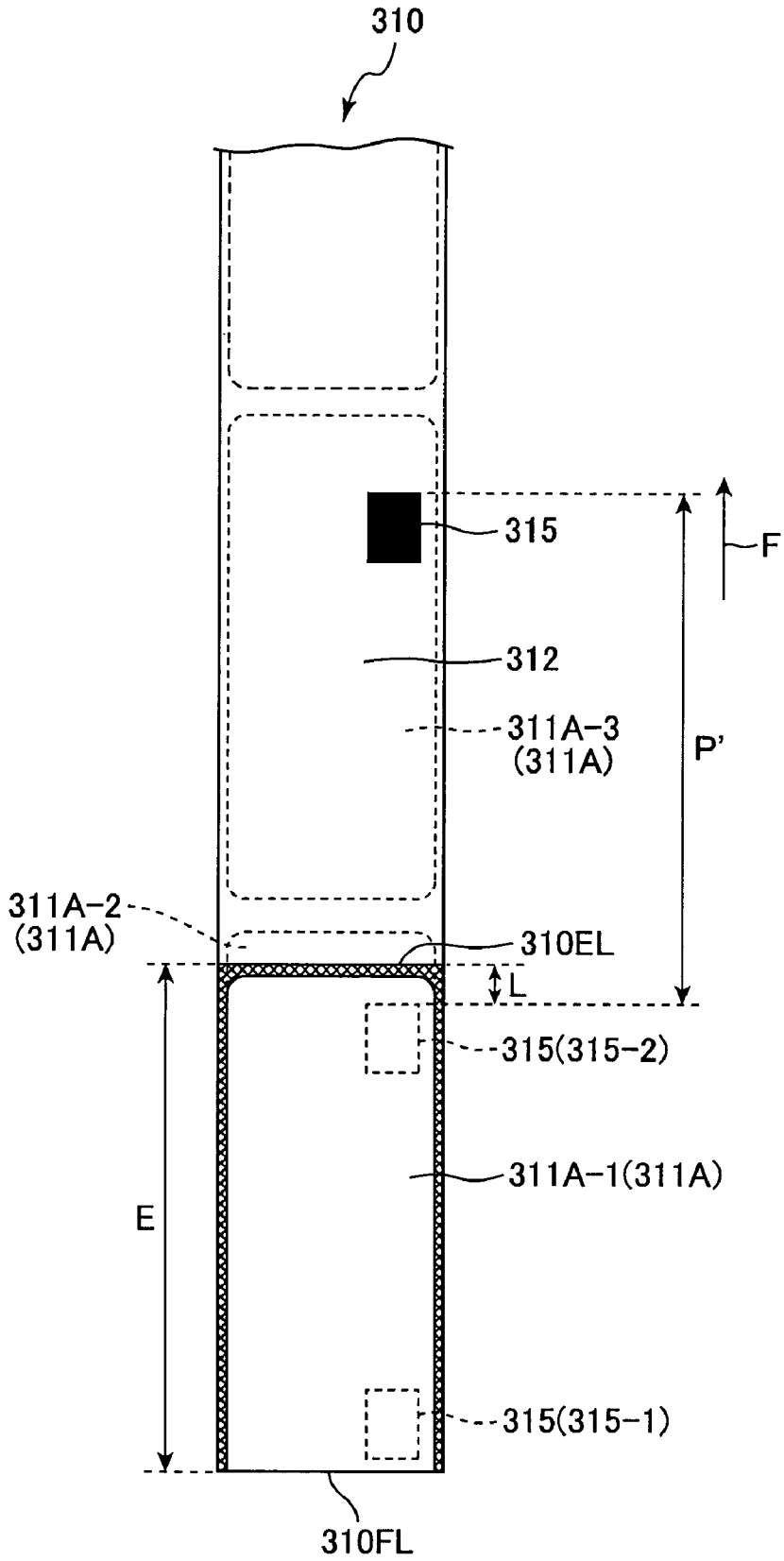
FIG. 20(C) is a plan view showing a sensing surface side of the roll sheet at the folded trailing end portion of FIG. 20(A)

As shown in FIG. 20(A), FIG. 20(B), and FIG. 20(C), the roll sheet 310 is folded at the folding line 310FL in the same manner as in the first example so that the release paper 312 will face inwardly and the recording labels 311A will face outwardly at the folded part.

The folding line 310FL is positioned at such a location in the feeding direction F that when the end portion of the roll sheet 310 is folded over at the folding line 310FL, both of the end sensor mark 315-1 and the second sensor mark 315-2 are hidden by the folded portion of the roll sheet 310 and the sensor marks 315-1 and 315-2 do not overlap with each other but are shifted entirely from each other in the feeding direction F. This will prevent the optical sensor 95 from erroneously detecting the sensor marks 315-1 and 315-2. As shown in FIG. 20(C), when the roll sheet 310 is folded at the folding line 310FL, a length L is defined between the trailing end line 310EL and the leading edge of the sensor mark 315-2 in the feeding direction F.

Figure 20D:
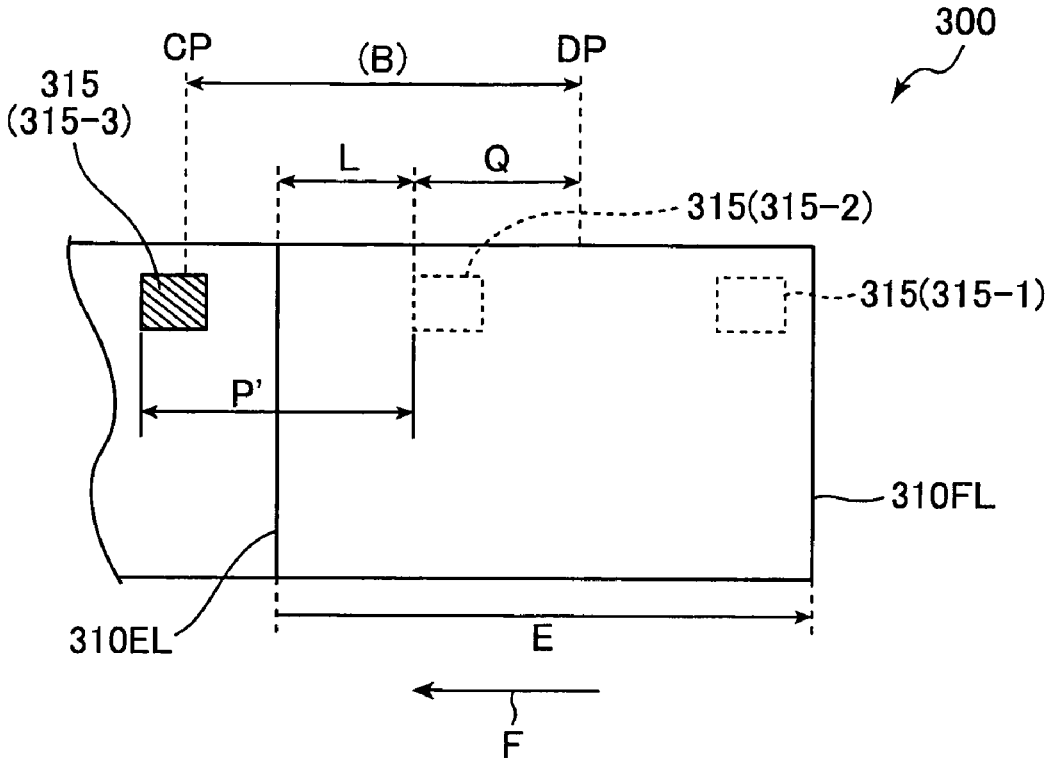
FIG. 20(D) is a plan illustration showing the positional relationship between the folded trailing end portion of the roll sheet of FIG. 20(A) and a cutting position CP and a detecting position DP.
Figure 20E:
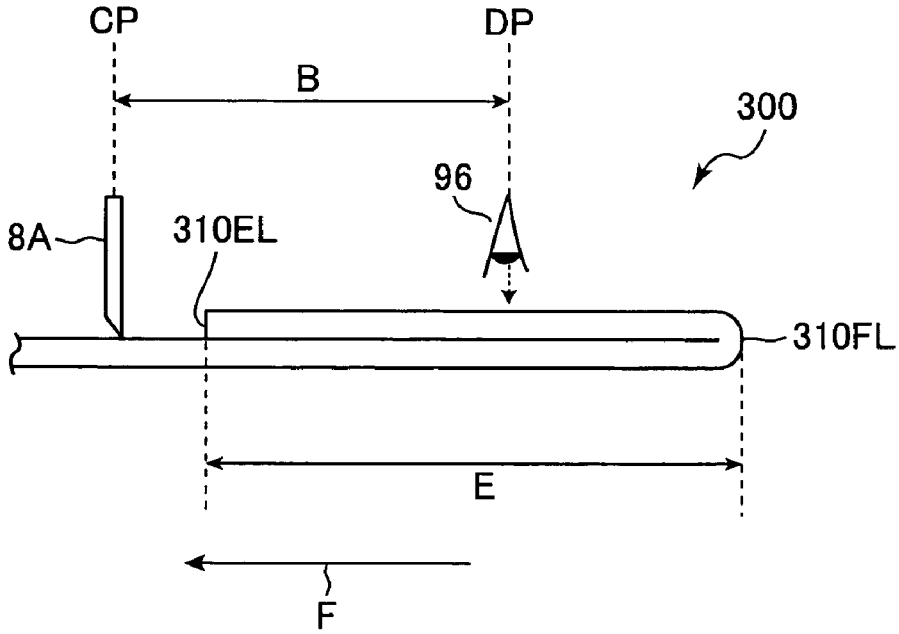
FIG. 20(E) is a side illustration showing a positional relationship between the folded trailing end portion of the roll sheet of FIG. 20(A) and the cutting position CP and the detecting position DP.

Similarly to the first example, after the optical sensor 95 detects the third sensor mark 315-3, the tape printer 1 still continues feeding the roll sheet 300 by the pitch P', as shown in FIG. 20(C) and FIG. 20(E), in order to allow the optical sensor 95 to try detecting the next sensor mark 315-2. Because the sensor mark 315-2 is hidden by the folded part of the roll sheet 310, the tape printer 1 fails to detect the sensor mark 315-2. As shown in FIG. 20(D), the tape printer 1 further continues feeding the roll sheet 310 by a predetermined length Q after the optical sensor 95 fails to detect the sensor mark 315-2, before finally determining that the optical sensor 95 has detected a trailing end of the roll sheet 310. The tape printer 1 finally stops feeding the roll sheet 310 when the tape printer 1 finally determines that the optical sensor 95 has detected a trailing end of the roll sheet 310. In other words, the tape printer 1 finally stops feeding the roll sheet 310 when the optical sensor 95 confronts the position of the roll sheet 310 that is distant from the sensor mark 315-2 by the length Q in the direction opposite to the feeding direction F.

Similarly to the first example, the folding line 310FL is set so that the total length of the length Q and the distance L is smaller than both of the DP-CP feed path length B and the folded length E.

Because the sum (L+Q) is smaller than B, when the tape printer 1 finally stops feeding the roll sheet 310, the trailing end line 310EL has not yet reached the cutting position CP as shown in FIG. 20(D) and FIG. 20(E). This ensures that the trailing end line 310EL of the roll sheet 310 will not reach the cutting position CP before the tape printer 1 finally stops feeding the roll sheet 310. It is possible to prevent the cutting unit 8 from cutting the folded part of the roll sheet 310 that has two sheets' worth of thickness. It is therefore possible to prevent occurrence of damage to the blade 8A and the occurrence of feed jams along the feed path.

Because the sum (L+Q) is smaller than E, when the tape printer 1 finally stops feeding the roll sheet 310, the folding line 310FL has not yet reached the detecting position DP. This ensures that the folding line 310FL of the roll sheet 310 will not reach the detecting position DP before the tape printer 1 finally stops feeding the roll sheet 300. It is possible to prevent the entire part of the roll sheet 310 from erroneously passing by the optical sensor 95 before finally stopping feeding the roll sheet 310.

<Modification>

Figure 21A:
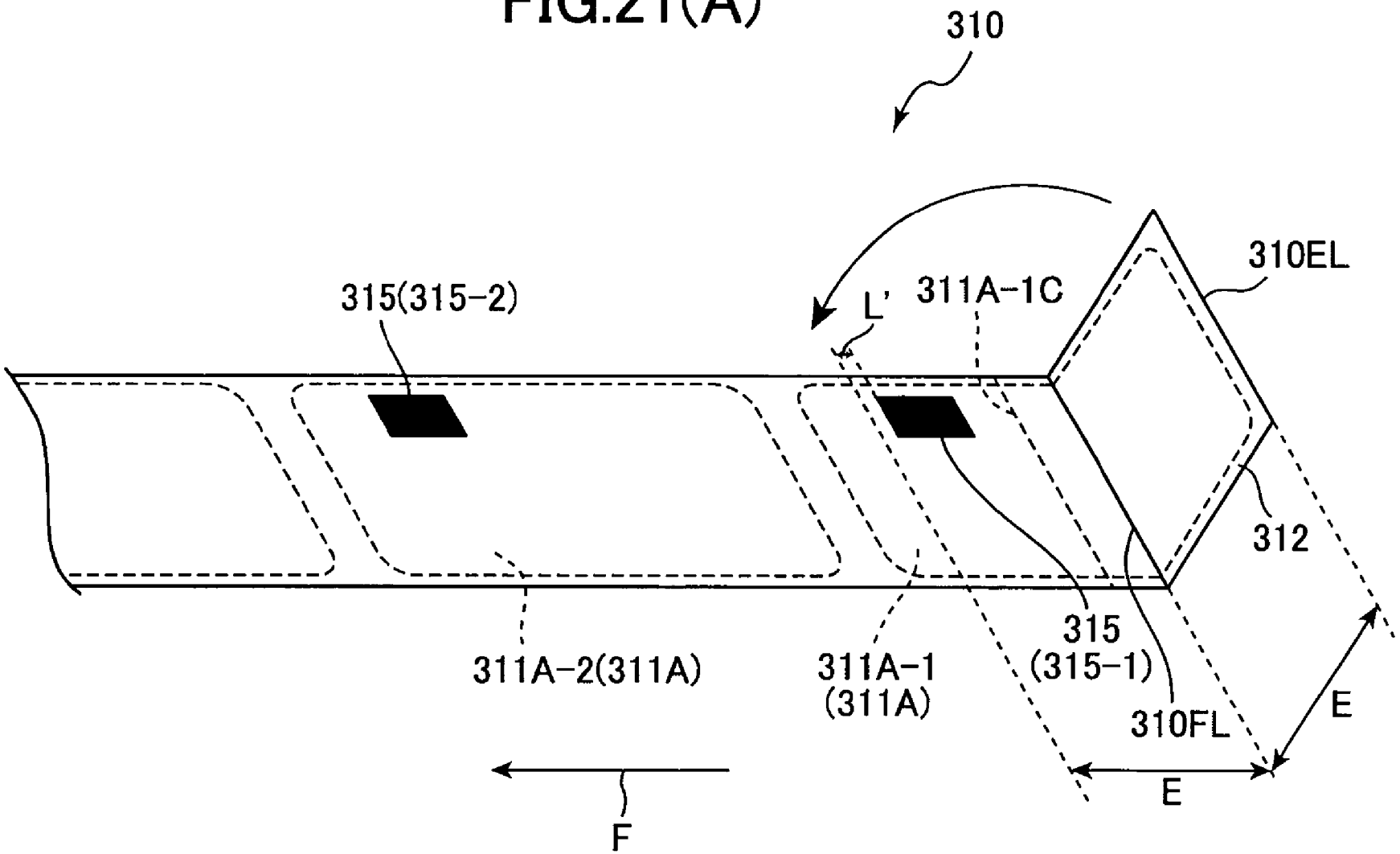
FIG. 21(A) is a perspective view showing how to fold the trailing end portion of the roll sheet shown in FIG. 19(A) and FIG. 19(B) according to a modification.
Figure 21B:
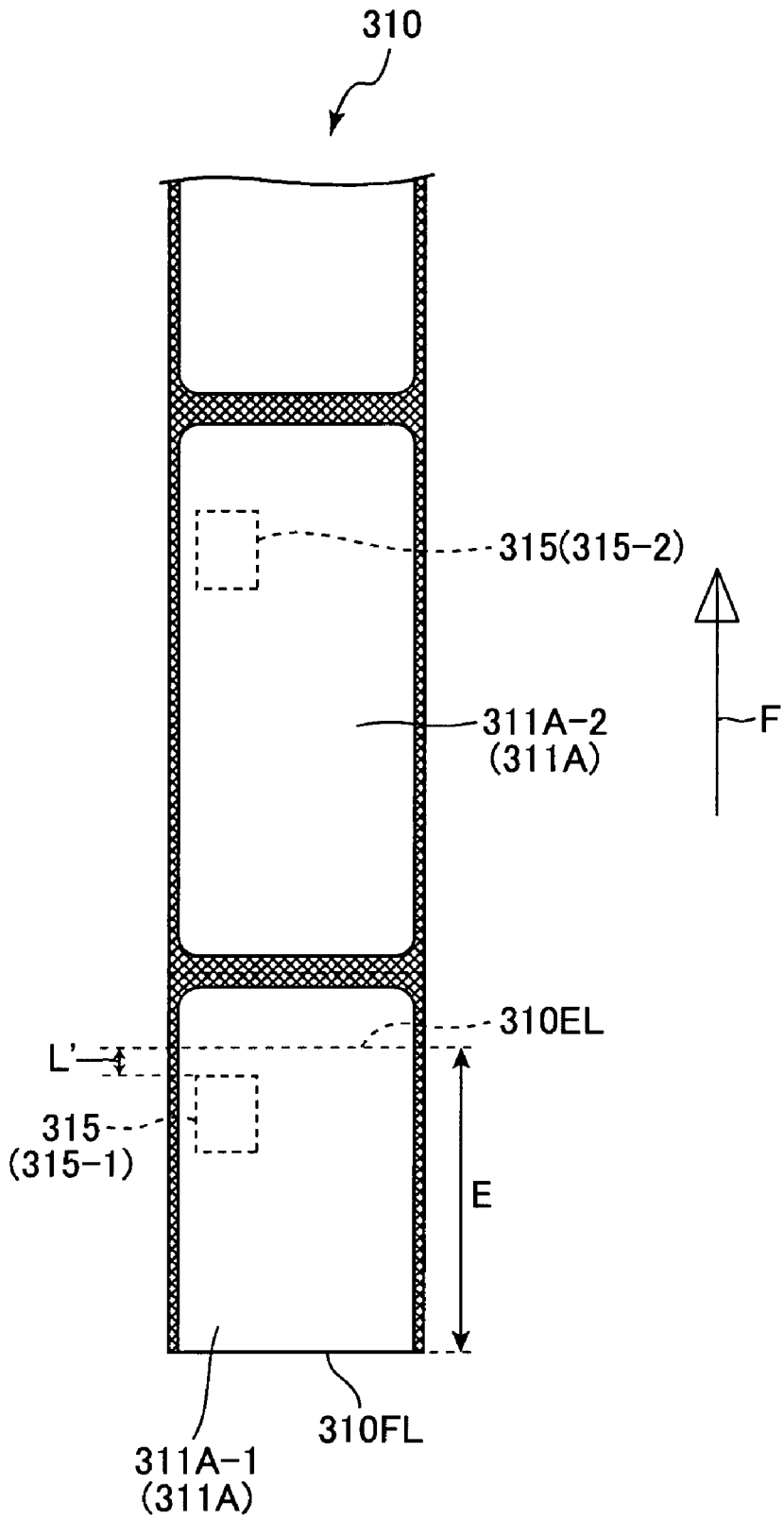
FIG. 21(B) is a plan view showing a printing surface side of the roll sheet at the folded trailing end portion shown in FIG. 21(A)

In the above description, the folding line 310FL is located in the end label 311A-1 on the second label 311A-2 side with respect to the center line 311A-1C. However, the folding line 310FL may be located in the end label 311A-1 on the trailing end line 310EL side with respect to the center line 311A-1C in the feeding direction F as shown in FIG. 21(A), FIG. 21(B), and FIG. 21(C).

In this modification, the folding line 310FL is located so that only the sensor mark 315-1 is hidden by the folded part of the roller sheet 310. Also in this modification, a distance E is defined between the folding line 310FL and the trailing end line 310EL. The roll sheet 310 is folded at the folding line 310 FL so that the release paper 312 face inwardly and the recording labels 311A face outwardly. As shown in FIG. 21(C), when the roll sheet 310 is folded at the folding line 310FL, a length L' is defined between the trailing end line 310EL and the leading edge of the sensor mark 315-1 in the feeding direction F.

Figure 21C:
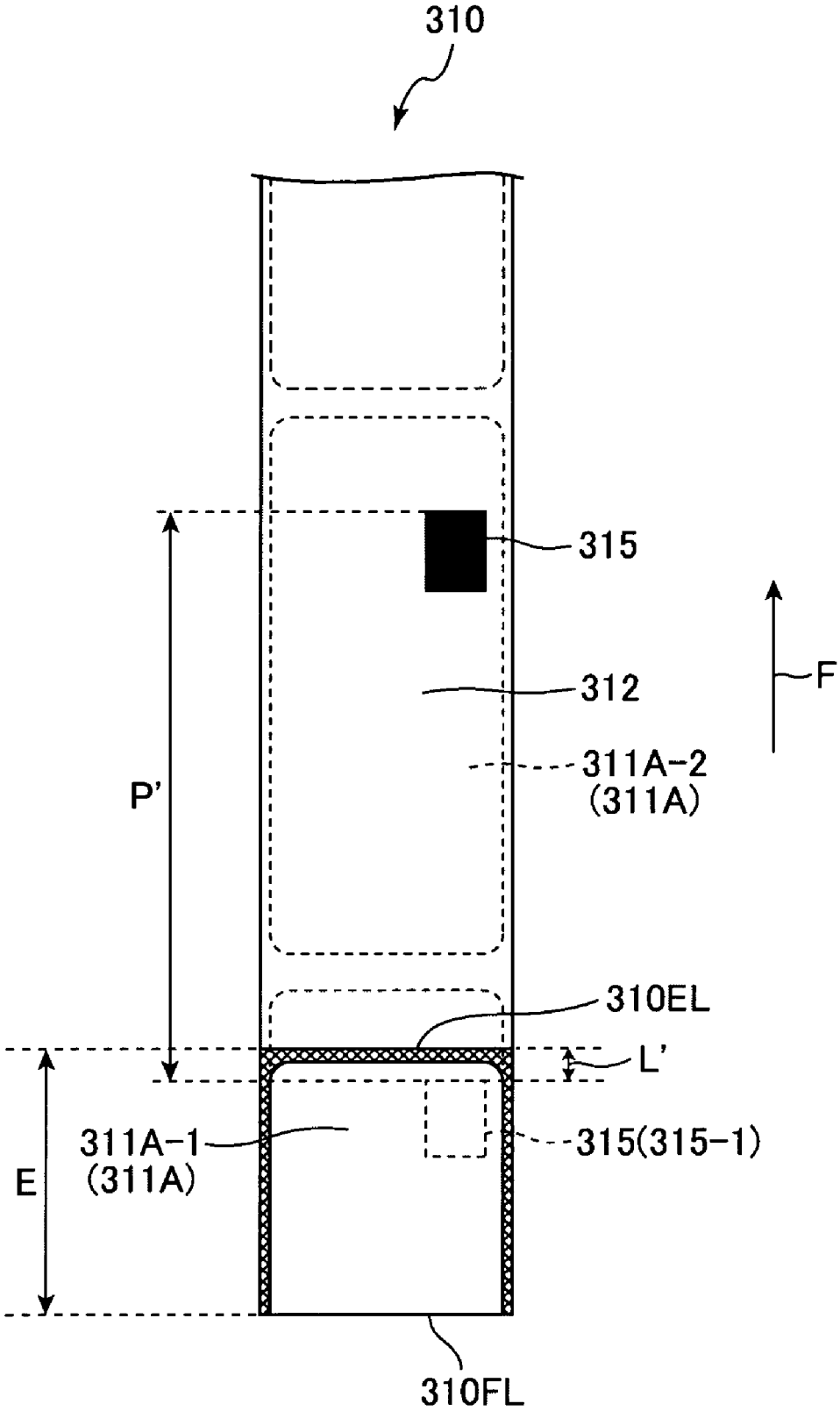
FIG. 21(C) is a plan view showing a sensing surface side of the roll sheet at the folded trailing end portion of FIG. 21(A)
Figure 21D:
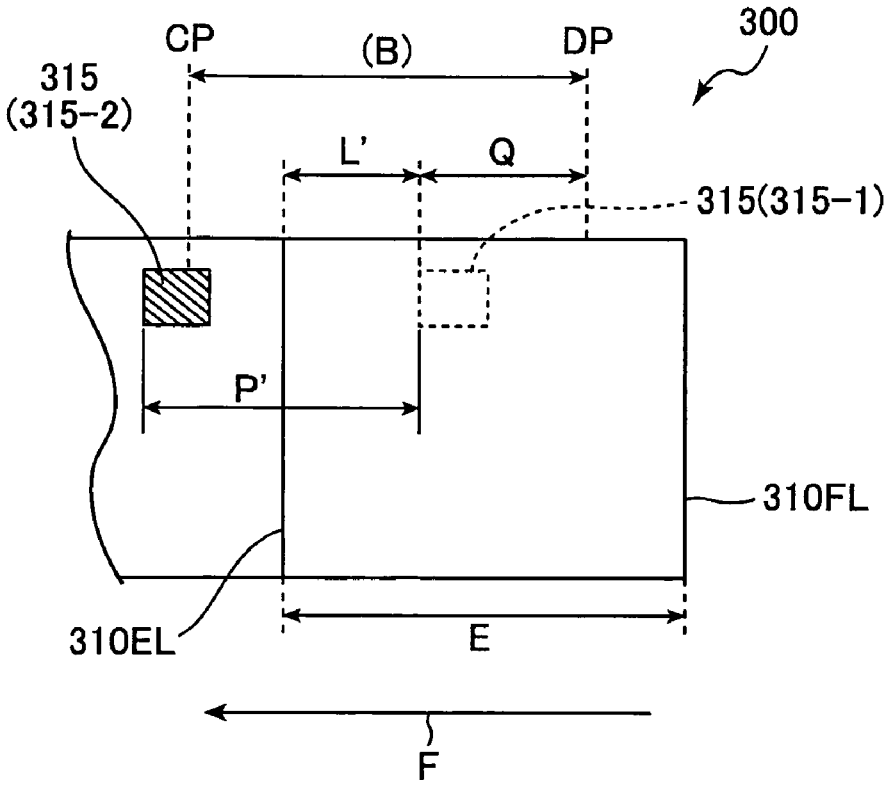
FIG. 21(D) is a plan illustration showing the positional relationship between the folded trailing end portion of the roll sheet of FIG. 21(A) and a cutting position CP and a detecting position DP.

As shown in FIG. 21(C), after the optical sensor 95 detects the second sensor mark 315-2, the tape printer 1 still continues feeding the roll sheet 300 by the pitch P', in order to allow the optical sensor 95 to try detecting the next sensor mark 315-1. Because the sensor mark 315-1 is hidden by the folded part of the roll sheet 310, the tape printer 1 fails to detect the sensor mark 315-1. In this case, the tape printer 1 further continues feeding the roll sheet 310 by the predetermined length Q after the optical sensor 95 fails to detect the sensor mark 315-1, as shown in FIG. 21(D), before finally determining that the optical sensor 95 has detected a trailing end of the roll sheet 310. The tape printer 1 finally stops feeding the roll sheet 310 when the tape printer 1 finally determines that the optical sensor 95 has detected a trailing end of the roll sheet 310. In other words, the tape printer 1 finally stops feeding the roll sheet 310 when the optical sensor 95 confronts the position of the roll sheet 310 that is distant from the sensor mark 315-1 by the length Q in the direction opposite to the feeding direction F.

According to this modification, the folding line 310FL is set so that the total length of the length Q and the distance L' is smaller than both of the DP-CP feed path length B and the length E.

Figure 21E:
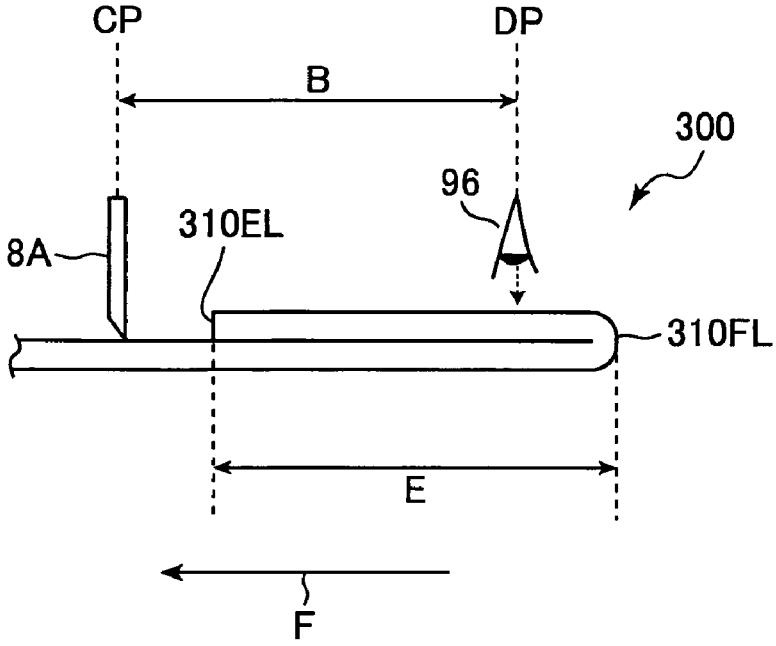
FIG. 21(E) is a side illustration showing a positional relationship between the folded trailing end portion of the roll sheet of FIG. 21(A) and the cutting position CP and the detecting position DP.

Because the sum (L'+Q) is smaller than B, when the tape printer 1 finally stops feeding the roll sheet 310, the trailing end line 310EL has not yet reached the cutting position CP as shown in FIG. 21(D) and FIG. 21(E). This ensures that the trailing end line 310EL of the roll sheet 310 will not reach the cutting position CP before the tape printer 1 finally stops feeding the roll sheet 310. It is possible to prevent the cutting unit 8 from cutting the folded part of the roll sheet 310 that has two sheets' worth of thickness. It is therefore possible to prevent occurrence of damage to the blade 8A and the occurrence of feed jams along the feed path.

Because the sum (L'+Q) is smaller than E, when the tape printer 1 finally stops feeding the roll sheet 310, the folding line 310FL has not yet reached the detecting position DP. This ensures that the folding line 310FL of the roll sheet 310 will not reach the detecting position DP before the tape printer 1 finally stops feeding the roll sheet 300. It is possible to prevent the entire part of the roll sheet 310 from erroneously passing by the optical sensor 95 before finally stopping feeding the roll sheet 310.

According to the present modification, only the end label 311A-1 may not be used for printing, but the second label 311A-2 can be used for printing.

THIRD EXAMPLE

Next, a roll sheet 320 according to a third example of the roll sheet 3A will be described with reference to FIG. 22(A) and FIG. 22(B).

Similarly to the roll sheet 310 of the second example, the roll sheet 320 has a three-layer structure. More specifically, the roll sheet 320 has: a release paper 322; a recording paper 321; and an adhesive layer (not shown) provided between the recording paper 321 and the release paper 322. The release paper 322, the recording paper 321, and the adhesive layer are made from the same material with the release paper 302, the recording paper 301, and the adhesive layer 308 in the roll sheet 300 of the first example. The positional relationship between the release paper 322, the recording paper 321, and the adhesive layer in the roll sheet 320 is the same as that between the release paper 302, the recording paper 301, and the adhesive layer 308 in the roll sheet 300 of the first example.

Similarly to the roll sheet 300 of the first example, the roll sheet 320 is rolled up into a roll shape, with its trailing end 320*te* being located in an innermost position in the roll and its leading end 3201*e* being located in an outermost position in the roll as shown in FIG. 4. In the roll, the release paper 322 faces outwardly and the recording paper 321 faces inwardly. When the roll of the roll sheet 320 is set in the roll sheet holder 3 and is mounted in the tape printer 1, the roll sheet 320 is unwound from the roll in succession from the leading end 3201*e* toward the trailing end 320*te* and is fed along the feeding path in the feeding direction F. While the roll sheet 320 is fed along the feeding path, the recording paper 321 confronts the thermal head 31 to be printed on by the thermal head 31, and the release paper 322 confronts the optical detector 95 to be detected thereby.

Additionally, similarly to the first peel-away area 313, the second peel-away area 314, and the third peel-away area 319 in the second example, a first peel-away area 323, a second peel-away area 324, and a third peel-away area 329 are formed on the release paper 322 on its surface where the recording paper 321 is attached. In other words, the release paper 322 is exposed on the recording surface at the peel-away areas 323, 324, and 329 as shown in FIG. 22(A). The recording paper 321 is divided into a plurality of labels 321A by the peel-away areas 329. The plurality of recording labels 321A are arranged at a fixed pitch P'. A third peel-away area 329 is located between each two adjacent recording labels 321A.

In this example, the roll sheet 320 has a tape width of 66 mm. As shown in FIG. 22(A), each recording label 321A is substantially of a rectangular shape with four rounded corners. The recording label 321A has a longer side in the widthwise direction of the roll sheet 320 and a shorter side in the lengthwise direction of the roll sheet 320. In this example, each recording label 321A has a size of 62 mm (length in the widthwise direction of the roll sheet 320)×29 mm (width in the lengthwise direction of the roll sheet 320). The spacing between each two adjacent recording labels 321A is 6 mm. In other words, each third peel-away area 329 extends by an amount of 6 mm in the lengthwise direction of the roll sheet 320. Each of the peel-away areas 323 and 324 has a width of 2 mm.

Figure 22A:
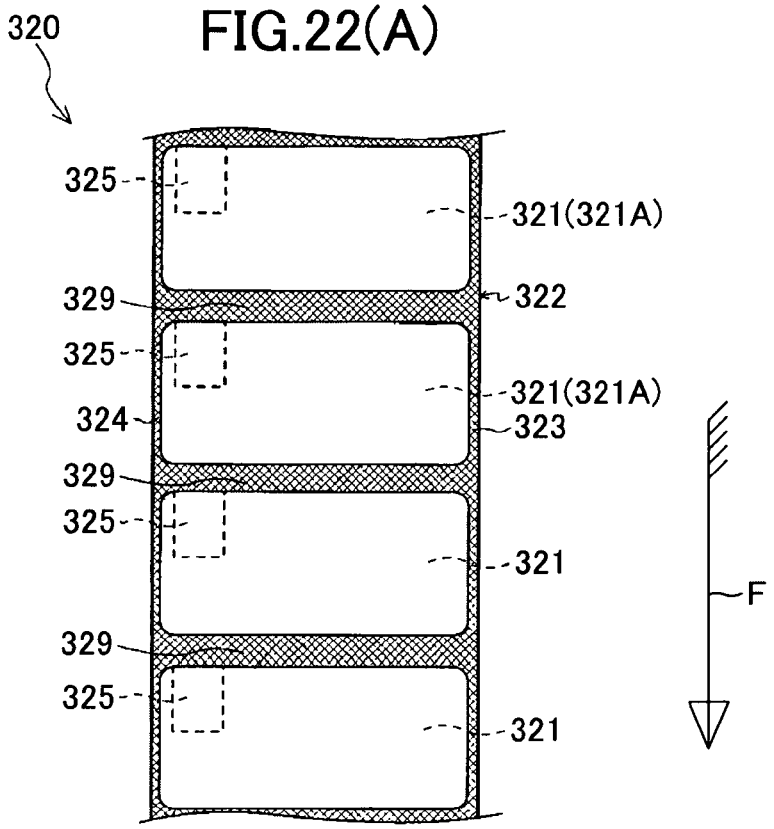
FIG. 22(A) is a plan view showing a recording surface of an unwound portion of a roll sheet according to a third example of the embodiment.
Figure 22B:
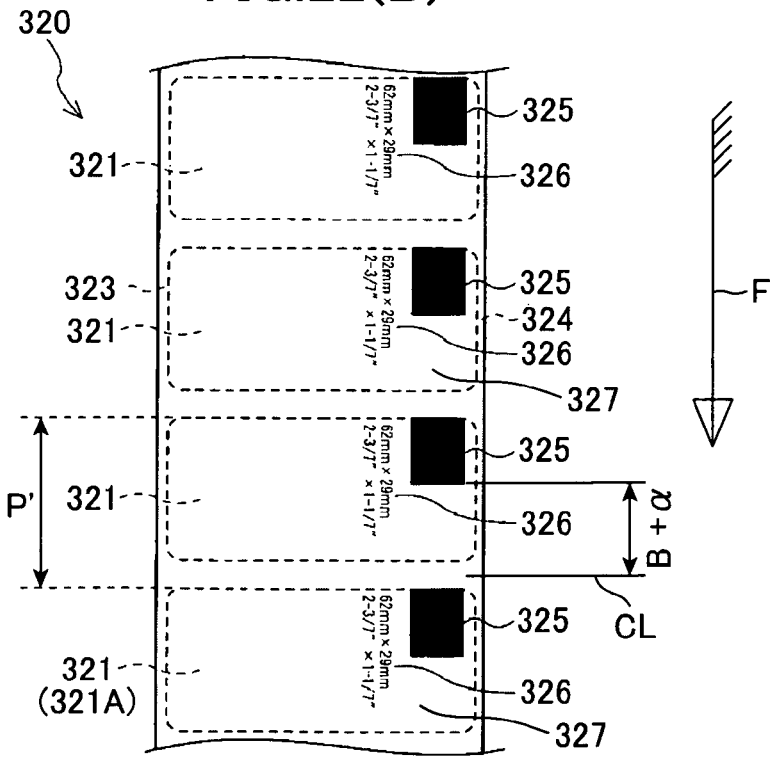
FIG. 22(B) is a plan view showing a sensing surface of the unwound portion of the roll sheet of FIG. 22(A)

As shown in FIG. 22(B), on the sensing surface of the roll sheet 320, a plurality of sensor marks 325 are printed on the release paper 322 at its one widthwise side (right side in the figure) of the roll sheet 320. The plurality of sensor marks 325 are printed in one-to-one correspondence with the plurality of labels 321A. The sensor marks 325 are therefore printed at the predetermined pitch P' along the longitudinal direction of the roll sheet 320. Each sensor mark 325 is printed in a rectangle filled with black. In this example, each sensor mark 325 has the shape of a rectangle with a longer side of 13 mm (lengthwise direction of the roll sheet 320) and a shorter side of 10 mm (widthwise direction of the roll sheet 320). An inter-mark area 327 is defined between each two adjacent sensor marks 325 in the feeding direction F.

As shown in FIG. 22(A) and FIG. 22(B), each sensor mark 325 is located with its entire area being located within the corresponding label 321A. More specifically, each sensor mark 325 is located at such a position that no part of the sensor mark 325 is located on any parts of the peel-away area 323, 324, or 329, but the entire part of the sensor mark 325 is located on a corresponding recording label 321A. In this example, each sensor mark 325 is located with its rightside edge (in FIG. 22(B)) being located at a position that is more than 2 mm (for example, 4.5 mm) apart from the rightside edge of the roll sheet 320. Accordingly, similarly to the sensor mark 315 in the second example, the sensor mark 325 can exhibit the uniform amount of light reflectivity and the uniform amount of light transmittance. Similarly to the inter-mark area 317 in the second example, the inter-mark area 327 can exhibit the uniform amount of light reflectivity and the uniform amount of light transmittance.

Similarly to the characters and/or symbols 316 in the second example, characters and/or symbols 326 are printed at positions that are shifted by an amount G (6 mm, in this example) from the leftside edge (in FIG. 22(B)) of the sensor marks 325. The characters and/or symbols 316 are for identifying the roll sheet 320. More specifically, the characters and/or symbols 326 indicate: the tape type and tape width of the tape 320, the size of the recording labels 321A, and the like.

As shown in FIG. 22(B), a cutting line CL for each label 321A is defined in the third peel-away area 329 that is located on the leading edge of the subject label 311A in the feeding direction F. For each label 321A, a sensor mark 325 is located in the feeding direction F that the leading edge of the sensor mark 325 is distant from the corresponding cutting line CL by an amount that is equal to a sum of the DP-CP feed path length B and the predetermined fixed amount $\alpha$. This ensures that the cutting line CL for one label 321A will reach the cutting position CP when the tape printer 1 feeds the roll sheet 320 by the predetermined fixed amount $\alpha$ after the optical sensor 95 has detected the sensor mark 325 for the subject label 321A.

FOURTH EXAMPLE

Next, a roll sheet 330 according to a fourth example of the roll sheet 3A will be described with reference to FIG. 23(A) and FIG. 23(B).

Similarly to the roll sheet 320 of the third example, the roll sheet 330 has a three-layer structure. More specifically, the roll sheet 330 has: a release paper 332; a recording paper 331; and an adhesive layer (not shown) provided between the recording paper 331 and the release paper 332. The release paper 332, the recording paper 331, and the adhesive layer are made from the same material with the release paper 302, the recording paper 301, and the adhesive layer 308 in the roll sheet 300 of the first example. The positional relationship between the release paper 332, the recording paper 331, and the adhesive layer in the roll sheet 330 is the same as that between the release paper 302, the recording paper 301, and the adhesive layer 308 in the roll sheet 300 of the first example.

Similarly to the roll sheet 300 of the first example, the roll sheet 330 is rolled up into a roll shape, with its trailing end 330*te* being located in an innermost position in the roll and its leading end 3301*e* being located in an outermost position in the roll as shown in FIG. 4. In the roll, the release paper 332 faces outwardly and the recording paper 331 faces inwardly. When the roll of the roll sheet 330 is set in the roll sheet holder 3 and is mounted in the tape printer 1, the roll sheet 330 is unwound from the roll in succession from the leading end 3301*e* toward the trailing end 330*te* and is fed along the feeding path in the feeding direction F. While the roll sheet 330 is fed along the feeding path, the recording paper 331 confronts the thermal head 31 to be printed on by the thermal head 31, and the release paper 332 confronts the optical detector 95 to be detected thereby.

Additionally, similarly to the first peel-away area 313, the second peel-away area 314, and the third peel-away area 319 in the second example, a first peel-away area 333, a second peel-away area 334, and a third peel-away area 339 are formed on the release paper 332 on its surface where the recording paper 321 is attached. In other words, the release paper 332 is exposed on the recording surface at the peel-away areas 333, 334, and 339 as shown in FIG. 23(A). The recording paper 331 is divided into a plurality of labels 331A by the peel-away areas 339. The plurality of recording labels 331A are arranged at a fixed pitch P'. A third peel-away area 339 is located between each two adjacent recording labels 331A.

In this example, the roll sheet 330 has a tape width of 19 mm. As shown in FIG. 23(A), each recording label 331A is substantially of a rectangular shape with four rounded corners. The recording label 331A has a longer side in the lengthwise direction of the roll sheet 330 and a shorter side in the widthwise direction of the roll sheet 330. In this example, each recording label 331A has a size of 54 mm (length in the lengthwise direction of the roll sheet 330)×17 mm (width in the widthwise direction of the roll sheet 330). The spacing between each two adjacent recording labels 331A is 6 mm. In other words, each third peel-away area 339 extends by an amount of 6 mm in the lengthwise direction of the roll sheet 330. Each of the peel-away areas 333 and 334 has a width of 1 mm.

Figure 23A:
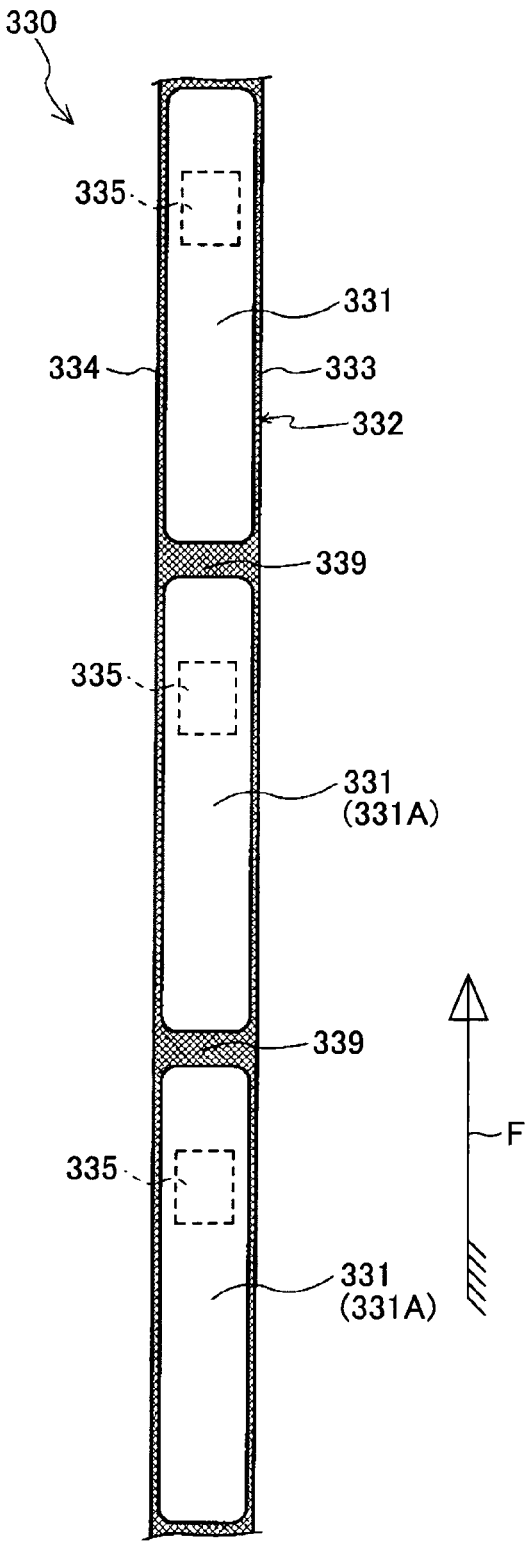
FIG. 23(A) is a plan view showing a recording surface of an unwound portion of a roll sheet according to a fourth example of the embodiment.
Figure 23B:
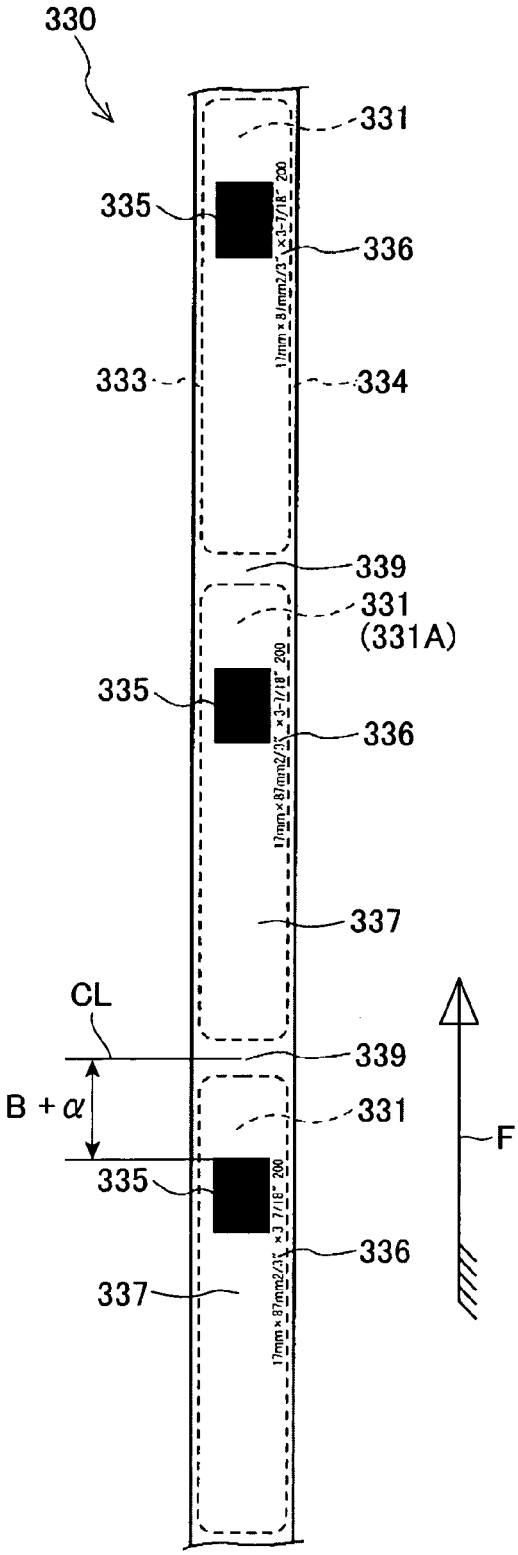
FIG. 23(B) is a plan view showing a sensing surface of the unwound portion of the roll sheet of FIG. 23(A)

As shown in FIG. 23(B), on the sensing surface of the roll sheet 330, a plurality of sensor marks 335 are printed on the release paper 332 at its substantially center location in the widthwise direction of the roll sheet 330. The plurality of sensor marks 335 are printed in one-to-one correspondence with the plurality of labels 331A. The sensor marks 335 are therefore printed at the predetermined pitch P' along the longitudinal direction of the roll sheet 330. Each sensor mark 335 is printed in a rectangle filled with black. In this example, each sensor mark 335 has the shape of a rectangle with a longer side of 13 mm (lengthwise direction of the roll sheet 330) and a shorter side of 10 mm (widthwise direction of the roll sheet 330). An inter-mark area 337 is defined between each two adjacent sensor marks 335 in the feeding direction F.

As shown in FIG. 23(A) and FIG. 23(B), each sensor mark 335 is located with its entire area being located within the corresponding label 331A. More specifically, each sensor mark 335 is located at such a position that no part of the sensor mark 335 is located on any parts of the peel-away area 333, 334, or 339, but the entire part of the sensor mark 335 is located on a corresponding recording label 331A. Accordingly, similarly to the sensor mark 325 in the third example, the sensor mark 335 can exhibit the uniform amount of light reflectivity and the uniform amount of light transmittance. Similarly to the inter-mark area 327 in the third example, the inter-mark area 337 can exhibit the uniform amount of light reflectivity and the uniform amount of light transmittance. Similarly to the characters and/or symbols 326 in the third example, characters and/or symbols 336 for identifying the roll sheet 330 are also printed on the sensing surface of the roll sheet 330. The characters and/or symbols 336 are located on the right side of the sensor marks 335 on the release paper 332.

As shown in FIG. 23(B), a cutting line CL for each label 331A is defined in the third peel-away area 339 that is located on the leading edge of the subject label 331A in the feeding direction F. For each label 331A, a sensor mark 335 is located in the feeding direction F that the leading edge of the sensor mark 335 is distant from the corresponding cutting line CL by an amount that is equal to a sum of the DP-CP feed path length B and the predetermined fixed amount α. This ensures that the cutting line CL for one label 331A will reach the cutting position CP when the tape printer 1 feeds the roll sheet 330 by the predetermined fixed amount α after the optical sensor 95 has detected the sensor mark 335 for the subject label 331A.

FIFTH EXAMPLE

Next, a roll sheet 340 according to a fifth example of the roll sheet 3A will be described with reference to FIG. 24(A) and FIG. 24(B).

Similarly to the roll sheet 330 of the fourth example, the roll sheet 340 has a three-layer structure. More specifically, the roll sheet 340 has: a release paper 342; a recording paper 341; and an adhesive layer (not shown) provided between the recording paper 341 and the release paper 342. The release paper 342, the recording paper 341, and the adhesive layer are made from the same material with the release paper 302, the recording paper 301, and the adhesive layer 308 in the roll sheet 300 of the first example. The positional relationship between the release paper 342, the recording paper 341, and the adhesive layer in the roll sheet 340 is the same as that between the release paper 302, the recording paper 301, and the adhesive layer 308 in the roll sheet 300 of the first example.

Similarly to the roll sheet 300 of the first example, the roll sheet 340 is rolled up into a roll shape, with its trailing end 340*te* being located in an innermost position in the roll and its leading end 3401*e* being located in an outermost position in the roll as shown in FIG. 4. In the roll, the release paper 342 faces outwardly and the recording paper 341 faces inwardly. When the roll of the roll sheet 340 is set in the roll sheet holder 3 and is mounted in the tape printer 1, the roll sheet 340 is unwound from the roll in succession from the leading end 3401*e* toward the trailing end 340*te* and is fed along the feeding path in the feeding direction F. While the roll sheet 340 is fed along the feeding path, the recording paper 341 confronts the thermal head 31 to be printed on by the thermal head 31, and the release paper 342 confronts the optical detector 95 to be detected thereby.

Additionally, similarly to the first peel-away area 303 and the second peel-away area 304 in the first example, a first peel-away area 343 and a second peel-away area 344 are formed on the release paper 342 on its surface where the recording paper 341 is attached. In other words, the release paper 342 is exposed on the recording surface at the peel-away areas 343 and 344 as shown in FIG. 24(A).

A plurality of donut-shaped labels 341A are formed on the roll sheet 340 by forming a plurality of pair of outer and inner concentric ring-shaped cut lines 341*a* and 341*b* through the recording paper 341. The plurality of cut lines 341*a* and 341*b* divide the recording paper 341 into a plurality of donut-shaped labels 341A, a center circle portion 341B, and an outer remaining portion 341C. When one donut-shaped label 341A is peeled off from the release paper 342, the corresponding center circle 341B and the outer remaining portion 341C remains on the release paper 342.

In this example, the roll sheet 340 has a tape width of 66 mm. As shown in FIG. 24(A), each donut-shaped label 341A has an outer diameter of 58 mm and an inner diameter of 16 mm. The spacing between each two adjacent recording labels 341A is 6 mm. Each of the peel-away areas 343 and 344 has a width of 2 mm.

Figure 24A:
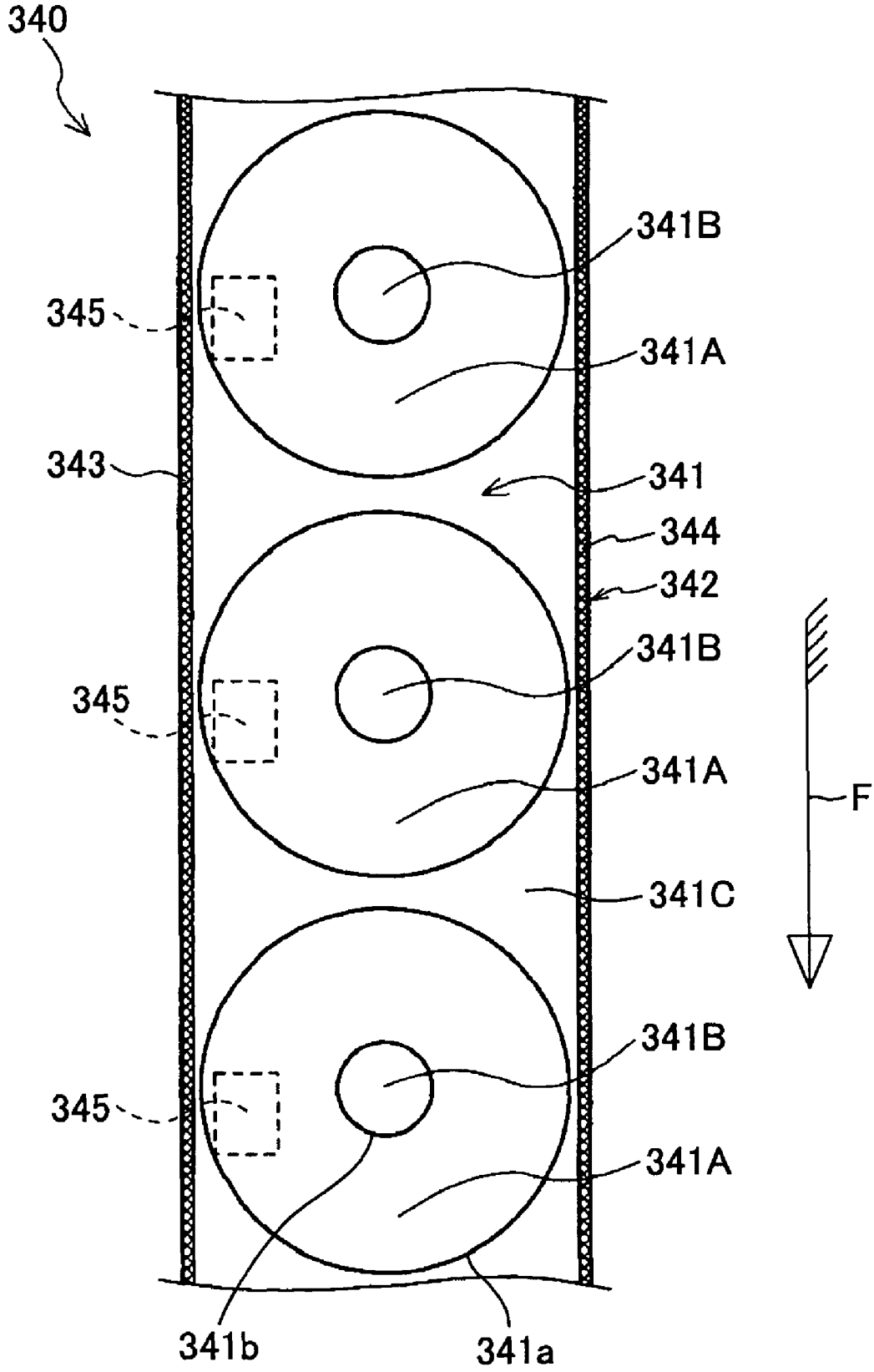
FIG. 24(A) is a plan view showing a recording surface of an unwound portion of a roll sheet according to a fifth example of the embodiment.
Figure 24B:
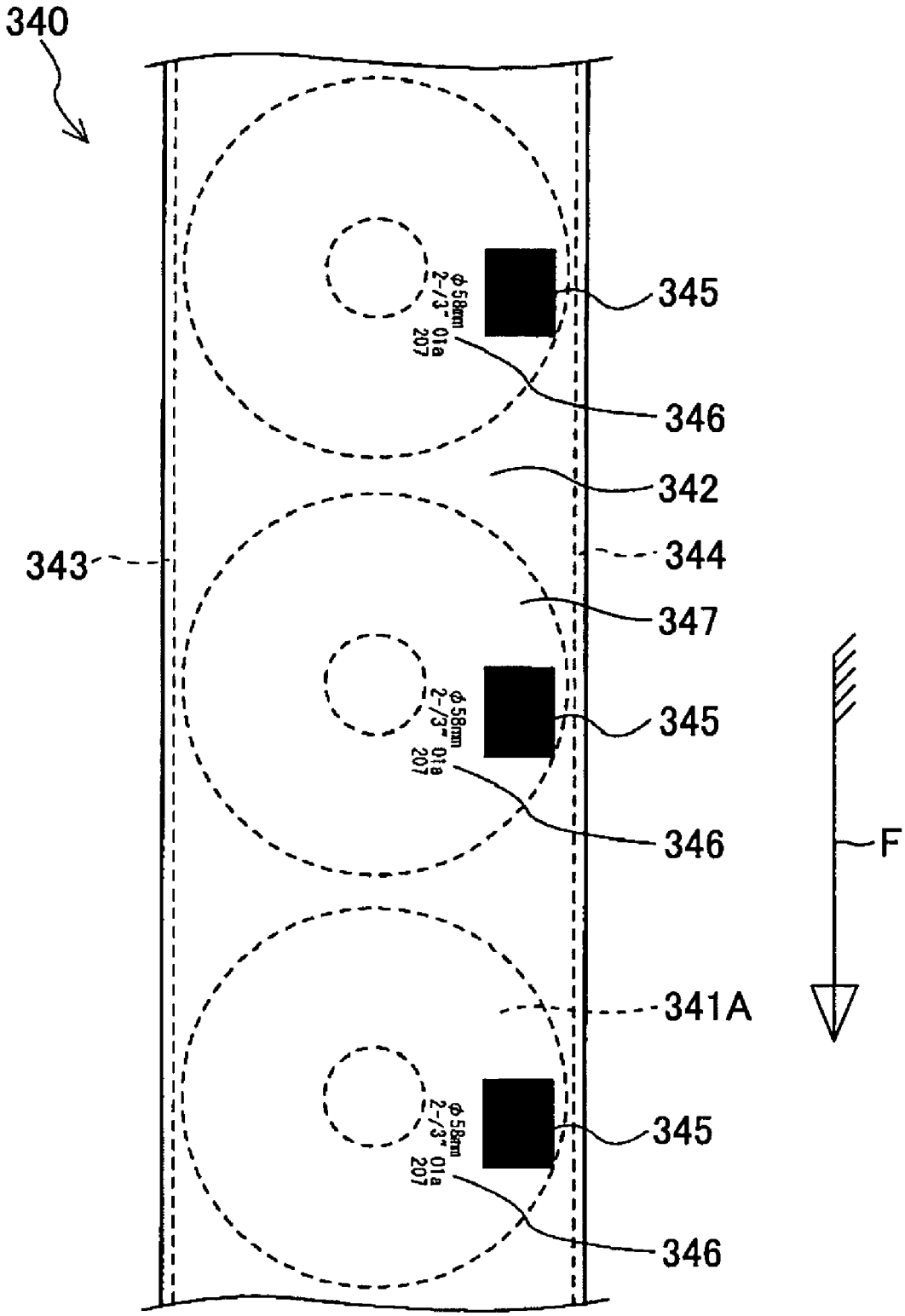
FIG. 24(B) is a plan view showing a sensing surface of the unwound portion of the roll sheet of FIG. 24(A).

As shown in FIG. 24(B), on the sensing surface of the roll sheet 340, a plurality of sensor marks 345 are printed on the release paper 332 in one-to-one correspondence with the plurality of labels 341A. Each sensor mark 345 is printed in a rectangle filled with black. In this example, each sensor mark 345 has the shape of a rectangle with a longer side of 13 mm (lengthwise direction of the roll sheet 340) and a shorter side of 10 mm (widthwise direction of the roll sheet 340). An inter-mark area 347 is defined between each two adjacent sensor marks 345 in the feeding direction F.

As shown in FIG. 24(A) and FIG. 24(B), each sensor mark 345 is located at such a position that no part of the sensor mark 345 is located on any parts of the peel-away area 343 or 344, but the entire part of the sensor mark 345 is located on a corresponding recording label 341A. Accordingly, similarly to the sensor mark 335 in the fourth example, the sensor mark 345 can exhibit the uniform amount of light reflectivity and the uniform amount of light transmittance. Similarly to the inter-mark area 337 in the fourth example, the inter-mark area 347 can exhibit the uniform amount of light reflectivity and the uniform amount of light transmittance.

In this example, each sensor mark 345 is located with its entire area being located within the corresponding donut-shaped label 341A, that is, between the outer edge 341*a* and the inner edge 341*b* of the corresponding donut-shaped label 341A.

However, it is sufficient that the sensor marks 345 be located in one-to-one correspondence with the donut-shaped labels 341A if the entire parts of the sensor marks 345 are located on the recording paper 341. In other words, each sensor mark 345 may cross the outer edge 341*a* of the corresponding donut-shaped label 341A to protrude into the outer remaining portion 341C. Each sensor mark 345 may cross the center circle portion 341B to protrude into the center circle portion 341B.

Similarly to the characters and/or symbols 326 in the third example, characters and/or symbols 346 for identifying the roll sheet 340 are also printed on the sensing surface of the roll sheet 340. The characters and/or symbols 346 are printed on the release paper 332 at a location that is separated by an amount G of 6 mm or more away from the leftside edge of the sensor marks 345.

As described above, on each of the roll sheets 300 to 340, each sensor mark is printed on the release paper so that the entire part of the sensor mark is located on the recording paper, with no part of the sensor mark being located on any peel-away area. This ensures that the thickness directly under each sensor mark is constant over the entire area of the sensor mark. This ensures that the sensor mark exhibits a uniform amount of light reflectivity and a uniform amount of transmittance over the entire area of the sensor mark, thereby preventing errors from arising during read-in of the sensor mark by the optical sensor 95.

Similarly, on each of the roll sheets 300 to 340, the entire part of each inter-mark area is located on the recording paper, with no part of the inter-mark area being located on any peel-away area. This ensures that the thickness directly under each inter-mark area is constant over its entire area. This ensures that the inter-mark area exhibits a uniform amount of light reflectivity and a uniform amount of transmittance over its entire area, thereby preventing errors from arising during read-in of the inter-mark area by the optical sensor 95.

It is noted that because the sum (B+$\alpha$) of the DP-CP feed path length B and the predetermined fixed amount $\alpha$ is unique to the tape printer 1, the distance between the sensor mark and the corresponding cutting line CL is the same for all the roll sheets 310, 320, and 330 in the second through fourth examples.

While the invention has been described in detail with reference to the specific embodiment thereof, it would be apparent to those skilled in the art that various changes and modifications may be made therein without departing from the spirit of the invention.

For example, as the optical sensor 95, a transmissive sensor may be used instead of the reflective sensor.

Furthermore, shapes of the roll sheets are not limited to those in the first to fifth examples described above, but roll sheets of any shape can be applied to the present invention.

In addition, the distance G, at which the characters or symbols indicating the roll sheet's identification information are separate from the sensor marks, can be any amount of distance that is large enough to prevent the density of the characters or symbols from becoming lighter due to the printing of the sensor marks.

In the third through fifth examples, the trailing end portion of the roll sheet may be folded up in the same manner as in the second example. Alternatively, the trailing end portion of the roll sheet may not be folded up.

Additionally, even when the sensor marks are partly located on the peel-away areas as shown in FIG. 17(A) and FIG. 17(B), by folding up the trailing end portion of the roll sheet as described above, the trailing end portion of the roll sheet can be detected accurately.

What is claimed is:

1. A tape, the tape comprising:

a release layer, which is elongated to extend in a lengthwise direction and which has a pair of side edges that extend along the lengthwise direction, the pair of side edges being separate from each other in a widthwise direction that is substantially perpendicular to the lengthwise direction, the release layer having a first surface and a second surface opposite to the first surface, an entire area of the second surface including a pair of non-recording regions and a recording region, the pair of non-recording regions extending along both side edges of the second surface, the recording region being located between the pair of non-recording regions, a plurality of sensor marks being formed on the first surface, the sensor marks being arranged in the lengthwise direction, an entire part of each sensor mark being located on the first surface at a region that corresponds to the recording region and that is shifted offset from the pair of non-recording regions; and a recording medium provided over the recording region of the second surface of the release layer via an adhesive layer, the recording medium being able to be peeled off from the release layer;

wherein the release layer has a trailing end line, the trailing end line extending in the widthwise direction, the lengthwise direction extending from the trailing end line substantially perpendicularly thereto, the release layer being rolled up together with the recording medium to form a roll with the trailing end line being located at an innermost part of the roll with the printing medium facing inward and the first surface of the release layer facing outward, the tape being unwound by a tape printer and fed in the lengthwise direction when the tape is mounted in the tape printer, wherein a folding line is defined at a distance away from the trailing end line in the lengthwise direction, the folding line extending in the widthwise direction, an end portion being defined between the trailing end line and the folding line, a next-to-end portion being defined next to the end portion in the lengthwise direction to have a length the same as the end portion along the lengthwise direction, the tape being folded at the folding line, with the release layer in the end portion facing the release layer in the next-to-end portion to prevent the sensor marks on the release layer in the end portion and in the next-to-end portion from being exposed.

2. The tape as claimed in claim 1, wherein the sensor marks are arranged on the first surface of the release layer by a fixed interval along the entire length of the release layer in the lengthwise direction, and wherein when the tape is folded at the folding line, the sensor marks in the next-to-end portion are arranged as being shifted from the sensor marks in the end portion in the lengthwise direction.

3. The tape as claimed in claim 1, wherein each sensor mark has a length along the lengthwise direction, and the sensor marks are arranged with a spacing, defined between each two adjacent sensor marks, the spacing having another length along the lengthwise direction, the another length being greater than or equal to the length of the sensor mark.

4. The tape as claimed in claim 1, wherein the recording medium includes a plurality of labels, which are arranged along the lengthwise direction and which are able to be peeled off from the release layer independently from one another, the plurality of labels including an end label that is next to the trailing end line, a sensor mark being formed on the release layer at a location that corresponds to each label, the folding line being located at a position that is on the end label in the lengthwise direction.

5. The tape as claimed in claim 4, wherein the end label has a center line with respect to the lengthwise direction, the center line extending in the widthwise direction, the folding line being located on an opposite side of the trailing end line with respect to the center line in the lengthwise direction.

6. The tape as claimed in claim 4, wherein the end label has a center line with respect to the lengthwise direction, the center line extending in the widthwise direction, the folding line being located on the same side of the trailing end line with respect to the center line.

* * * * *